US010355419B2

(12) United States Patent
Gao et al.

(10) Patent No.: US 10,355,419 B2
(45) Date of Patent: Jul. 16, 2019

(54) CONNECTOR RECEPTACLE HAVING A SHIELD

(71) Applicant: Apple Inc., Cupertino, CA (US)

(72) Inventors: Zheng Gao, Sunnyvale, CA (US); Mahmoud R. Amini, Sunnyvale, CA (US); Nathan N Ng, Fremont, CA (US); Min Chul Kim, Santa Clara, CA (US); Colin Abraham, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/396,640

(22) Filed: Dec. 31, 2016

(65) Prior Publication Data

US 2017/0237202 A1 Aug. 17, 2017

Related U.S. Application Data

(63) Continuation of application No. 14/543,711, filed on Nov. 17, 2014, now Pat. No. 9,537,263.

(Continued)

(51) Int. Cl.
*H01R 13/6582* (2011.01)
*H01R 13/6591* (2011.01)

(Continued)

(52) U.S. Cl.
CPC ..... *H01R 13/6582* (2013.01); *H01R 13/627* (2013.01); *H01R 13/6273* (2013.01);

(Continued)

(58) Field of Classification Search
CPC ..... H01R 13/6581; H01R 13/6582; H01R 13/6591; H01R 13/627; H01R 24/60; H01R 2107/00
See application file for complete search history.

(56) References Cited

U.S. PATENT DOCUMENTS 3,128,138 A 4/1964 Noschese
3,587,029 A 6/1971 Knowles (Continued)

FOREIGN PATENT DOCUMENTS

CN 101882726 11/2010
CN 101908679 12/2010

(Continued)

OTHER PUBLICATIONS

Notice of Allowance dated Oct. 14, 2015 for U.S. Appl. No. 14/543,768, 9 pages.

(Continued)

*Primary Examiner* — Edwin A. Leon
*Assistant Examiner* — Oscar Jimenez
(74) *Attorney, Agent, or Firm* — Kilpatrick Townsend & Stockton, LLP

(57) ABSTRACT

Connector systems may include a connector receptacle and connector plug or insert. The connector receptacle may include a tongue. A first plurality of contacts may be formed on a top surface of the tongue. A first ground pad may be located on a top surface of tongue, and a shield may be formed around the tongue. The connector insert may include a housing and a conductive shield around the housing behind a leading edge of the connector insert. A front edge of the shield may be folded into an opening at the leading edge. In other examples, the receptacle shield may include one or more fingers. These fingers may contact the connector insert shield to form a ground path. One or more of these fingers may engage openings in the insert shield to provide a retention force between the connector insert and receptacle.

23 Claims, 59 Drawing Sheets

Related U.S. Application Data

(60) Provisional application No. 62/003,012, filed on May 26, 2014, provisional application No. 61/929,967, filed on Jan. 21, 2014, provisional application No. 61/927,468, filed on Jan. 14, 2014, provisional application No. 61/926,391, filed on Jan. 12, 2014, provisional application No. 61/922,853, filed on Jan. 1, 2014, provisional application No. 61/918,599, filed on Dec. 19, 2013, provisional application No. 61/905,279, filed on Nov. 17, 2013.

(51) Int. Cl.

| | |
|---|---|
| ***H01R 13/6581*** | (2011.01) |
| ***H01R 13/627*** | (2006.01) |
| ***H01R 13/6597*** | (2011.01) |
| ***H01R 24/60*** | (2011.01) |
| ***H01R 13/73*** | (2006.01) |
| *H01R 107/00* | (2006.01) |

(52) U.S. Cl.

CPC ..... *H01R 13/6581* (2013.01); *H01R 13/6591* (2013.01); *H01R 13/6597* (2013.01); *H01R 24/60* (2013.01); *H01R 13/73* (2013.01); *H01R 2107/00* (2013.01)

(56) References Cited

U.S. PATENT DOCUMENTS 4,337,989 A 7/1982 Asick et al.
4,389,080 A 6/1983 Clark et al.
4,544,227 A 10/1985 Hirose
4,571,012 A 2/1986 Bassler et al.
4,684,192 A 8/1987 Long et al.
4,808,118 A 2/1989 Wilson et al.
4,875,881 A 10/1989 Caveny et al.
4,950,184 A 8/1990 Caveney et al.
5,037,315 A 8/1991 Collier et al.
5,145,385 A 9/1992 Takano
5,164,880 A 11/1992 Cronin et al.
5,221,212 A 6/1993 Davis et al.
5,318,452 A 6/1994 Fortuna et al.
5,382,179 A 1/1995 Noschese
5,431,578 A 7/1995 Wayne
5,586,911 A 12/1996 Miller
5,591,050 A 1/1997 Sueoka
5,622,522 A 4/1997 Tan et al.
5,674,085 A 10/1997 Davis et al.
5,788,516 A 8/1998 Uggmark
5,913,690 A 6/1999 Dechelette et al.
5,975,935 A 11/1999 Yamaguchi et al.
5,975,957 A 11/1999 Noda
5,997,349 A 12/1999 Yoshioka
6,019,616 A 2/2000 Yagi et al.
6,039,583 A 3/2000 Korsunsky et al.
6,042,424 A 3/2000 LaCoy et al.
6,162,089 A 12/2000 Jacobson et al.
6,203,333 B1 3/2001 Medina et al.
6,273,749 B1 * 8/2001 Yang ..... H01R 9/0515 439/497
6,287,147 B1 9/2001 Lin
6,305,978 B1 * 10/2001 Ko ..... H01R 9/053 439/579
6,338,652 B1 1/2002 Ko
6,447,311 B1 9/2002 Hu et al.
6,565,366 B1 5/2003 Wu
6,685,486 B1 2/2004 Zhang et al.
6,736,676 B2 5/2004 Zhang et al.
6,755,689 B2 6/2004 Chu et al.
6,840,806 B2 1/2005 Kodama et al.
6,913,485 B2 7/2005 Ko et al.
6,926,557 B1 8/2005 Yamaguchi et al.
6,981,887 B1 1/2006 Mese et al.
6,984,150 B2 1/2006 Kondou et al.
7,052,287 B1 5/2006 Ni et al.
7,074,052 B1 7/2006 Ni et al.
7,086,889 B2 8/2006 Yin et al.
7,086,901 B2 8/2006 Zhang et al.
7,094,103 B2 8/2006 Lai et al.
7,128,588 B2 10/2006 Hu et al.
7,179,124 B2 2/2007 Zhang et al.
7,207,836 B2 4/2007 Tsai et al.
7,238,048 B2 7/2007 Olson
7,269,004 B1 9/2007 Ni et al.
7,275,962 B1 10/2007 Yamakami et al.
7,314,383 B1 1/2008 Ho et al.
7,364,464 B2 4/2008 Shen et al.
7,407,390 B1 8/2008 Ni
7,410,365 B2 8/2008 Wu
7,445,452 B1 11/2008 Wu
7,462,071 B1 12/2008 Wu
7,466,556 B2 12/2008 Hiew et al.
7,497,737 B2 3/2009 Mikolajczak et al.
7,508,677 B2 3/2009 Ice et al.
7,594,827 B2 9/2009 Takamoto et al.
7,604,497 B2 10/2009 Wu et al.
7,658,617 B1 2/2010 Brodsky et al.
7,670,156 B2 3/2010 Chen
7,686,656 B2 3/2010 He et al.
7,690,947 B2 4/2010 Gu
7,699,663 B1 4/2010 Little et al.
7,753,724 B2 7/2010 Gong et al.
7,837,506 B1 11/2010 Chiang
7,837,510 B1 11/2010 Hung et al.
7,841,905 B2 11/2010 He et al.
7,878,852 B2 2/2011 Hiew et al.
7,883,369 B1 2/2011 Sun et al.
7,988,491 B2 8/2011 Davis
7,997,909 B2 8/2011 Xu et al.
8,007,318 B1 8/2011 Dunwoody et al.
8,011,948 B2 9/2011 Wu
8,011,950 B2 9/2011 McGrath et al.
8,011,968 B2 9/2011 Lai et al.
8,047,875 B2 11/2011 Yamakami et al.
8,052,476 B2 11/2011 He et al.
8,062,053 B2 11/2011 Dooley
8,100,720 B2 1/2012 Hsu et al.
8,133,061 B1 3/2012 Ayers, Sr. et al.
8,147,272 B2 4/2012 Rhein
8,251,747 B2 8/2012 He et al.
8,298,009 B2 10/2012 Elkhatib et al.
8,393,907 B2 3/2013 Lee et al.
8,439,706 B2 5/2013 Sytsma et al.
8,454,381 B2 6/2013 Wu
8,475,218 B2 7/2013 Zheng et al.
8,476,110 B2 7/2013 Lee et al.
8,506,317 B2 8/2013 Bandhu et al.
8,545,273 B1 10/2013 Chen
8,562,369 B2 10/2013 Wu
8,567,050 B2 10/2013 Hiew et al.
8,579,519 B2 11/2013 Wu et al.
8,602,822 B2 12/2013 Siahaan et al.
8,662,933 B2 3/2014 Wu et al.
8,696,388 B2 4/2014 Gao
8,708,718 B2 4/2014 Li et al.
8,708,752 B2 4/2014 Wu
8,747,147 B2 6/2014 Yu et al.
8,764,492 B2 7/2014 Chiang
8,777,664 B2 7/2014 Gui et al.
8,794,981 B1 8/2014 Hayashida et al.
8,808,029 B2 8/2014 Castillo et al.
8,808,030 B2 8/2014 Gao et al.
8,814,443 B2 8/2014 He et al.
8,814,599 B2 8/2014 Wu et al.
8,821,181 B1 9/2014 Lam et al.
8,911,262 B1 12/2014 Leiba
8,992,249 B2 3/2015 Kobayashi et al.
9,065,212 B2 6/2015 Golko et al.
9,065,229 B2 6/2015 Yamaguchi et al.
9,276,340 B2 3/2016 Amini
9,281,608 B2 3/2016 Zhao
9,356,370 B2 5/2016 Lee et al.
9,496,653 B2 11/2016 Little

(56) References Cited

U.S. PATENT DOCUMENTS

| | | | | |
|---|---|---|---|---|
| 9,614,310 | B2 | 4/2017 | Tsai | |
| 9,660,399 | B2 | 5/2017 | Hsu | |
| 2002/0001982 | A1 | 1/2002 | Sakurada | |
| 2002/0039857 | A1 | 4/2002 | Naito et al. | |
| 2002/0142636 | A1 | 10/2002 | Murr et al. | |
| 2004/0198079 | A1 | 10/2004 | Aronson et al. | |
| 2005/0026469 | A1 | 2/2005 | Ice et al. | |
| 2006/0052005 | A1 | 3/2006 | Zhang et al. | |
| 2007/0072446 | A1 | 3/2007 | Hashimoto et al. | |
| 2007/0111600 | A1 | 5/2007 | Tokunaga | |
| 2007/0115682 | A1 | 5/2007 | Roberts et al. | |
| 2007/0254517 | A1 | 11/2007 | Olson | |
| 2009/0023339 | A1 | 1/2009 | Kameyama | |
| 2009/0042448 | A1 | 2/2009 | He et al. | |
| 2010/0248544 | A1 | 9/2010 | Xu et al. | |
| 2010/0267282 | A1 | 10/2010 | Tsai | |
| 2010/0303421 | A1 | 12/2010 | He et al. | |
| 2011/0151688 | A1 | 6/2011 | Beaman | |
| 2011/0237134 | A1 | 9/2011 | Gao et al. | |
| 2011/0300749 | A1 | 12/2011 | Sytsma et al. | |
| 2012/0015561 | A1 | 1/2012 | Tsai | |
| 2012/0030943 | A1 | 2/2012 | Hiew et al. | |
| 2012/0282808 | A1 | 11/2012 | Luo | |
| 2013/0005193 | A1 | 1/2013 | Tsai | |
| 2013/0045638 | A1 | 2/2013 | Gui et al. | |
| 2013/0122752 | A1 | 5/2013 | Lu | |
| 2013/0164965 | A1 | 6/2013 | Yin et al. | |
| 2013/0183862 | A1 | 7/2013 | Ni et al. | |
| 2013/0217253 | A1 | 8/2013 | Golko | |
| 2013/0244492 | A1 | 9/2013 | Golko et al. | |
| 2013/0288520 | A1 | 10/2013 | Simmel | |
| 2013/0288537 | A1 | 10/2013 | Simmel et al. | |
| 2013/0330976 | A1 | 12/2013 | Simmel et al. | |
| 2014/0024257 | A1 | 1/2014 | Castillo | |
| 2014/0073183 | A1 | 3/2014 | Golko | |
| 2014/0078695 | A1 | 3/2014 | Shih et al. | |
| 2014/0094066 | A1 | 4/2014 | Do | |
| 2014/0113493 | A1 | 4/2014 | Funamura | |
| 2014/0194005 | A1 | 7/2014 | Little | |
| 2014/0220827 | A1 | 8/2014 | Hsu | |
| 2014/0242848 | A1 | 8/2014 | Golko et al. | |
| 2015/0031240 | A1 | 1/2015 | Yang | |
| 2015/0044886 | A1* | 2/2015 | Little | H01R 12/75 439/55 |
| 2015/0093936 | A1* | 4/2015 | Little | H01R 13/6583 439/607.19 |
| 2015/0131245 | A1 | 5/2015 | Amini et al. | |
| 2015/0162684 | A1 | 6/2015 | Amini et al. | |
| 2015/0171562 | A1 | 6/2015 | Gao et al. | |
| 2015/0194772 | A1* | 7/2015 | Little | H01R 13/6597 439/357 |
| 2015/0200493 | A1 | 7/2015 | Gao et al. | |
| 2015/0207279 | A1* | 7/2015 | Little | H01R 24/60 439/607.01 |
| 2015/0214673 | A1 | 7/2015 | Gao et al. | |
| 2015/0244111 | A1 | 8/2015 | Ju | |
| 2015/0340782 | A1 | 11/2015 | Amini et al. | |

FOREIGN PATENT DOCUMENTS

| | | |
|---|---|---|
| CN | 102341970 | 2/2012 |
| EP | 1 085 604 | 3/2001 |
| EP | 2 228 871 | 9/2010 |
| EP | 2 590 273 | 5/2013 |
| GB | 2 067 361 | 7/1981 |
| WO | 2011/163256 | 12/2011 |
| WO | 2012/177905 | 12/2012 |

OTHER PUBLICATIONS

Office Action dated Nov. 10, 2015 for U.S. Appl. No. 14/543,717, 16 pages.

International Search Report and Written Opinion of the International Seaching Authority dated Mar. 17, 2015 for PCT Patent Application No. PCT/US2015/010253, 12 pages.

Invitation to Pay Additional Fees and, Where Applicable, Protest Fee with Partial International Search Report dated Apr. 28, 2015 for PCT Patent Application No. PCT/US2014/065968, 6 pages.

Invitation to Pay Additional Fees and, Where Applicable, Protest Fee with Partial International Search Report dated May 4, 2015 for PCT Patent Application No. PCT/US2014/065996, 7 pages.

International Search Report and Written Opinion of the International Seaching Authority dated Jul. 3, 2015 for PCT Patent Application No. PCT/US2014/065968, 17 pages.

International Search Report and Written Opinion of the International Seaching Authority dated Jul. 10, 2015 for PCT Patent Application No. PCT/US2014/065996, 18 pages.

Office Action dated Nov. 17, 2015 for U.S. Appl. No. 14/543,748, 21 pages.

Office Action dated Jan. 4, 2016 for U.S. Appl. No. 14/543,803, 14 pages.

Notice of Allowance dated Jan. 25, 2016, for U.S. Appl. No. 14/641,353, 8 pages.

Taiwan Office Action dated Nov. 23, 2015 for Taiwan Application No. 14/543,748, 7 pages.

Restriction Requirement dated Feb. 16, 2016, for U.S. Appl. No. 14/641,375, 5 pages.

Office Action, Chinese Patent Application No. 201410858208.7, dated Jul. 4, 2016, 19 pages.

International Preliminary Report on Patentability, International Patent Application No. PCT/US2014/065968, dated May 26, 2016, 12 pages.

International Preliminary Report on Patentability, International Patent Application No. PCT/US2014/065996, dated May 26, 2016, 14 pages.

Notice of Allowance, U.S. Appl. No. 14/543,717 , dated May 25, 2016, 8 pages.

Final Office Action, U.S. Appl. No. 14/543,748, dated Jun. 28, 2016, 21 pages.

Notice of Allowance, U.S. Appl. No. 14/543,803, dated Jun. 27, 2016, 7 pages.

First Action Interview Pilot Program Pre-Interview Communication, U.S. Appl. No. 14/641,375, dated May 16, 2016, 7 pages.

Notice of Preliminary Rejection (English Translation) dated Feb. 16, 2017 in Korean Patent Application No. 10-2016-7012626, 4 pages.

Office Action dated Mar. 8, 2017 in U.S. Appl. No. 15/263,645, 18 pages.

Notification of the Second Office Action (English Translation) dated Apr. 17, 2017 in Chinese Patent Application No. 201410858208.7, 7 pages.

Notice of Preliminary Rejection (English Translation) dated May 18, 2017 in Korean Patent Application No. 10-2016-7012914, 5 pages.

Notice of Allowance dated Jun. 19, 2017 in U.S. Appl. No. 15/168,036, 8 pages.

Office Action (English Translation) dated May 31, 2017 in Chinese Patent Application No. 201510013108.9, 10 pages.

Universal Serial Bus Type-C Cable and Connector Specification (Redline Revision from Apr. 3, 2015), USB 3.0 Promoter Group, 248 pages.

Universal Serial Bus Type-C Cable and Connector Specification (Revision 1.0), USB 3.0 Promoter Group, 171 pages.

Universal Serial Bus Type-C Cable and Connector Specification (Revision 1.2), USB 3.0 Promoter Group, 221 pages.

U.S. Appl. No. 15/482,830, First Action Interview Pilot Program Pre-Interview Communication dated Feb. 1, 2018, 7 pages.

Korean Application No. 10-2016-7012914, Office Action dated Dec. 28, 2017, 11 pages (6 pages of the original document and 5 pages of the English translation).

Office Action dated Aug. 10, 2017 in U.S. Appl. No. 15/368,691, 11 pages.

Notice of Allowance dated Aug. 16, 2017 in U.S. Appl. No. 15/268,645, 10 pages.

* cited by examiner

CONNECTOR PINOUT

| | | | | | | | | | |
|---|---|---|---|---|---|---|---|---|---|
| G | TX0 | TX0 | P | LSI | AP | LSTX | P | RXO | RXO | G |
| G | RX1 | RX1 | P | LSRX | CP | LSI | P | TX1 | TX1 | G |

FIG. 55

CONNECTOR PINOUT

| | | | | | | | | | | | | |
|---|---|---|---|---|---|---|---|---|---|---|---|---|
| 12T | G | HS1P | HS1N | HVP1 | C1 | USB1 | USB0 | RFU0 | HVP0 | HS0N | HS0P | G 1T |
| 1B | G | HS2P | HS2N | HVP2 | RFU1 | USB2 | USN3 | C2 | HVP3 | HS3N | HS3P | G 12B |

FIG. 56

| | | | | | | | | | | | | |
|---|---|---|---|---|---|---|---|---|---|---|---|---|
| **DP/HDMI TX** | GND | ML3+ | ML3- | P_HV | C1 | N.C | AUX+ | N.C | P_HV | ML1- | ML1+ | GND |
| **DP/ HDMI Rx** | GND | ML2+ | ML2- | P_HV | C1 | N.C | AUX+ | N.C | P_HV | ML0- | ML0+ | GND |
| **USB** | GND | SSTX1+ | SSTX1- | VBUS | C1 | D+ | N.C. | N.C | VBUS | SSRX2- | SSRX2+ | GND |
| **Power Only** | GND | N.C. | N.C. | VBUS | C1 | N.C. | SB_TX | N.C | VBUS | N.C. | N.C. | GND |

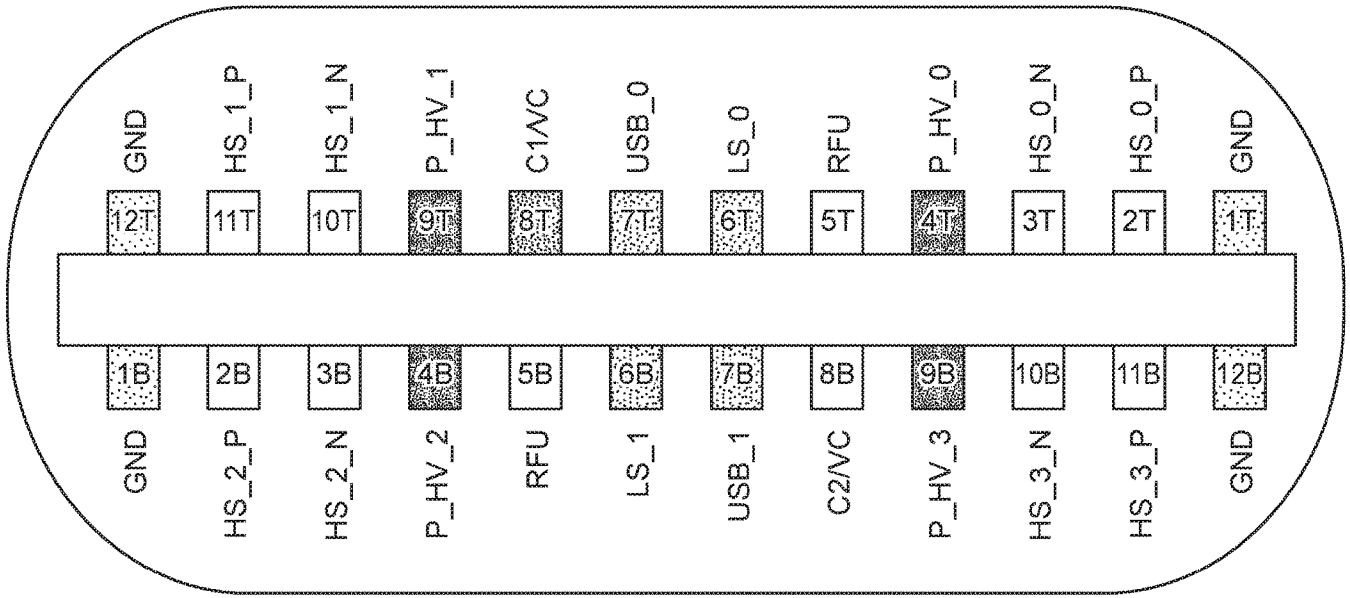

| | | | | | | | | | | | | |
|---|---|---|---|---|---|---|---|---|---|---|---|---|
| **Power Only** | GND | N.C. | N.C. | VBUS | GND | N.C | N.C | VC | VBUS | N.C. | N.C. | GND |
| **USB** | GND | SSR1X1+ | SSRX1- | VBUS | GND | N.C | D- | VC | VBUS | SSTX2- | SSTX2- | GND |
| **DP/ HDMI Rx** | GND | ML3+ | ML3- | P_HV | GND | AUX- | N.C | DP_PWR | P_HV | ML1- | ML1+ | GND |
| **DP/ HDMI Tx** | GND | ML2+ | ML2- | P_HV | GND | AUX- | N.C | DP_PWR | P_HV | ML0- | ML0+ | GND |

FIG. 57

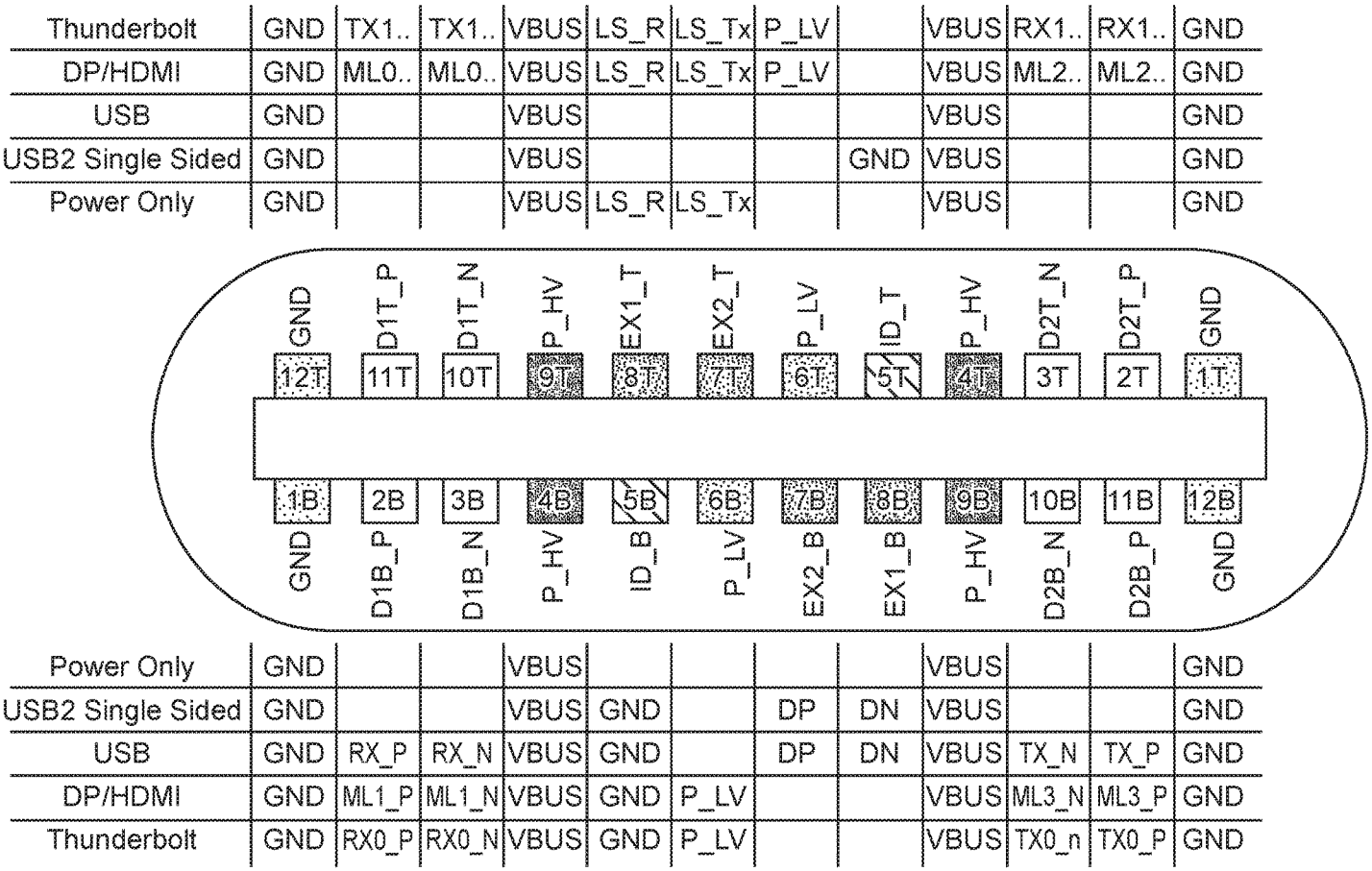
Thunderbolt
DP/HDMI
USB
USB2 Single Sided
Power Only
GND
TX1..
VBUS
LS_R
LS_Tx
P_LV
RX1..
ML0..
ML2..
GND
VBUS
LS_R
LS_Tx
P_LV
GND
VBUS
GND
VBUS
LS_R
LS_Tx
GND
12T
11T
10T
9T
8T
7T
6T
5T
4T
3T
2T
1T
GND
D11T_P
D11T_N
P_HV
EX1_T
EX2_T
P_LV
ID_T
P_HV
D21T_N
D21T_P
GND
1B
2B
3B
4B
5B
6B
7B
8B
9B
10B
11B
12B
GND
D1B_P
D1B_N
P_HV
ID_B
P_LV
EX2_B
EX1_B
P_HV
D2B_N
D2B_P
GND
Power Only
USB2 Single Sided
USB
DP/HDMI
Thunderbolt
GND
TX1..
VBUS
LS_R
LS_Tx
P_LV
RX1..
GND
GND
ML0..
VBUS
LS_R
LS_Tx
P_LV
ML2..
GND
GND
VBUS
GND
VBUS
GND
VBUS

CONNECTOR RECEPTACLE HAVING A SHIELD

CROSS-REFERENCES TO RELATED APPLICATIONS

This application is a continuation of U.S. patent application Ser. No. 14/543,711, filed Nov. 17, 2014, which claims the benefit of U.S. provisional patent applications No. 61/905,279, filed Nov. 17, 2013, 61/918,599, filed Dec. 19, 2013, 61/922,853, filed Jan. 1, 2014, 61/926,391, filed Jan. 12, 2014, 61/927,468, filed Jan. 14, 2014, 61/929,967, filed Jan. 21, 2014, and 62/003,012, filed May 26, 2014, which are incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices. Power may be transferred with this data, or power may be transferred separately.

Power and data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices to provide pathways for power and data.

These receptacles may be highly visible along a side of a device and may consume internal space inside the device. Accordingly, it may be desirable to provide receptacles having a reduced profile and size, as well as a pleasant appearance. Also, the data rates through these connector receptacles may be quite high. To provide these high data rates, it may be desirable that the connector receptacles have a high signal integrity and low insertion loss.

These connector inserts may be inserted into a device receptacle once or more each day for multiple years. It may be desirable that these connector inserts and receptacles are reliable and do not break or wear down prematurely, since such failures may lead to user dissatisfaction with both the cable assembly and the electronic devices that they connect to.

Electronic devices may be sold in the millions, with an attendant number of cable assemblies and their connector inserts sold alongside. With such volumes, any reduction or simplification in the manufacturing may become significant. For such reasons, it may be desirable that these connector inserts and receptacles are readily manufactured.

Thus, what is needed are connector inserts and receptacles that have an attractive appearance, a low profile, a high signal integrity and low insertion loss, are reliable, and are readily manufactured.

SUMMARY

Accordingly, embodiments of the present invention may provide connector inserts, receptacles, and other structures that have an attractive appearance, a low profile, a high signal integrity and low insertion loss, are reliable, and are readily manufactured.

An illustrative embodiment of the present invention may provide attractive devices by providing a connector receptacle having a reduced complexity and a resulting simplified appearance. This reduced complexity may also improve device manufacturability and reliably, and improve durability as well.

An illustrative embodiment of the present invention may provide devices having a low profile by employing a tongue formed having contacts that may be printed, plated, or otherwise formed on a surface of the tongue. This may provide a thin tongue, thereby helping to reduce the profile of the connector. Also, this configuration may remove the need for conventional spring-type signal contacts that may increase a profile or height of a receptacle. The removal of these spring type signal contacts may also improve the reliability and durability of these connectors. Specifically, connector inserts or other items won't get caught on these spring type contacts, thereby damaging the receptacle and device. Instead, embodiments of the present invention may include these signal contacts in the connector insert or plug. This way, if a signal contact is damaged, only a cable may need to be replaced and the device itself may not be damaged.

Another embodiment of the present invention may provide connector systems having good shielding. In one example, a receptacle may have a shield around a tongue to mate with a shield on a connector insert. Specifically, the insert shield may fit inside and connect to the receptacle shield. Contacts on the insert shield may form electrical connections with contacts on the tongue.

In other embodiments of the present invention, a shield on a connector insert may contact a shield in a receptacle in different ways. For example, one or more fingers may be stamped in a shield that is formed or placed around a tongue of a connector receptacle. A shield around a connector insert may be inserted into a receptacle shield and may contact the fingers in the receptacle shield thereby forming a ground connection. One or more cutouts or openings in the connector insert shield may accept an end of a receptacle shield finger to provide a retention force. In still other embodiments of the present invention, one or more fingers may be formed in a connector insert shield and contact or fit in cutouts or openings in the receptacle shield. In other embodiments, a combination of openings and fingers on the connector insert shield and the receptacle shield may be used.

An illustrative embodiment of the present invention may provide connector receptacles having good retention properties. For example, a connector receptacle tongue may include notches on each of a left and right side, where the notches accept ground contacts on a connector insert when the connector insert is inserted into the connector receptacle. In other embodiments of the present invention, one or more fingers may be formed in a shield around the tongue of a receptacle. These fingers may pass along an outside edge of the shield during insertion. Contact points on the fingers may fit in openings along a side of the connector insert shield.

Connector receptacle tongues may be mated to device enclosure housings in different ways in different embodiments of the present invention. For example, a bracket may be placed around the tongue, where the bracket has an opening for attaching to a device enclosure or other structure.

Another illustrative embodiment of the present invention may provide connector inserts to mate with these connector receptacles. One specific embodiment may provide a connector insert having a grounded metallic shield for shielding, isolation, and retention purposes. The shield may have a leading edge, where the leading edge is folded back into an opening at a front of the insert. The folded portion may contact one or more ground pads on a tongue of the receptacle. The insert shield may contact a receptacle shield around the tongue. The folded portion of the insert shield may contact ground pads on the tongue. The connections from pads on a tongue to an insert shield to a receptacle shield may form a Faraday cage around contacts on the tongue.

In various embodiments of the present invention, a folded leading edge of the insert shield may engage the contacts on the receptacle tongue during insertion. To avoid shorting power contacts to ground, the contacts formed by the leading edge may be spaced such that they do not encounter the power contacts, or make other undesirable connections to other pins, during insertion.

Another embodiment of the present invention may include ground contacts near a front opening of the insert shield. These ground contacts may replace or supplement the ground contacts formed by folding the leading edges of the insert shield described above. These ground contacts may be a separate piece formed separately from the shield and from the signal, power, and other ground contacts in the connector insert. In a specific embodiment, these ground contacts may have a sufficient length to provide enough force along a lever arm such that the ground contacts may form a good electrical connection with ground pads on receptacle tongues. This length may also help prevent permanent deformation of the ground contacts. The ground contacts may be placed above the signal, power, and other ground contacts (referred to simply as signal contacts) in the connector insert. This positioning may allow the ground contacts to have sufficient length while also consuming a minimal amount of space and not significantly increasing a length or thickness of the connector inserts.

To reduce the capacitance between the ground contacts and the signal contacts below the ground contacts, the ground contacts may have openings, where the openings are placed above the signal contacts. This reduced capacitance may increase the impedance of the signal contacts thereby improving signal quality. Tape may be placed over the signal pins to prevent inadvertent connections to the ground contacts and to the connector insert shield. Ground or other appropriate contacts on a tongue in a connector receptacle may be located where they engage the ground contacts in the connector insert during insertion of the connector insert. That is, the ground contacts may be arranged so that they do not contact power contacts during insertion. This may help to avoid damage to circuitry connected to either the connector receptacle or the connector insert during insertion. Examples of such ground contacts or pieces can be found in co-pending U.S. patent application Ser. No. 14/543,717, filed Nov. 17, 2014, titled GROUND CONTACTS FOR REDUCED-LENGTH CONNECTOR INSERTS, which is incorporated by reference.

Other embodiments of the present invention may provide other features for increasing the impedance of signal contacts in order to improve signal integrity in order to allow high data rates. For example, various embodiments of the present invention may include ground planes between rows of contacts in a connector in order to shield or electrically isolate signals in the different rows from each other. Also, a grounded shield may surround these rows of contacts. The ground plane and shield may increase capacitance to the signal contacts, thereby lowering the impedance at the contacts and degrading signal integrity. Accordingly, in order to improve signal integrity, embodiments of the present invention may thin or reduce thicknesses of one or more of the shield, ground plane, or contacts in order to increase the distances between the structures. This increase in distance may increase the impedance at the contacts.

In other embodiments of the present invention, the shape of a signal contact when it is in a deflected or inserted stage may be optimized. For example, a contact may be contoured to be at a maximum distance from the ground plane and shield over its length in order to increase impedance at the contact. In a specific embodiment of the present invention where the ground plane and shield are substantially flat, the signal contacts may be substantially flat as well, and where either or both the ground plane and shield are curved, the signal contacts may be substantially curved as well.

In this embodiment of the present invention, the signal contacts of a connector insert may be designed to be substantially flat when the connector insert is inserted into a connector receptacle. This design may also include a desired normal force to be applied to a contact on a connector receptacle by a connector insert signal contact. From this design, the shape of the connector insert signal contacts when the connector insert is not inserted in a connector receptacle may be determined. That is, from knowing the shape of a connector insert signal contact in a deflected state and the desired normal force to be made during a connection, the shape of a connector insert signal contact in a non-deflected state may be determined. The connector insert signal contacts may be manufactured using the determined non-deflected state information. This stands in contrast to typical design procedures that design a contact beginning with the non-deflected state. Further details may be found in co-pending U.S. patent application Ser. No. 14/543,803, filed Nov. 17, 2014, titled Connector Insert Assembly, which is incorporated by reference.

In these and other embodiments of the present invention where a leading edge of a connector insert shield is not folded back to form ground contacts, a leading edge of the connector insert may be a plastic tip. This plastic tip may be a front portion of a housing in the connector insert. Embodiments of the present invention may provide features to prevent light gaps from occurring between the plastic tip and shield. One illustrative embodiment of the present invention may provide a step or ledge on the plastic tip to block light from passing between the plastic tip and the shield. In other embodiments of the present invention, a force may be exerted on the shield acting to keep the shield adjacent to, or in proximity of, the plastic tip. This force may be applied at a rear of the shield by one or more arms having ramped surfaces, where the arms are pushed in an outward direction and the ramps are arranged to apply a force to the shield. Further details may be found in co-pending U.S. patent application Ser. No. 14/543,803, filed Nov. 17, 2014, titled Connector Insert Assembly, which is incorporated by reference.

In various embodiments of the present invention, contacts, shields, and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connector inserts and receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector inserts and receptacles may provide pathways for signals that are compliant with various standards such as one of the Universal Serial Bus (USB) standards, such as USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector inserts and receptacles that may be used to provide a reduced set of functions for one or more of these standards. In various embodiments of the present invention, these interconnect paths provided by these connector inserts and receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

BRIEF DESCRIPTION OF THE DRAWINGS

FIG. 55 is a pinout for a connector receptacle according to embodiments the present invention;

FIG. 56 is another pinout for a connector receptacle according to embodiments the present invention;

FIG. 57 illustrates a mapping of pins for various types of interfaces to pins of a connector receptacle according to an embodiment of the present invention;

FIG. 58 illustrates another mapping of pins for various types of interfaces to pins of a connector receptacle according to an embodiment of the present invention.

DESCRIPTION OF ILLUSTRATIVE EMBODIMENTS

Figure 1:
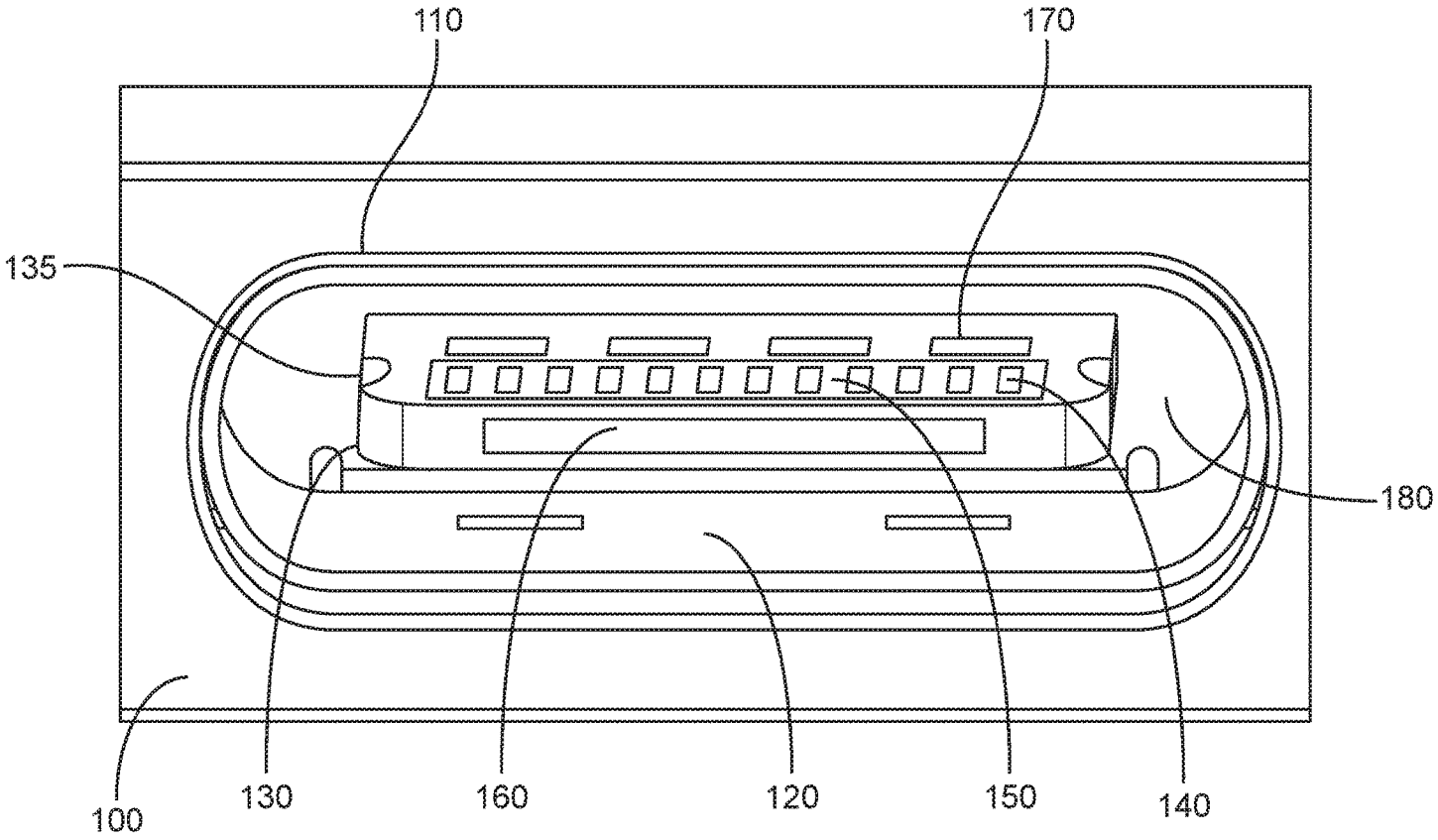
FIG. 1 illustrates a connector receptacle according to an embodiment of the present invention.

FIG. 1 illustrates a connector receptacle according to an embodiment of the present invention. This figure, as with the other included figures, is shown for illustrative purposes and does not limit either the possible embodiments of the present invention or the claims. Also, while only one surface of the tongue is shown in this in the other included figures, a second surface of the tongue may be identical or similar to the illustrated top surface and may include identical or similar features and structures.

This connector receptacle may be located in opening 110 of enclosure 100. Device enclosure 100 may be an enclosure for a portable computing device, tablet, desktop computer, laptop, all-in-one computer, cell phone, smart phone, media phone, storage device, portable media player, navigation system, monitors, power supply, adapter, and charger, or other device. The connector receptacle may include a shield 120 surrounding tongue 130. Tongue 130 may support contacts 140 in an isolation area 150. Ground contacts 160 and 170 may also be located on tongue 130. Notches 135 may be located on left and right sides of tongue 130. These notches may act as retention features by accepting ground contacts in a connector insert. A rear 180 of a connector receptacle may be formed by a bracket, which may be seen more clearly in the following figure.

Figure 2:
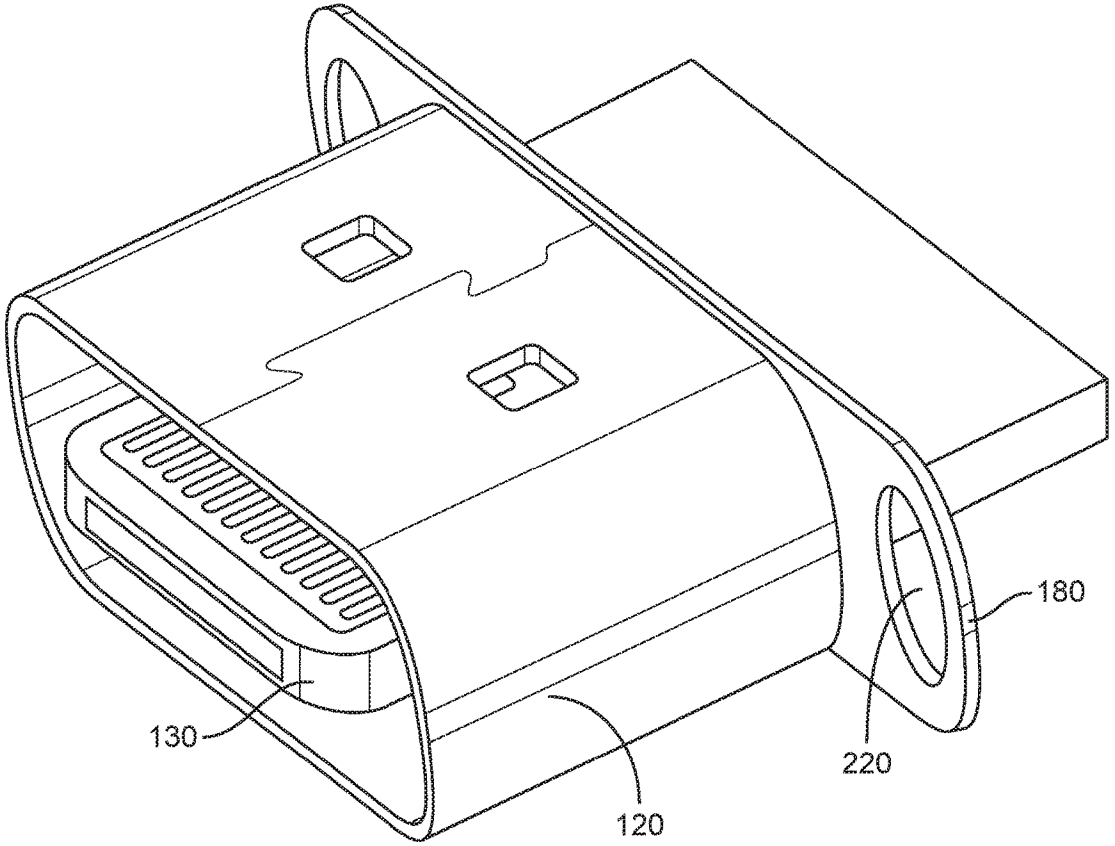
FIG. 2 illustrates a connector receptacle according to embodiment of the present invention.

FIG. 2 illustrates a connector receptacle according to embodiment of the present invention. Again, tongue 130 may be located inside shield 120. Bracket 180 may be formed around a part of tongue 130. Bracket 180 may include openings 220 for accepting fasteners so that the connector receptacle may be secured to device enclosure 100 or other appropriate structure. Bracket 180 may also form a rear of the connector receptacle opening.

Figure 3:
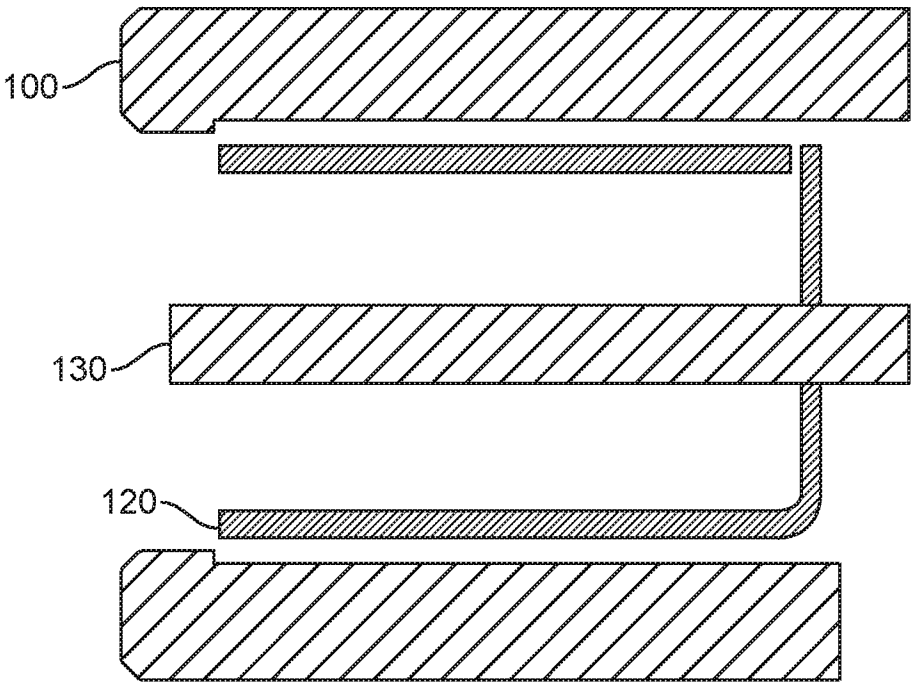
FIG. 3 illustrates a simplified view of a connector receptacle according to an embodiment of the present invention.

FIG. 3 illustrates a simplified view of a connector receptacle according to an embodiment of the present invention. The connector receptacle may be located in device enclosure 100. The receptacle may include a shield around tongue 130.

Embodiments of the present invention may also provide connector inserts to mate with these connector receptacles. An example is shown in the following figure.

Figure 4:
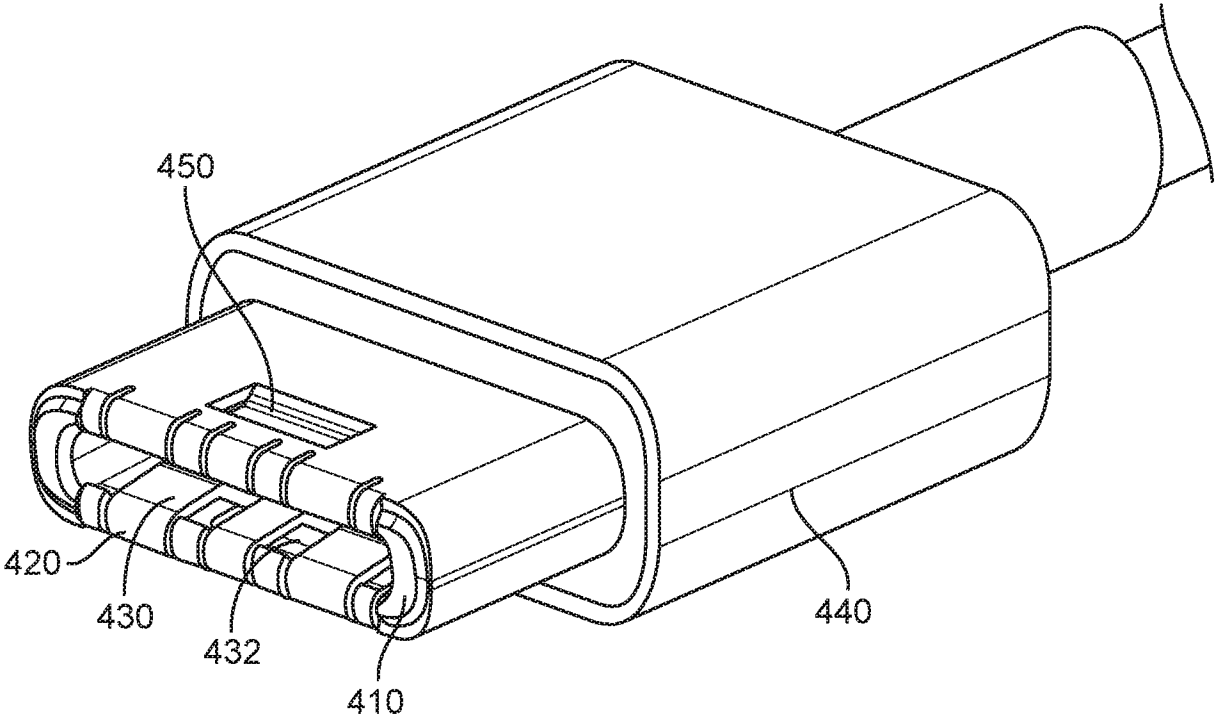
FIG. 4 illustrates a connector insert according to an embodiment of the present invention.

FIG. 4 illustrates a connector insert according to an embodiment of the present invention. This connector insert may include a shield 420. This shield may be located around insert housing 410. Insert housing 410 may be formed of plastic or other nonconducting material. A leading edge of shield 420 may be folded back into an opening of the connector insert to form one or more contacts 430. These contacts may be split to improve contact to ground pads on a tongue in the connector receptacle.

During insertion, contacts 430 may otherwise form undesirable electrical connections with pads or contacts 140 on tongue 130 in the connector receptacle. Accordingly, contacts 430 may be separated by spaces 432 such that undesirable connections to power and other pins are not created during insertion.

The connector insert may further include fingers 450 and a housing 440 to enclose circuitry and a printed circuit board. Housing 440 may further provide a structure to be handled by a user during insertion and extraction.

Figure 5:
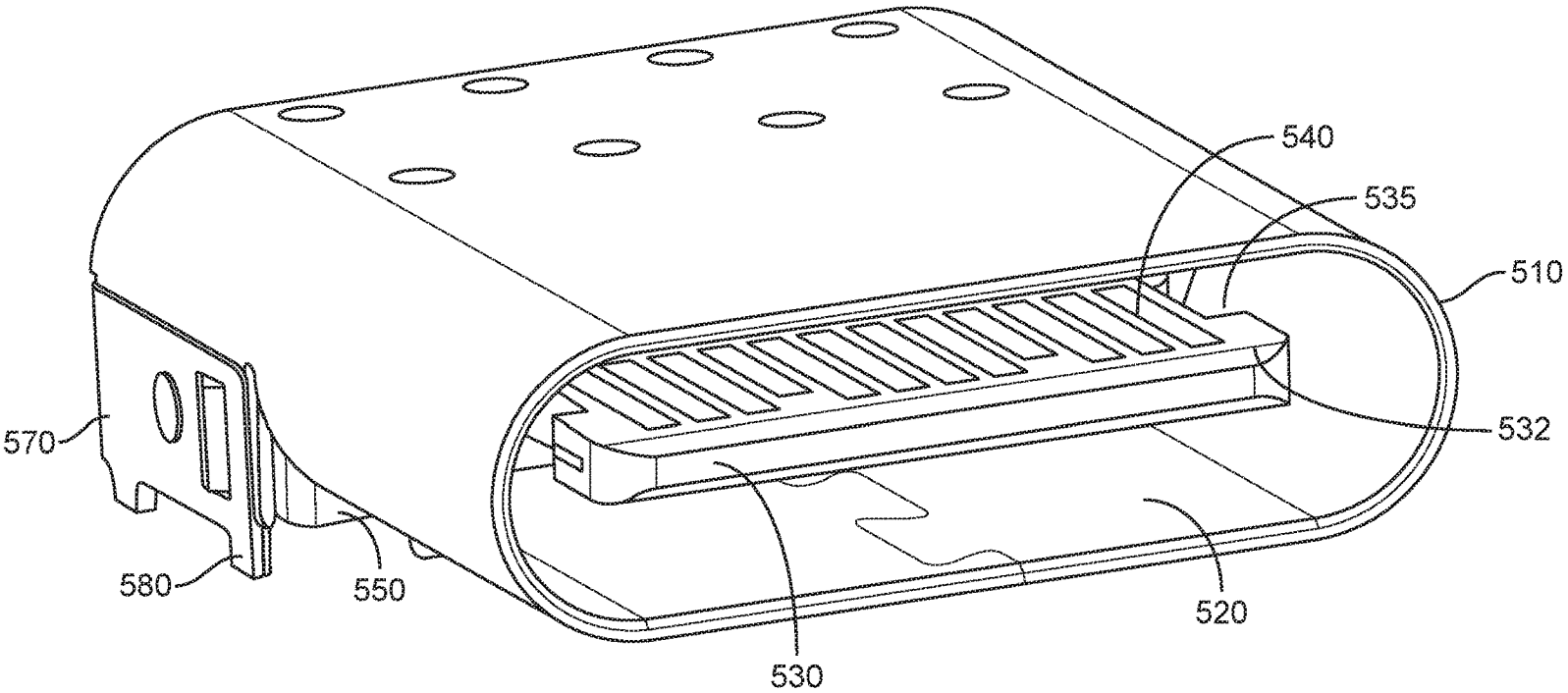
FIG. 5 illustrates a connector receptacle according to embodiments the present invention.

FIG. 5 illustrates a connector receptacle according to another embodiment of the present invention. This connector receptacle may include tongue 530 surrounded by shield 510. Shield 510 may have an opening 520, which may accept a connector insert. Tongue 530 may include cutouts 535 for grounding and retention features. Tongue 530 may further include contacts 540, which may be located on a top and bottom of tongue 530. Tongue 530 may be supported by housing or bracket 550. Shield 510 may include a number of tabs 580 on lower shield portion 570, which may be soldered into openings on a printed circuit board for shielding and mechanical stability. Tongue 530 may be chamfered along one or more edges 532 both for cosmetic reasons and to facilitate insertion of a connector insert.

Figure 6:
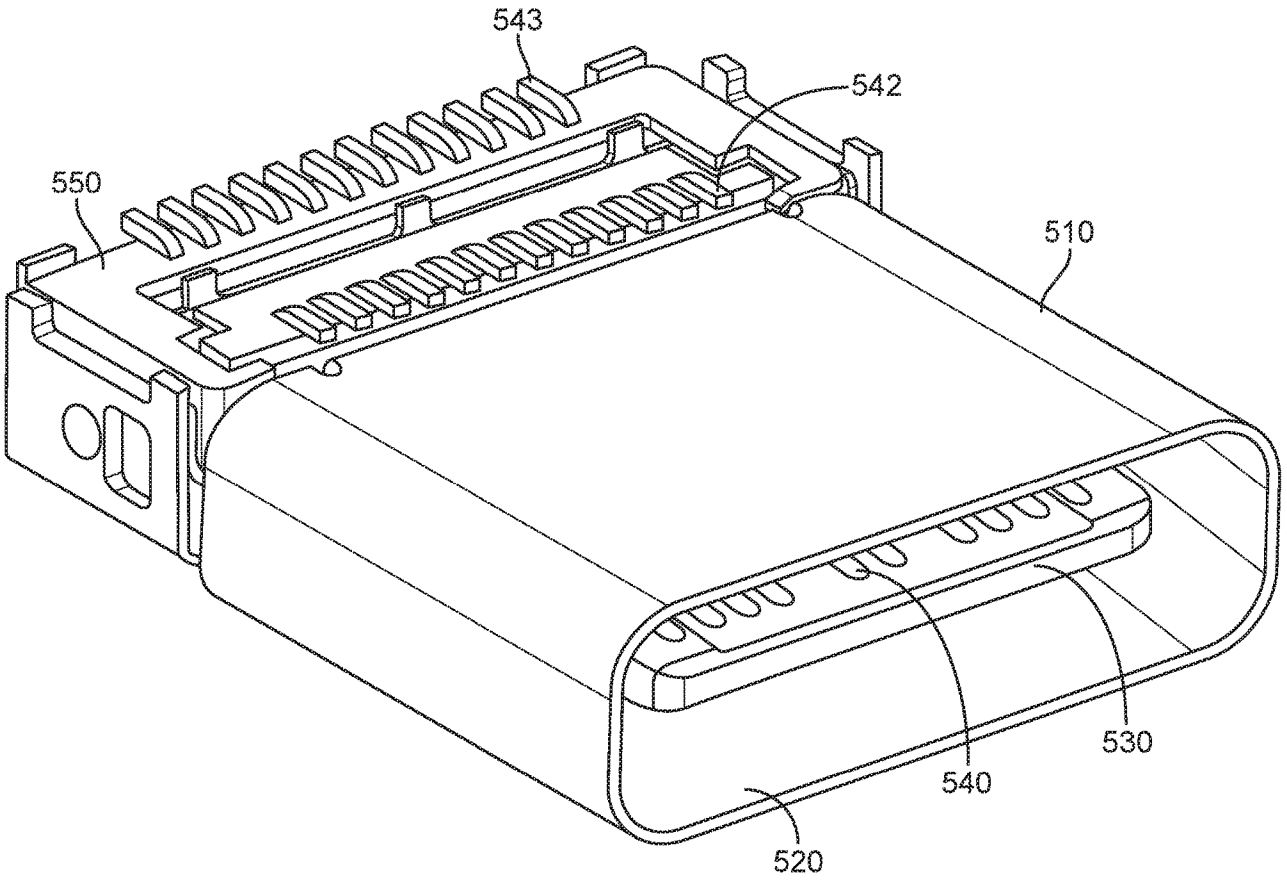
FIG. 6 illustrates an underside oblique view of the connector receptacle of FIG. 5.

FIG. 6 illustrates an underside oblique view of the connector receptacle of FIG. 5. Again, tongue 530 may be located in opening 520 of shield 510. Tongue 530 may support a number of contacts 540. Contacts 540 may connect to contact tails 542 and 543. Contact tails 542 and 543 may connect to contacts or traces on a printed circuit board or other appropriate substrate. Contact tails 542 and 543 may be surface mount, through-hole, or other types of contacts. Contact tails 542 and 543 may be supported by housing 550.

Figure 7:
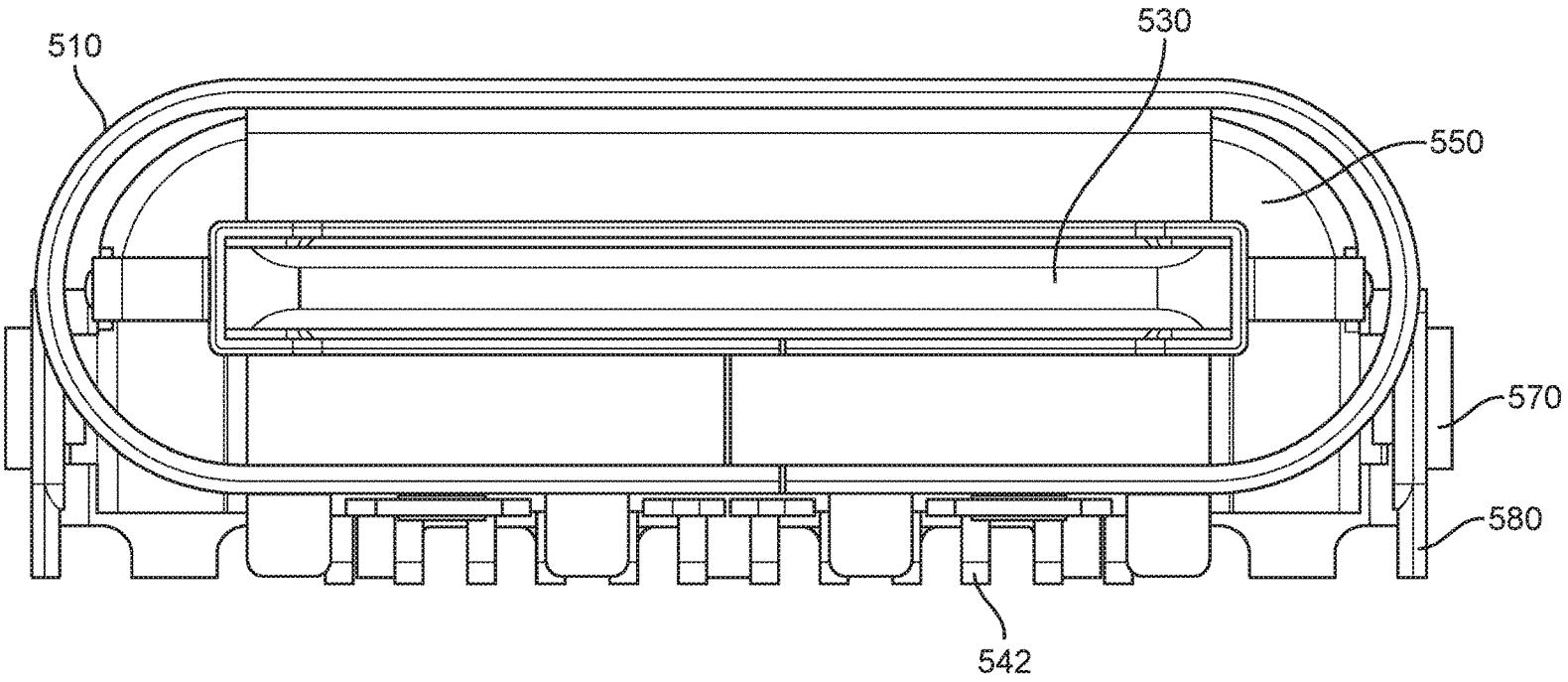
FIG. 7 illustrates a front view of the connector receptacle of FIG. 5.

FIG. 7 illustrates a front view of the connector receptacle of FIG. 5. Again, tongue 530 may be supported by housing or bracket 550. Tongue 530 may be surrounded by shield 510. Tabs 580 may connect to lower shield portion 570 and may be soldered into an opening in a printed circuit board for grounding and mechanical stability. Contact tails 542 may emerge from a bottom side of the receptacle. Contact tails 542 may connect to one or more contacts 540 on tongue 530. In this example, contact tails 542 may be surface mount contacts, though in other embodiments of the present invention, contact tails 542 may be through-hole or other types of contacts.

Figure 8:
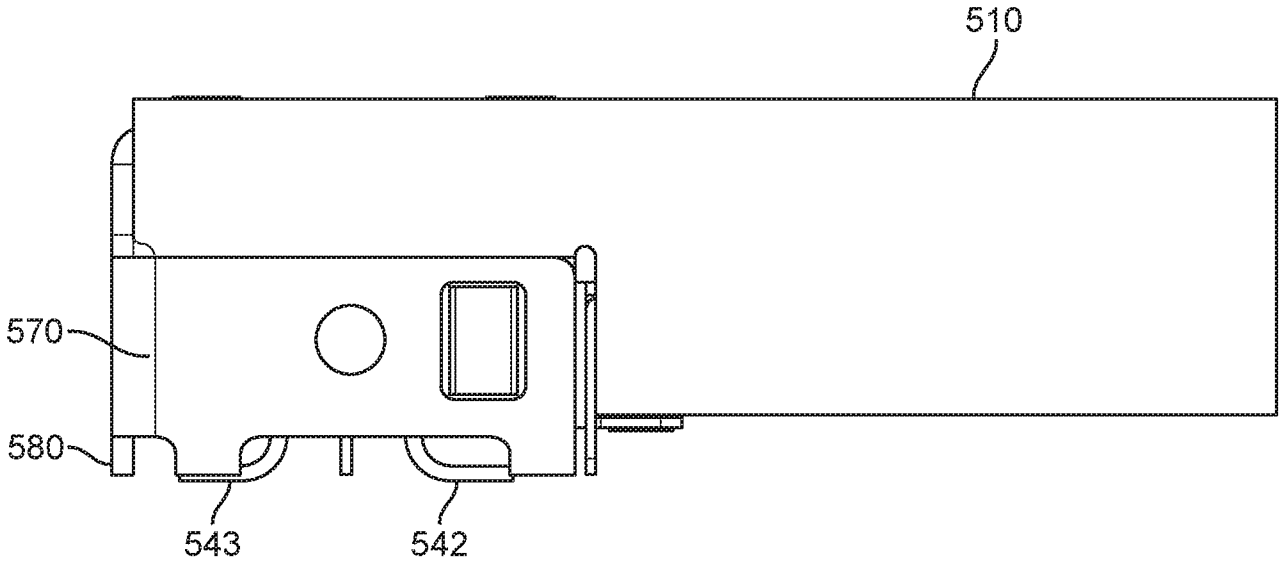
FIG. 8 illustrates a side view of a connector receptacle of FIG. 5.

FIG. 8 illustrates a side view of a connector receptacle of FIG. 5. Shield 510 may be supported by lower shield piece 570. Lower shield piece 570 may include one or more tabs 580 to form ground connections to a printed circuit board or other appropriate substrate. Contacts 542 and 543 may be in electrical contact with contacts 540 on tongue 530. Contacts 542 and 543 may be surface mount contacts that may be soldered to contacts and traces on a printed circuit board.

Figure 9:
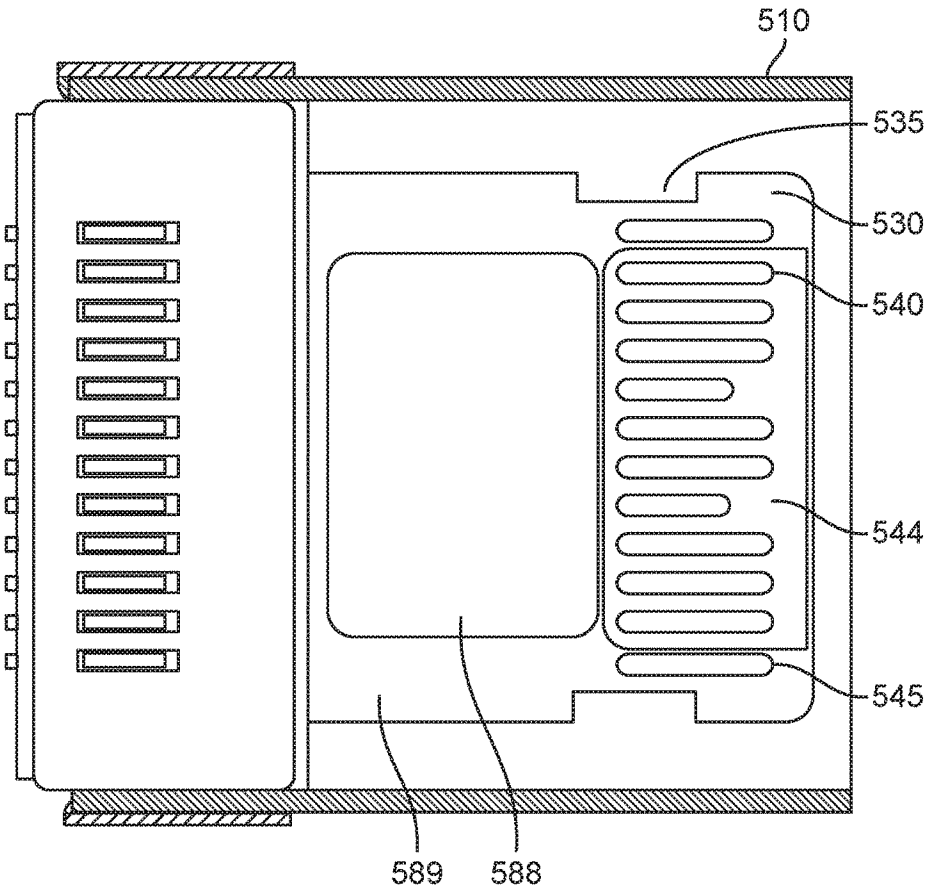
FIG. 9 is a top cross-section view of the connector receptacle of FIG. 5.

FIG. 9 is a top cross-section view of the connector receptacle of FIG. 5. Again tongue 530 may be located in shield 510. Notches 535 may be located in sides of tongue 530. The sides of tongue 530 may be metallized such that notches 535 may act in conjunction with features on a connector insert for retention and isolation purposes. Contacts 540 may be surrounded by an isolation area 544. Region 589 may be a metallized area for grounding. Regions 545 and 588 may be ground contacts. Specifically, regions 545 may connect to ground contacts in a connector insert. Regions 545 may be ground contacts and may be electrically connected to grounds that may be around and over notches 535. A connector insert may have a shield portion to make contact with ground pad 588.

In various embodiments of the present invention, notches 535 may be formed differently. For example, these notches may be formed as a general narrow and of a tongue behind a wider, front portion. Also, ground contacts, such as ground contacts 588, may be formed in various ways. For example, ground contacts 588 may be replaced by one or more metallic ground pieces. An example of such a connector receptacle is shown in the following figure.

Figure 10:
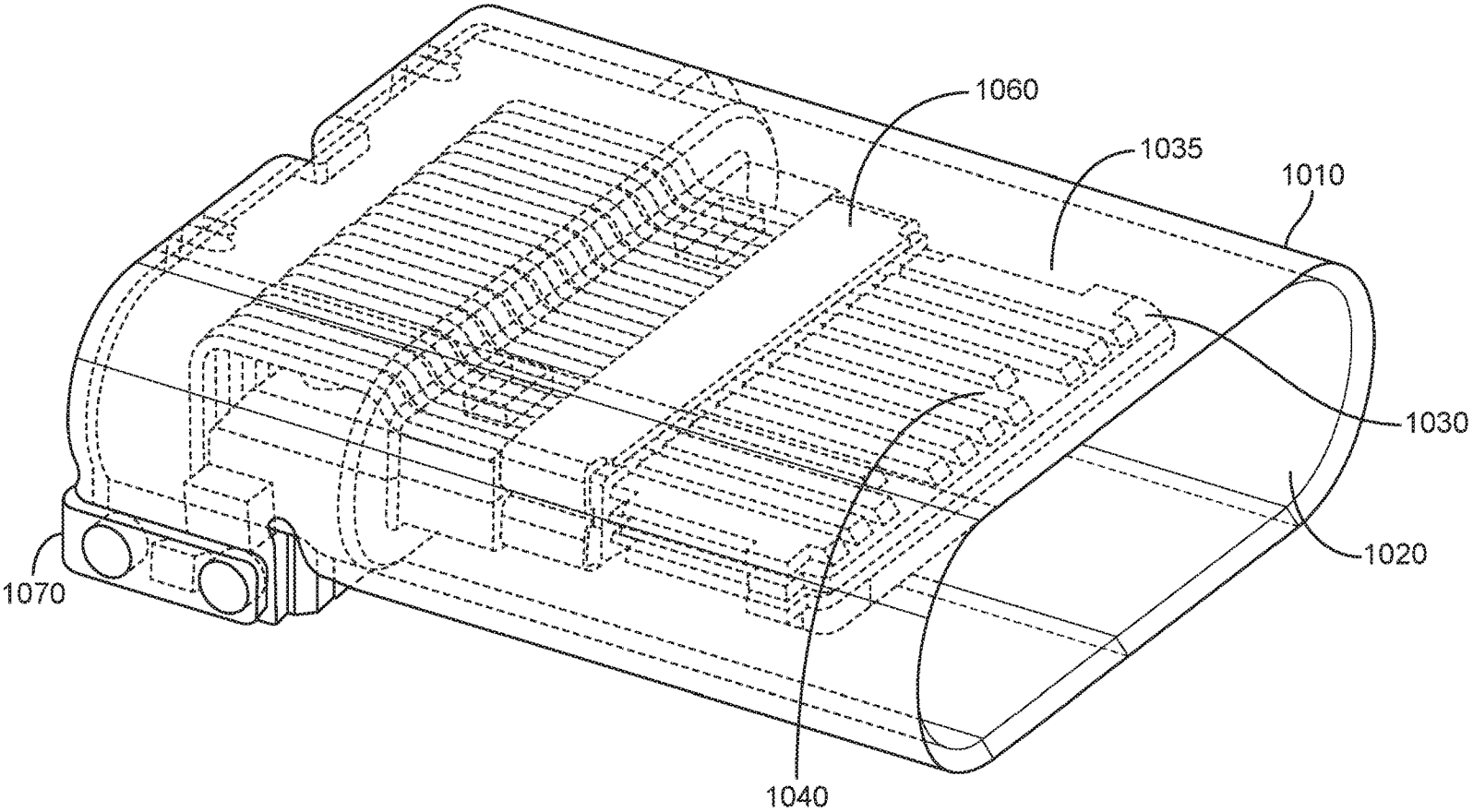
FIG. 10 illustrates a connector receptacle according to an embodiment of the present invention.

FIG. 10 illustrates a connector receptacle according to an embodiment of the present invention. This figure illustrates a connector receptacle having a shield 1010. Shield 1010 may have an opening 1020, in which is located tongue 1030. Tongue 1030 may support a number of contacts 1040. Tongue 1030 may have a narrow portion 1035 behind a leading, front portion.

Tongue 1030 may also support ground contacts 1060. Ground contacts 1060 may be formed from one or more metallic pieces. Ground contacts 1060 may connect to ground contacts near an opening of a connector insert when the connector insert is inserted into this connector receptacle.

Figure 11:
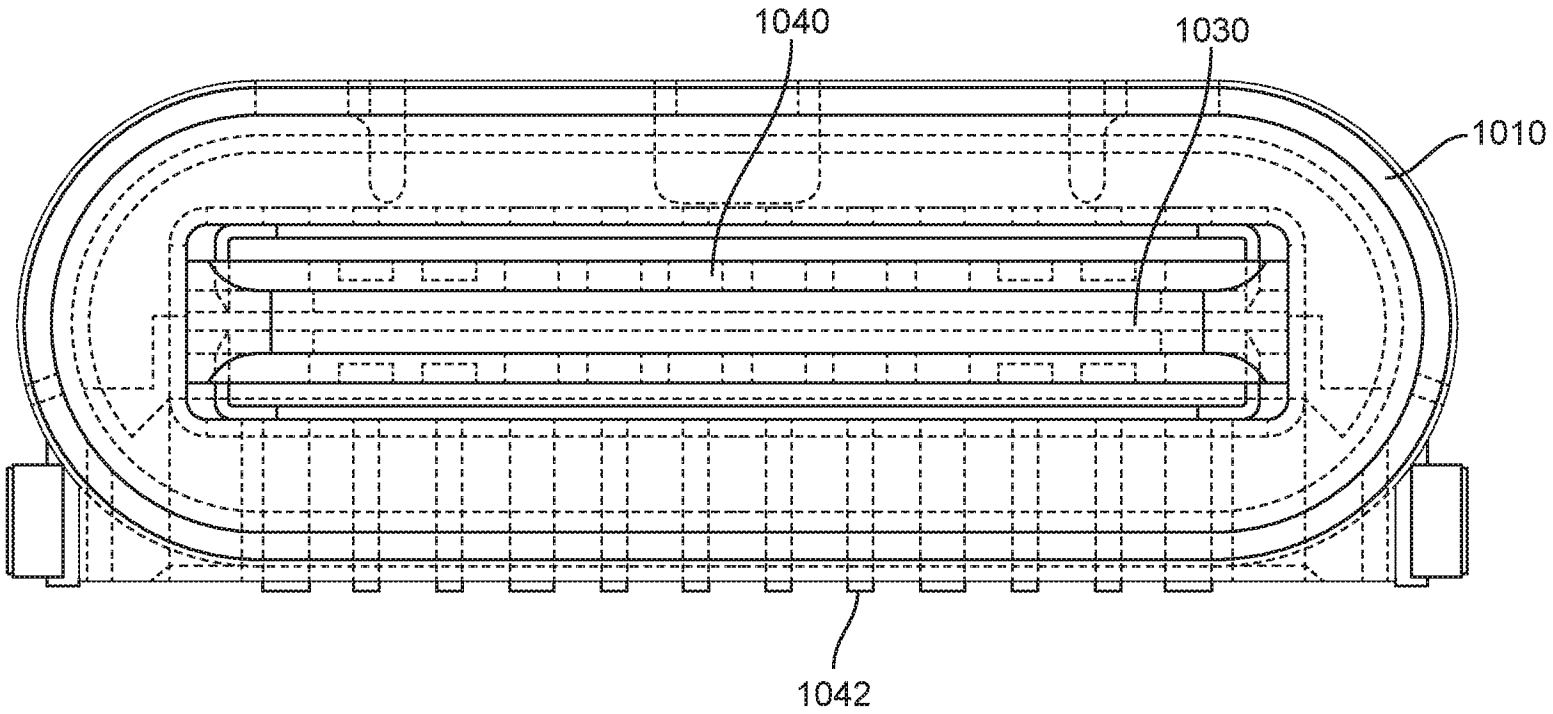
FIG. 11 illustrates a front view of the connector receptacle of FIG. 10.

FIG. 11 illustrates a front view of the connector receptacle of FIG. 10. Again, this connector receptacle may include tongue 1030 surrounded by shield 1010. Tongue 1030 may support a number of contacts 1040. Contacts 1040 may be connected to contact tail portions 1042. Contact tail portions may connect to contacts or traces on a printed circuit board. Contact tail portions 1042 may be surface mount or through hole type contacts.

Figure 12:
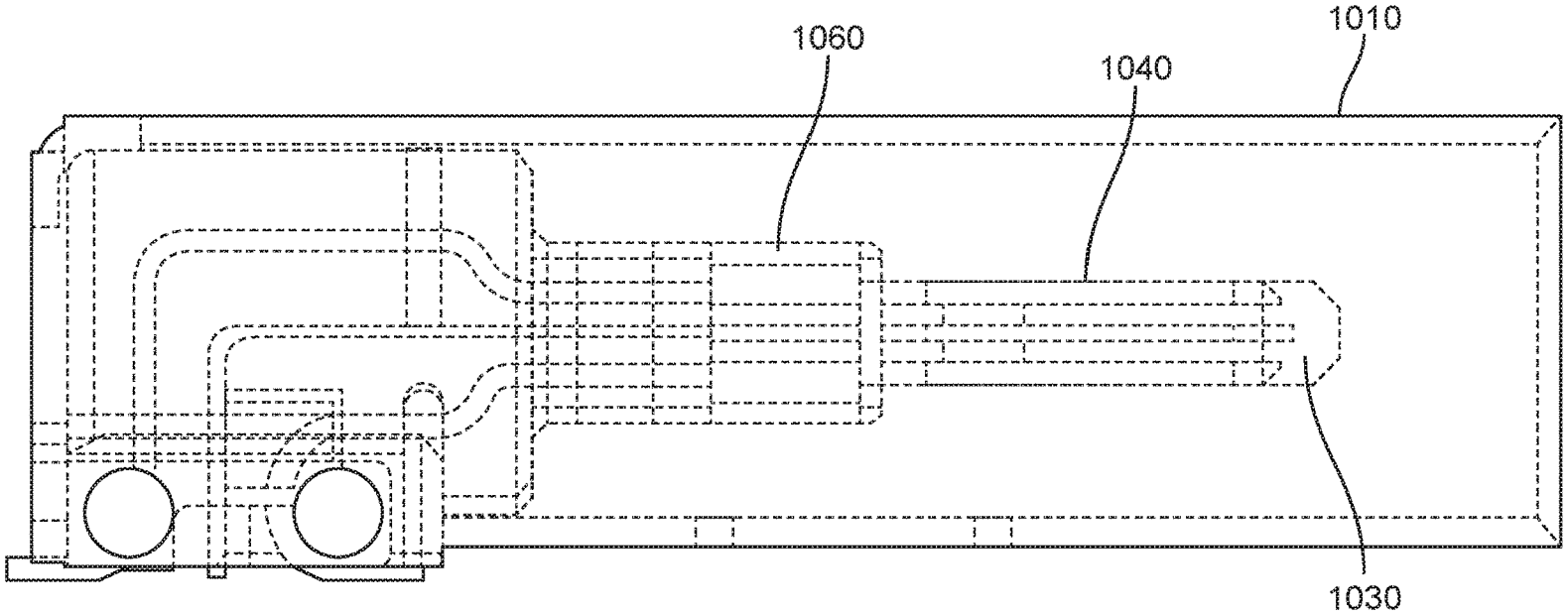
FIG. 12 illustrates a side view of a connector receptacle of FIG. 10.

FIG. 12 illustrates a side view of a connector receptacle of FIG. 10. Again, tongue 1030 may be surrounded by shield 1010. Tongue 1030 may support a number of contacts 1040 on its top and bottom. Ground contacts 1060 may also be included on tongue 1030.

Figure 13:
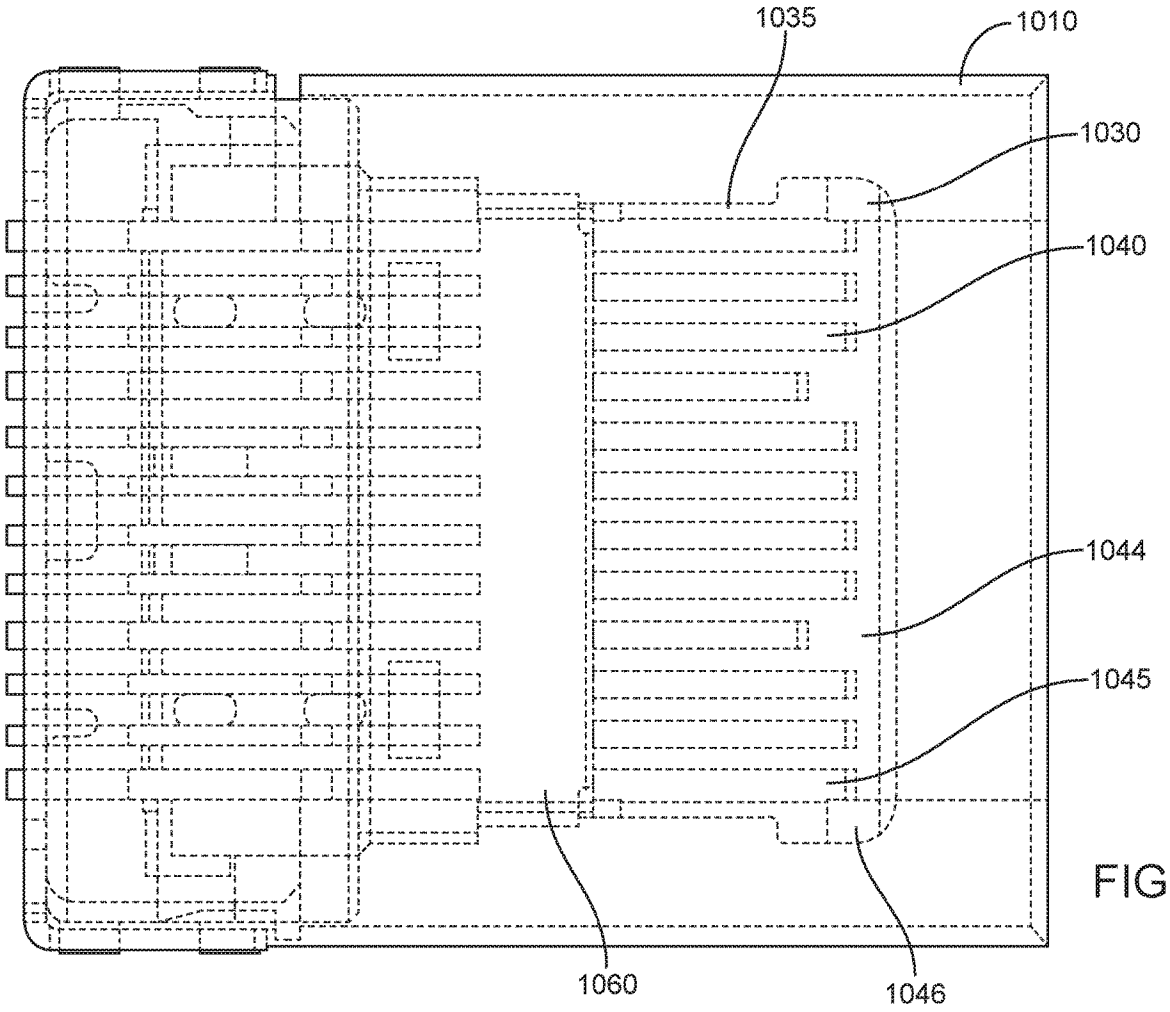
FIG. 13 illustrates a top view of the connector receptacle of FIG. 10.

FIG. 13 illustrates a top view of the connector receptacle of FIG. 10. Again, this connector receptacle may include tongue 1030 inside of shield 1010. Tongue 1030 may support a number of contacts 1040 in an isolation area 1044. Side portions 1046 of notches 1035 may be plated to form ground connections with features in a connector insert. Ground contacts 1045 may be electrically connected to side portions 1046. Ground contacts 1060 may also be located on tongue 1030.

Figure 14:
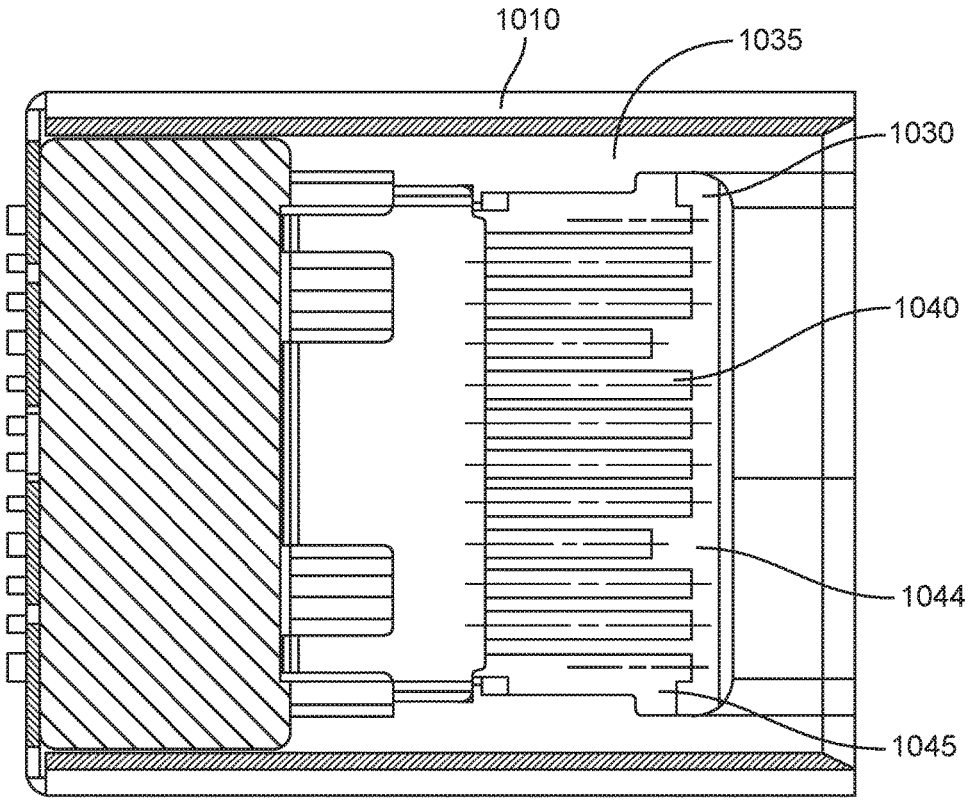
FIG. 14 illustrates a cut away view of the connector receptacle of FIG. 10.

FIG. 14 illustrates a cut away view of the connector receptacle of FIG. 10. Again, this connector receptacle may include tongue 1030 located inside of shield 1010. Notch 1035 may be metallized and formed to electrically connect to contacts 1045. Tongue 1030 may further support contacts 1040 in isolated area 1044.

These connector receptacles may be formed in various ways using various techniques. One example is shown in the following figures.

Figure 15:
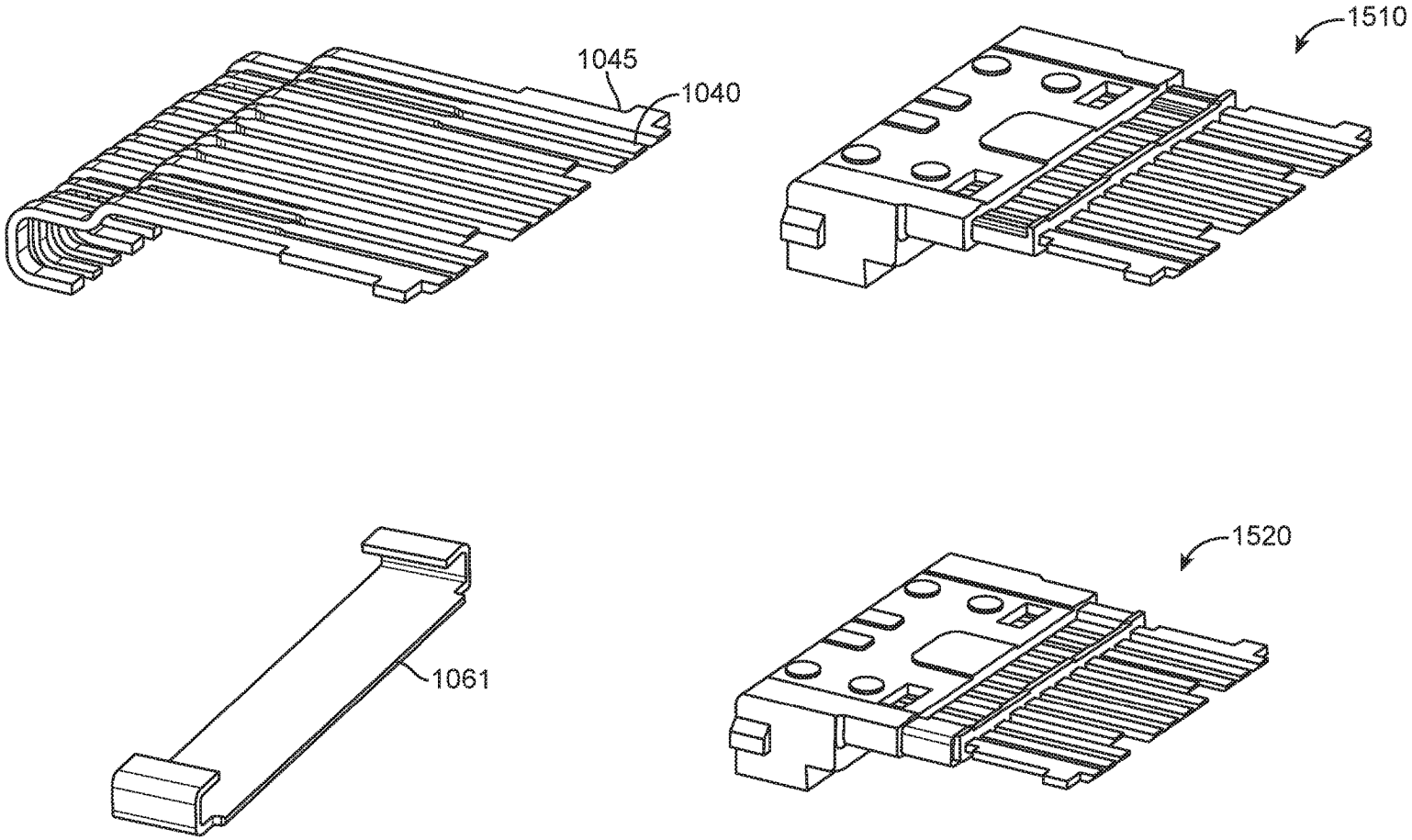
FIG. 15 illustrates initial acts that may be used in manufacturing connector receptacles according to an embodiment of the present invention.

FIG. 15 illustrates initial acts that may be used in manufacturing connector receptacles according to an embodiment of the present invention. A number of contacts may be formed, including contacts 1040 and ground contacts 1045. An insert or injection molded piece may be formed around a mid-portion of these contacts, resulting in structure 1510. Bottom ground contacts 1061 may be placed on structure 1510, resulting in structure 1520.

Figure 16:
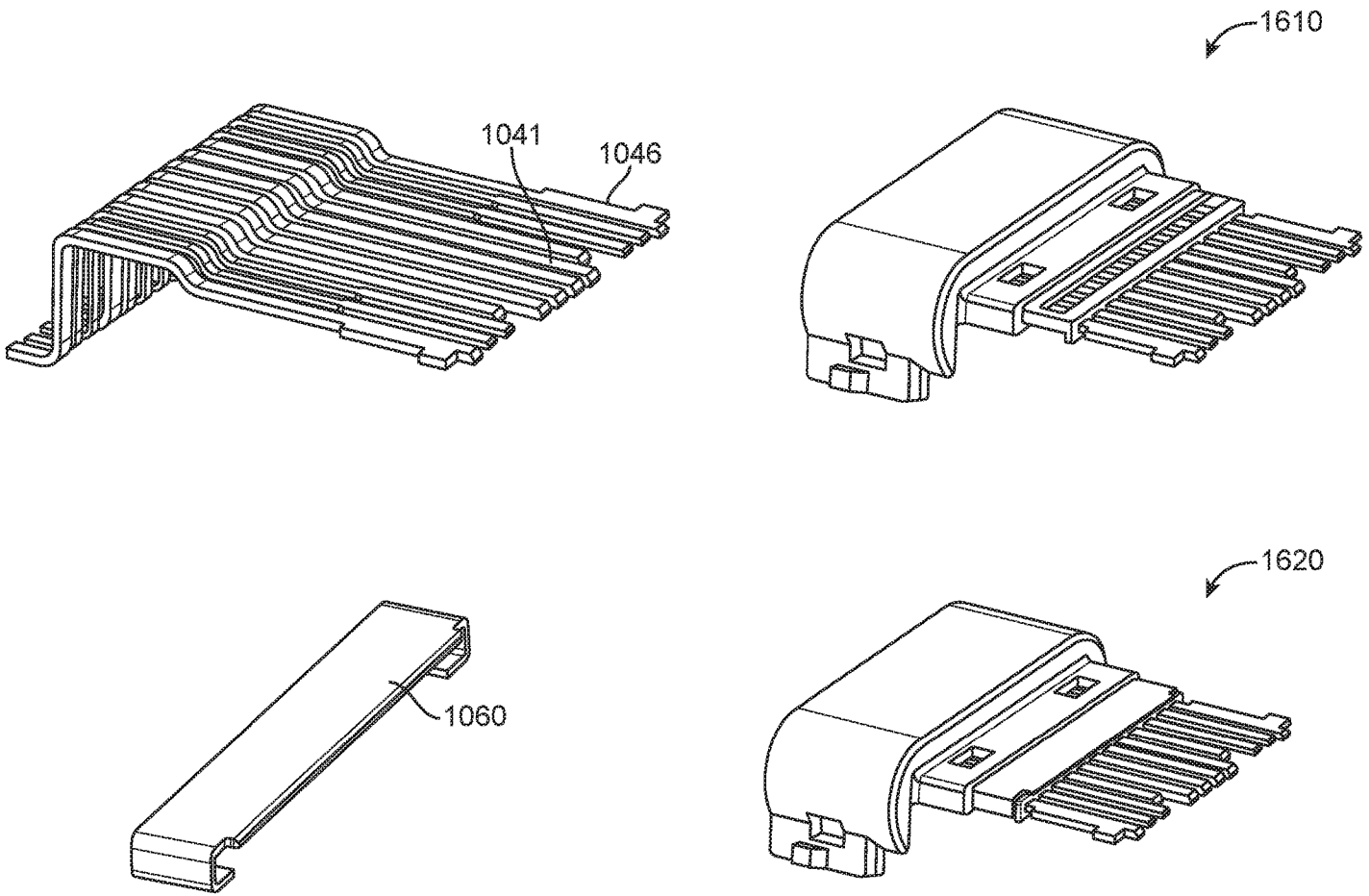
FIG. 16 illustrates following acts that may be used in the manufacturing connector receptacles according to an embodiment of the present invention.

FIG. 16 illustrates following acts that may be used in the manufacturing connector receptacles according to an embodiment of the present invention. A second group of contacts, including contacts 1041 and 1046 may be formed. Again, insert or injection molding may be used to form a plastic housing around a mid-section of these contacts, resulting in structure 1610. A top of ground contact 1060 may be added, resulting in structure 1620.

Figure 17:
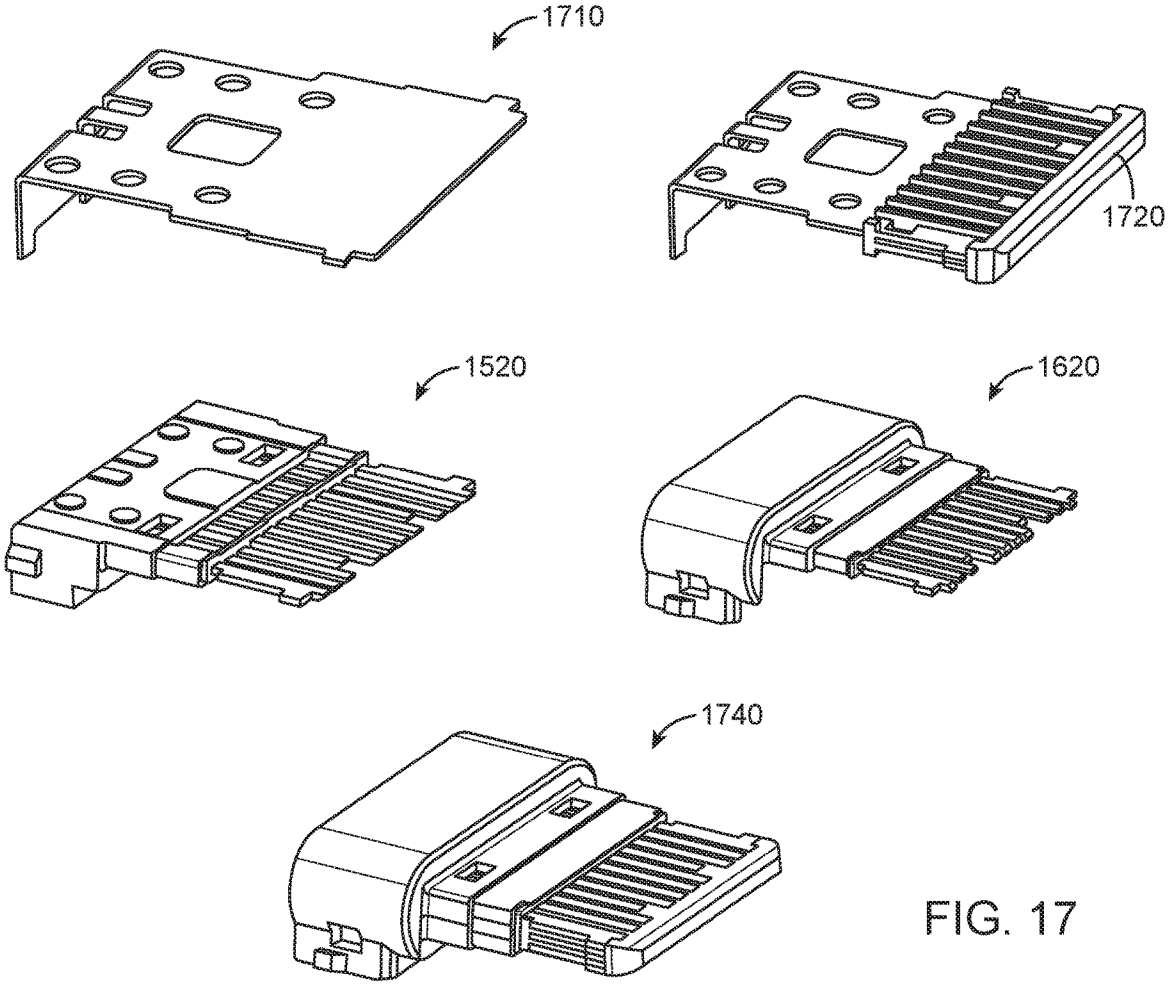
FIG. 17 illustrates following acts that may be used in manufacturing connector receptacles according to an embodiment of the present invention.

FIG. 17 illustrates following acts that may be used in manufacturing connector stamped and formed. A plastic or nonconductive piece 1720 may be added to a front of mid-piece 1710. Piece 1720 may form a front edge of a tongue of a connector receptacle, and may provide isolation between pins located on the tongue.

Previously formed pieces 1620 and 1520 may be placed above and below mid-piece 1720, resulting in connector receptacle tongue 1740.

Figure 18:
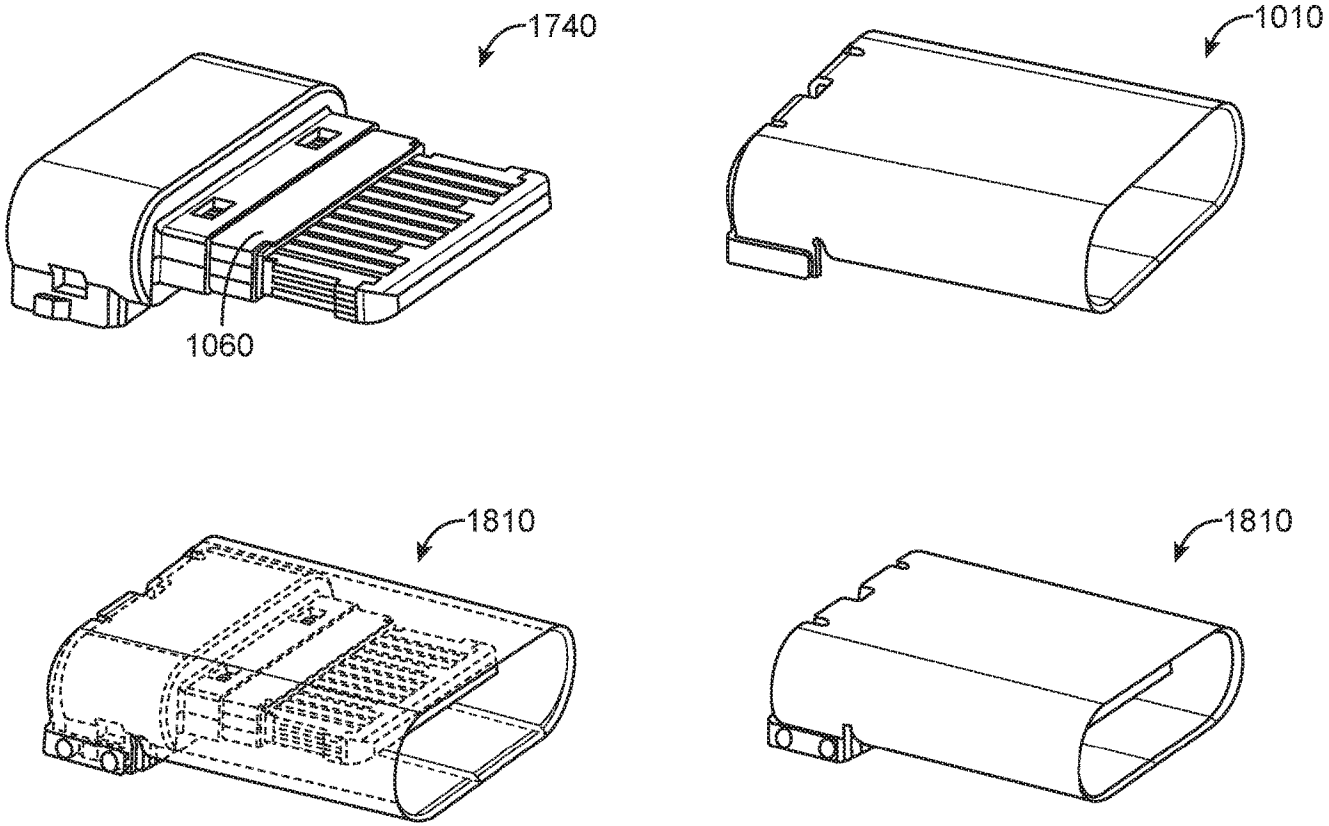
FIG. 18 illustrates following acts that may be used in manufacturing connector receptacle according to an embodiment of the present invention.

FIG. 18 illustrates following acts that may be used in manufacturing connector receptacle according to an embodiment of the present invention. Connector receptacle tongue 1740 may be inserted into shield 1800, resulting in connector receptacle 1810.

In various embodiments of the present invention, ground piece 1060 may be formed in different ways. For example, the ground piece 1060 may be angled such that it may connect directly to shield 1010, for example by laser or spot welding. An example is shown in the following figure.

Figure 19:
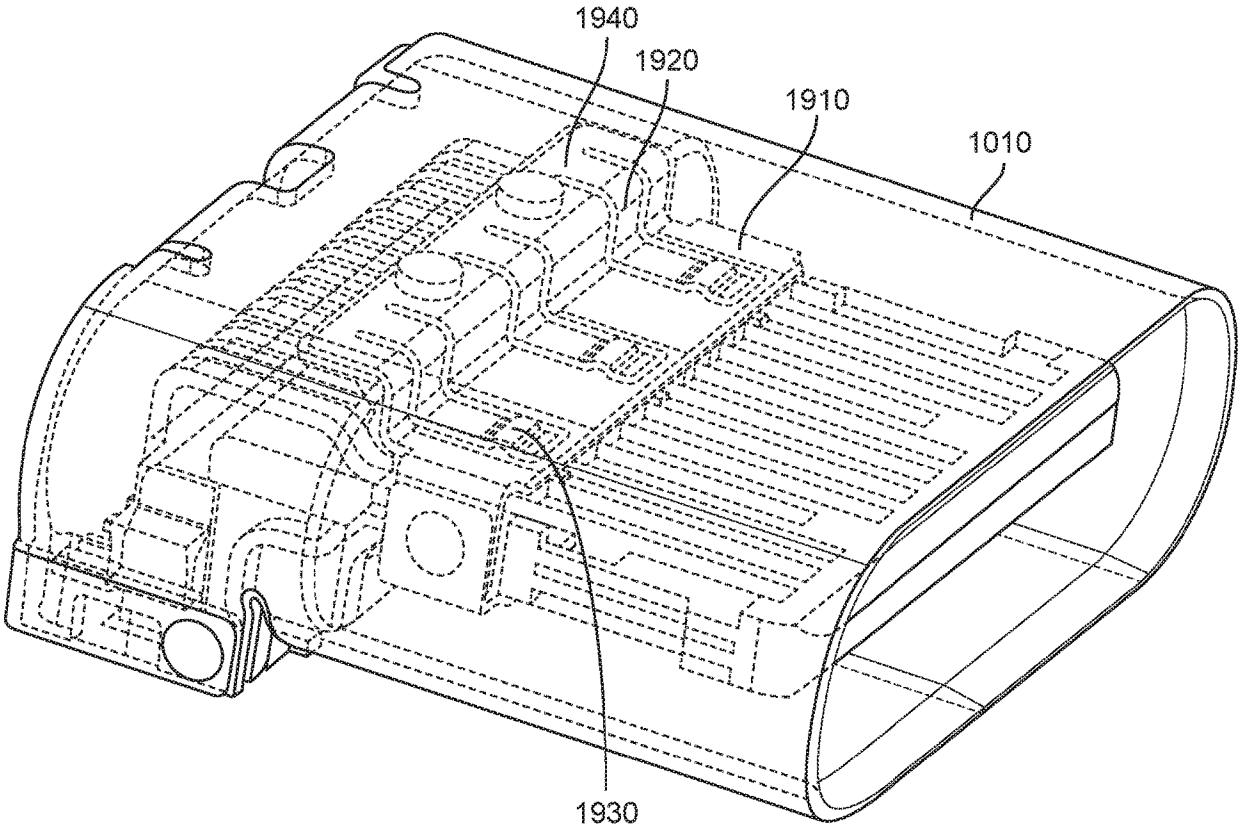
FIG. 19 illustrates a connector receptacle according to an embodiment of the present invention.

FIG. 19 illustrates a connector receptacle according to an embodiment of the present invention. In this example, ground piece 1610 has been replaced with ground piece 1910. Ground piece 1910 may include flat surface 1920. Flat surface 1920 may form a ground connection with a shield at a front end of a connector insert. Finger 1930 may further improve this electrical connection between ground piece 1910 and a shield or other ground contacts in a connector insert. Ground piece 1910 may be angled to include top portion 1940. Top portion 1940 may be soldered or spot welded to shield 1010 around the connector receptacle.

Figure 20:
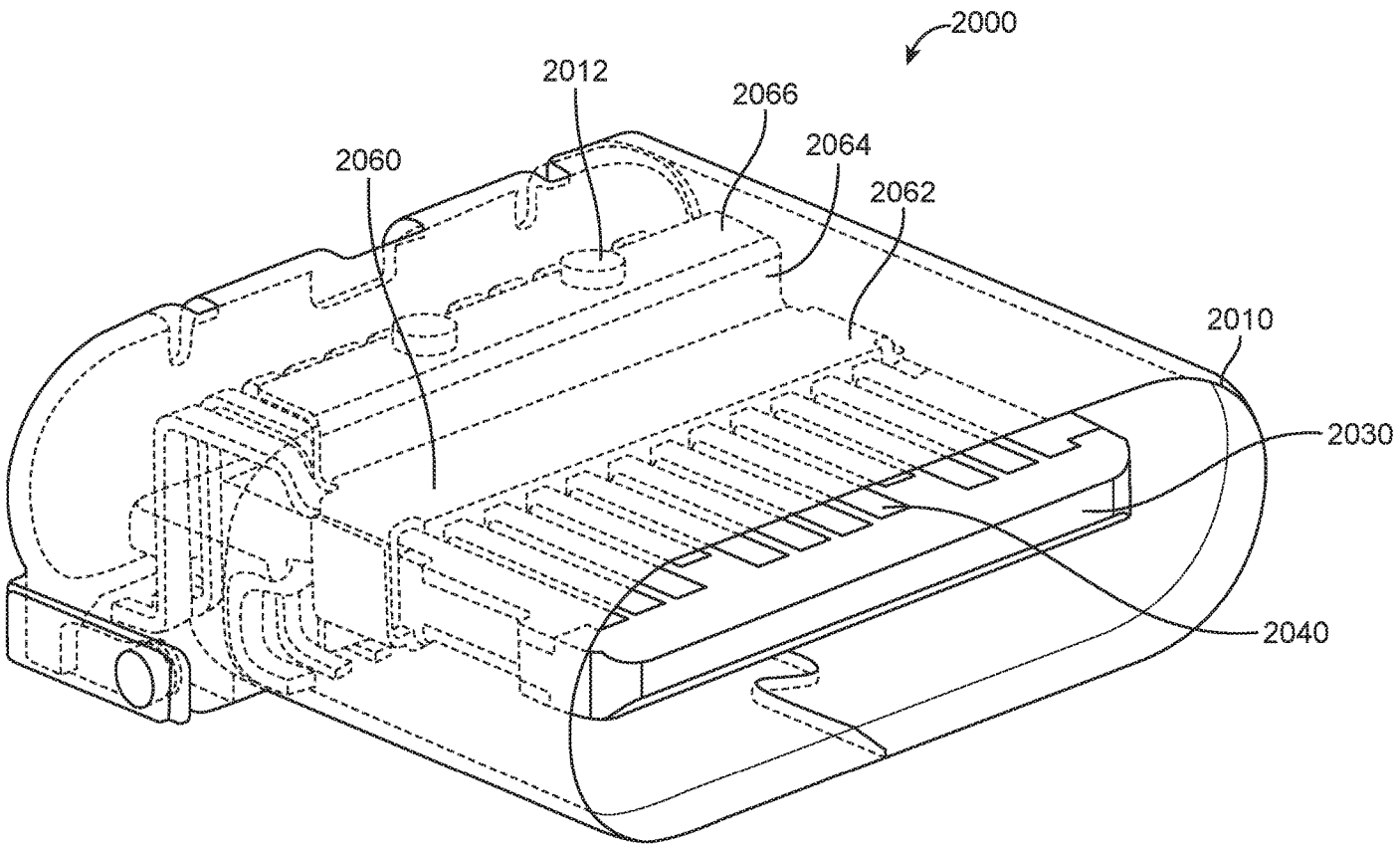
FIG. 20 illustrates another connector receptacle according to an embodiment present invention.

FIG. 20 illustrates another connector receptacle according to an embodiment present invention. Again, shield 2010 may surround a tongue 2030 supporting a number of contacts 2040. Ground piece 2060 may be included. Ground piece 2060 may include a front horizontal surface 2062. Front horizontal surface 2062 may form an electrical connection with a ground contacts near a front of a connector insert when the connector insert is inserted into this connector receptacle. Ground piece 2060 may further include a vertical portion 2064. Vertical portion 2064 may optionally form an electrical connection with a front of a shield on a connector insert. Ground piece 2060 may further include back horizontal piece 2066. Back horizontal piece 2066 may be connected to shield 2010 at points 2012 by spot or laser welding, or other appropriate method.

The arrangement of ground piece 2060 may provide a high degree of shielding for signals conveyed by contacts 2040. Specifically, ground contacts near a front of a connector insert may form an electrical connection with front horizontal piece 2062. A front of a shield around the connector insert may form an electrical connection with vertical portion 2064. An outside of the shield around the connector insert may form an electrical connection with shield 2010 of the receptacle. Shield 2010 may be electrically connected to back horizontal piece 2066 via connection points 2012.

Figure 21:
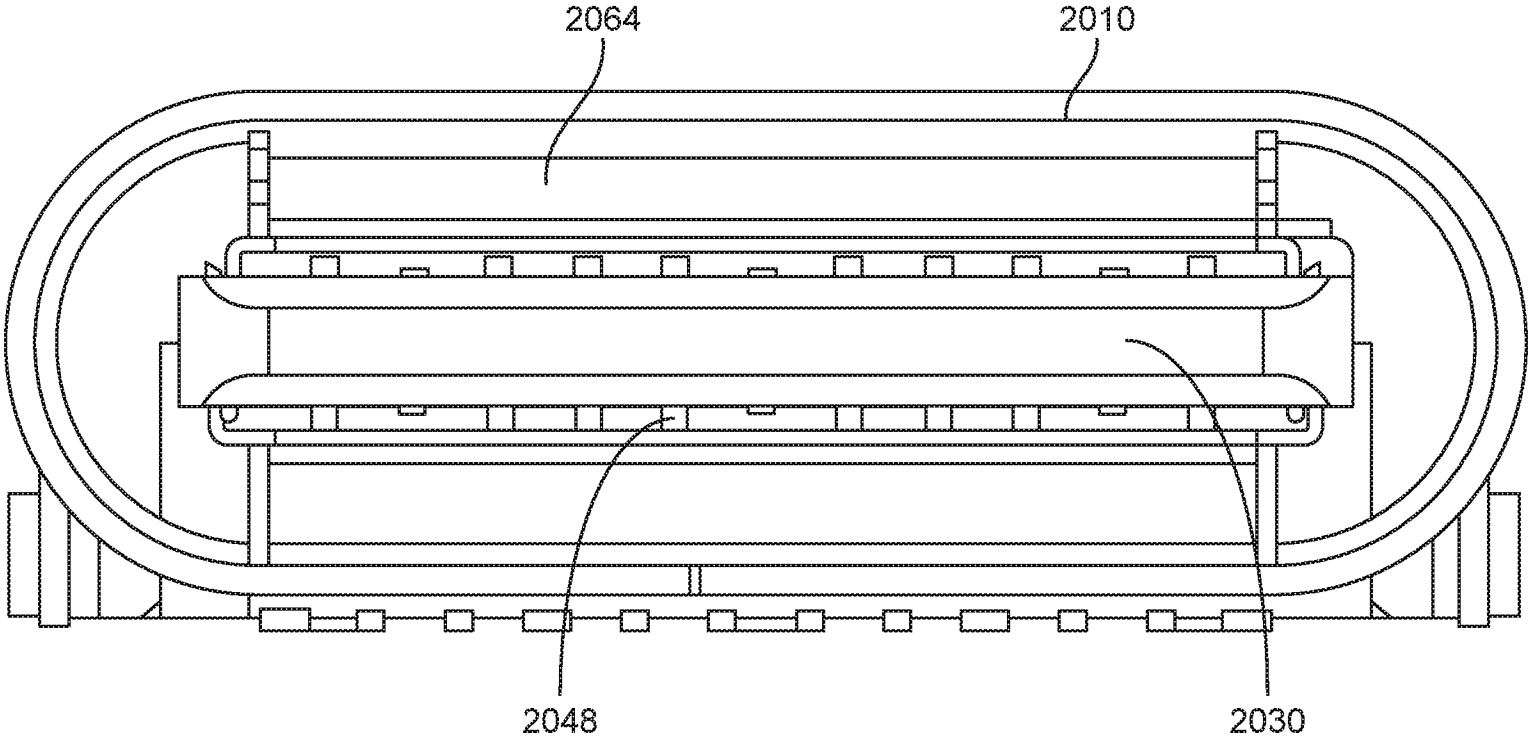
FIG. 21 illustrates a front view of the connect receptacle of FIG. 20.

FIG. 21 illustrates a front view of the connect receptacle of FIG. 20. Again, tongue 2030 may be surrounded by shield 2010. Tongue 2030 may support a number of contacts 2040. In vertical portion 2064 of ground piece 2060 may be contacted by a front portion of a shield of a connector insert in the connector insert is inserted into this connector receptacle.

Figure 22:
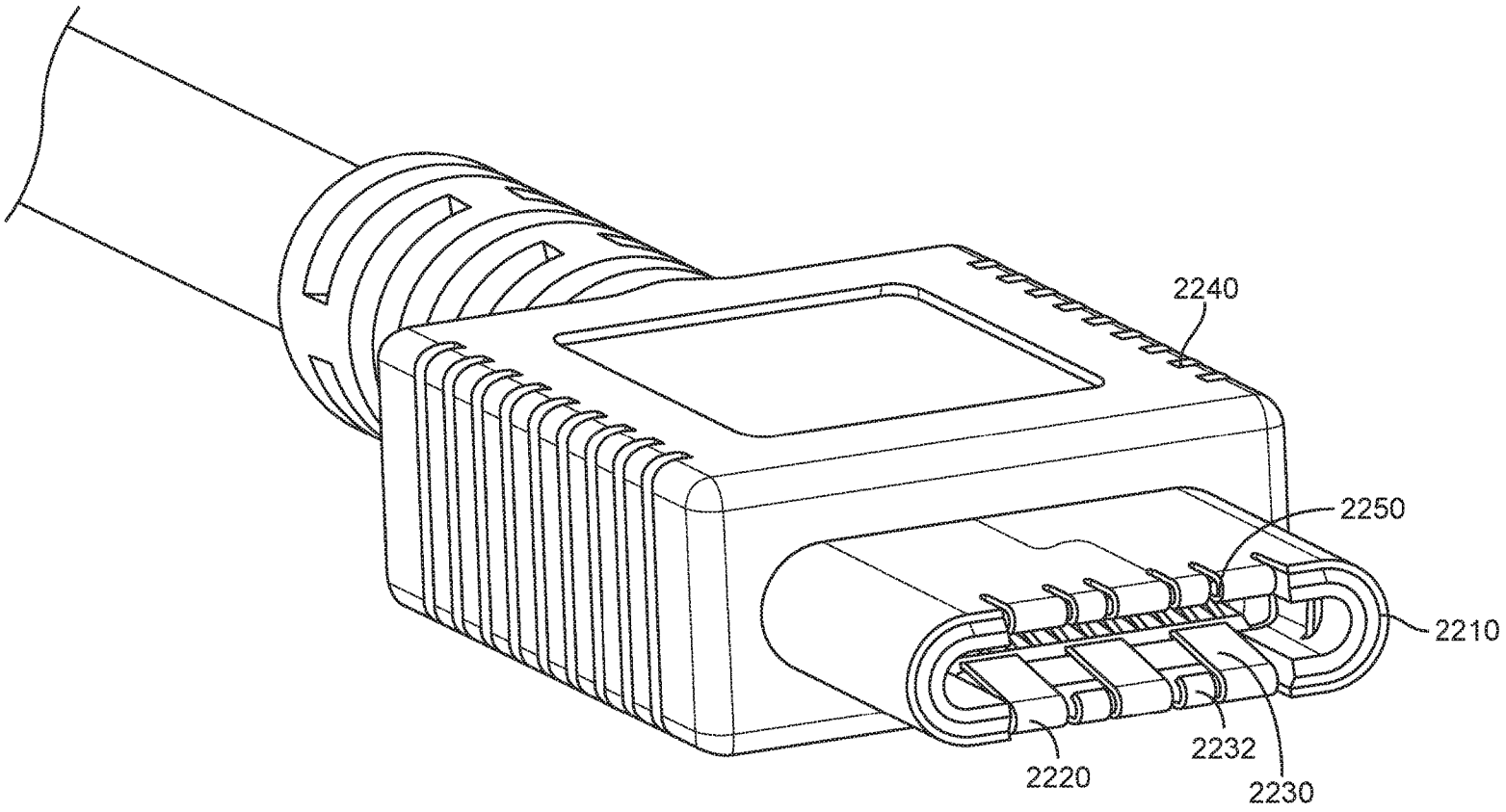
FIG. 22 illustrates another connector insert according to an embodiment of the present invention.

FIG. 22 illustrates another connector plug or insert according to an embodiment of the present invention. This connector insert may include a shield 2220. This shield may be located around insert housing 2210. Insert housing 2210 may be form of plastic or other nonconducting material. A leading edge of shield 2220 may be folded back into an opening of the connector insert to form one or more contacts 2230 and 2232. These contacts may be split to improve contact to ground pads or other ground structures on a connector receptacle.

Again, during insertion, contacts 2230 may form undesirable electrical connections with pads or contacts on a tongue of a connector receptacle. Accordingly, contacts 2230 may be separated by smaller contacts 2232 such that undesirable connections to power contacts or other contacts are not created during insertion. The connector insert may further include housing 2240 to include circuitry and a printed circuit board. Housing 2240 may be serrated to be more easily handled by a user during insertion and extraction. The connector insert may further include contacts 2230 form electrical connections with contacts on a tongue of the connector receptacle.

Figure 23:
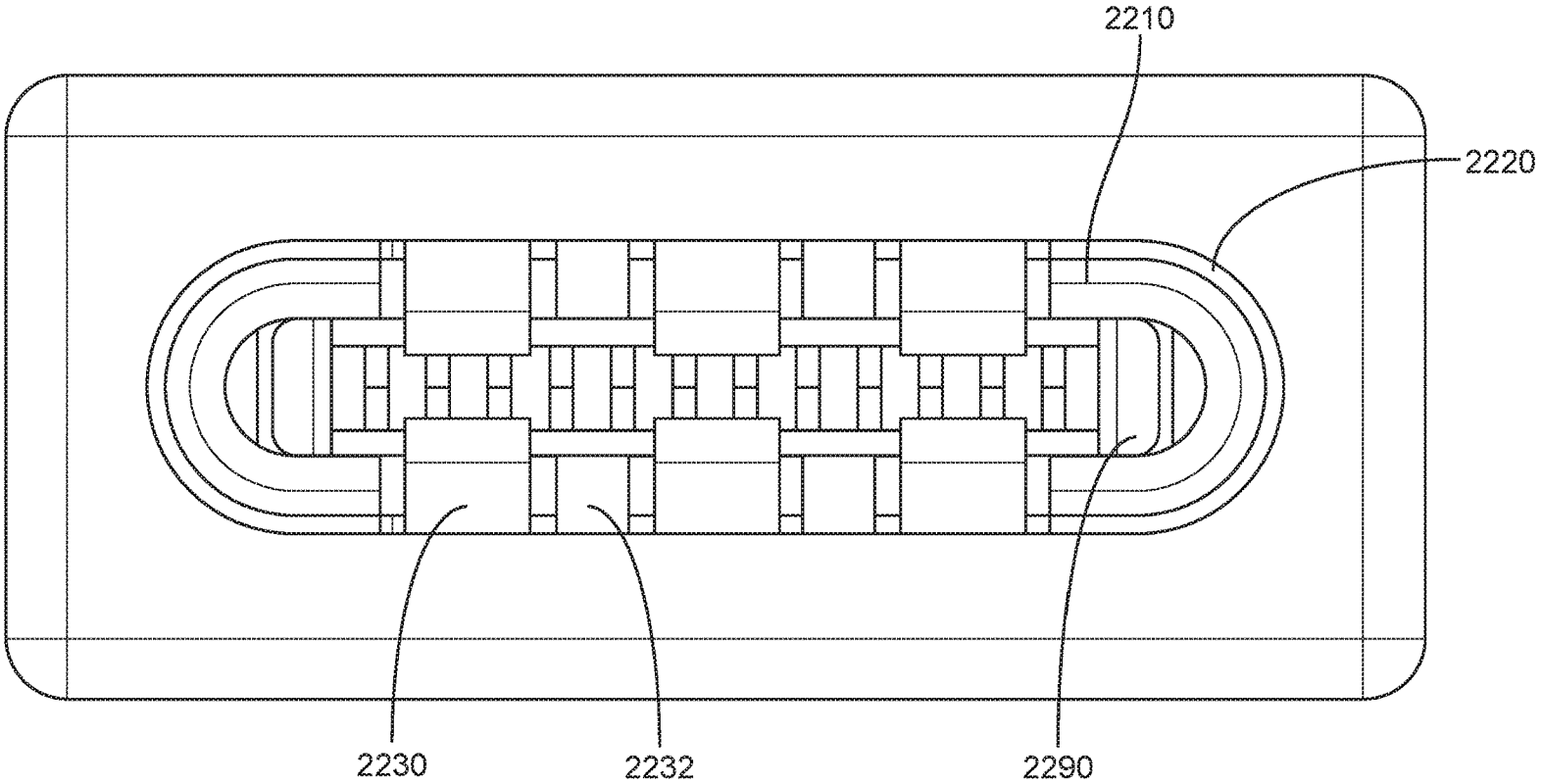
FIG. 23 illustrates a front view of the connector insert of FIG. 22.

FIG. 23 illustrates a front view of the connector insert of FIG. 22. Again, a leading edge of shield 2220 may be folded back into an opening of the connector insert to form contacts 2230 and 2232. Contacts 2232 may be lower profile to avoid undesirable electrical connections during insertion. Side ground contacts 2290 for shielding and retention may fit in notches in a tongue in a receptacle.

Figure 24:
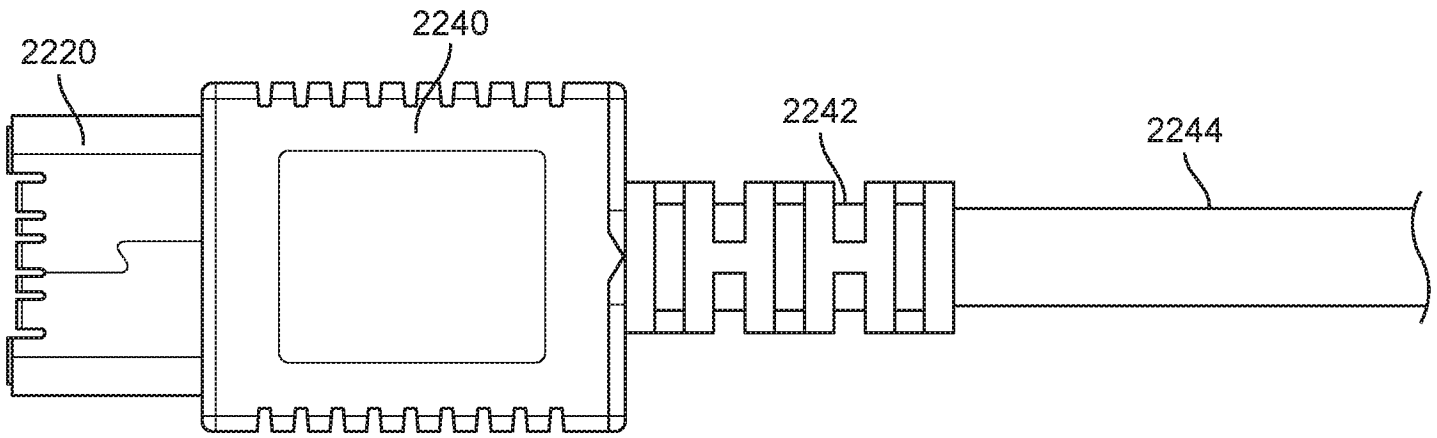
FIG. 24 illustrates a top view of the connector insert of FIG. 22.

FIG. 24 illustrates a top view of the connector insert of FIG. 22. Again, this connector insert may include shield 2220 and housing 2240. Cable 2244 may include one or more conductors to connect to circuitry in housing 2240 and contacts in the connector insert and to shield 2220. Strain relief 2242 may improve durability of a connector insert at the interface between housing 2240 and cable 2244. As before, housing 2240 and strain relief 2242 may be serrated for improved handling by a user during insertion and extraction.

Figure 25:
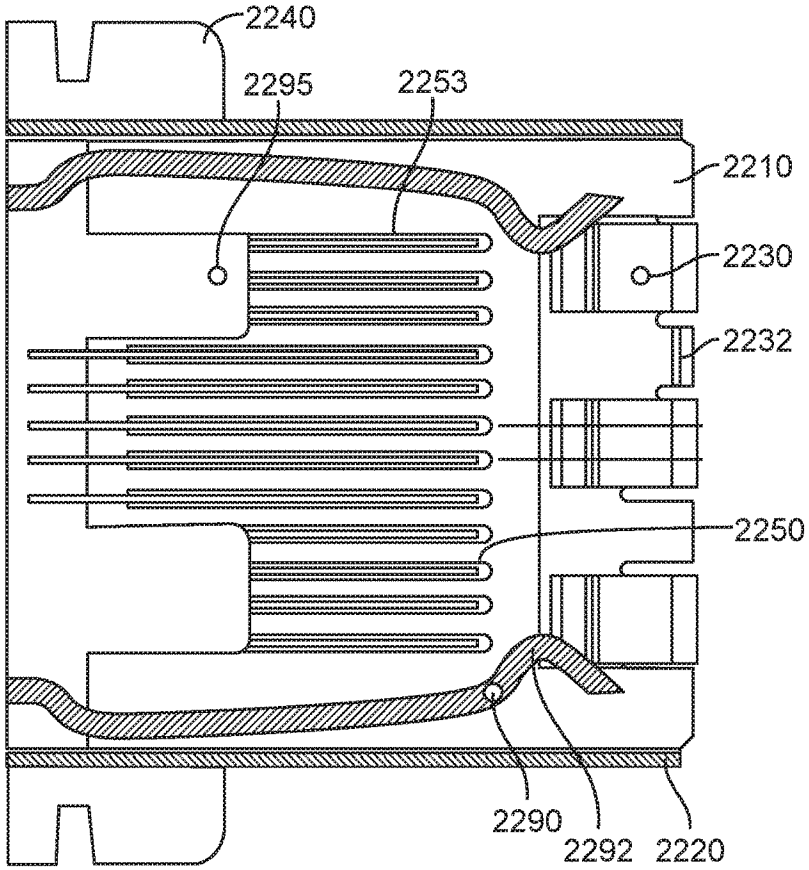
FIG. 25 illustrates a top cross-section view of the connector insert of FIG. 22.

FIG. 25 illustrates a top cross-section view of the connector insert of FIG. 22. This connector insert may include contacts 2253 at each end for contacting ground contacts in a connector receptacle, such as one of the connector receptacles shown herein. This connector insert may further include contacts 2250 for forming electrical connections with contacts in a connector receptacle. Shield 2220 may be folded back around housing 2210 at a front opening to form contacts 2230 and 2232. Side ground contacts 2290 may be included and may include contacting portions 2292. Contact portions 2292 may fit in notches in sides of a tongue in a connector receptacle. Ground structures 2295 and housing 2240 may be included.

Figure 26:
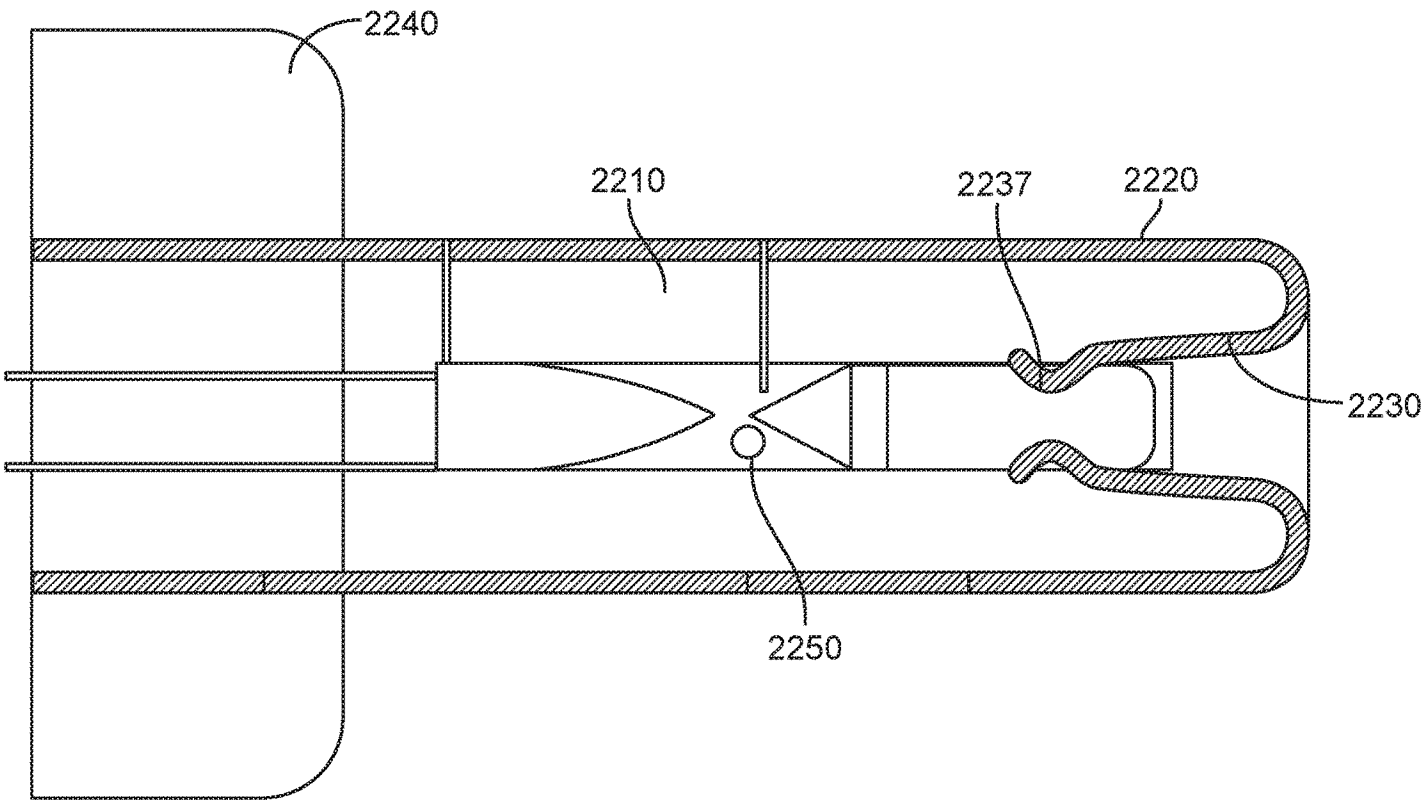
FIG. 26 illustrates a side cut away view of a connector insert of FIG. 22.

FIG. 26 illustrates a side cut away view of a connector insert of FIG. 22. Contacts 2250 may be located in housing 2210. Shield 2220 may be folded back to form contacts 2230. Contacts 2230 may include contacting portions 2237. Contacting portion 2237 may form an electrical connection with pads on a tongue in a connector receptacle. As before, housing 2240 may be included.

In various embodiments of the present invention, ground contacts 2230 may be formed in various ways. For example, instead of folding back a front edge of shield, ground contacts may be attached to an inside of a shield. Examples are shown in the following figures.

Figure 27:
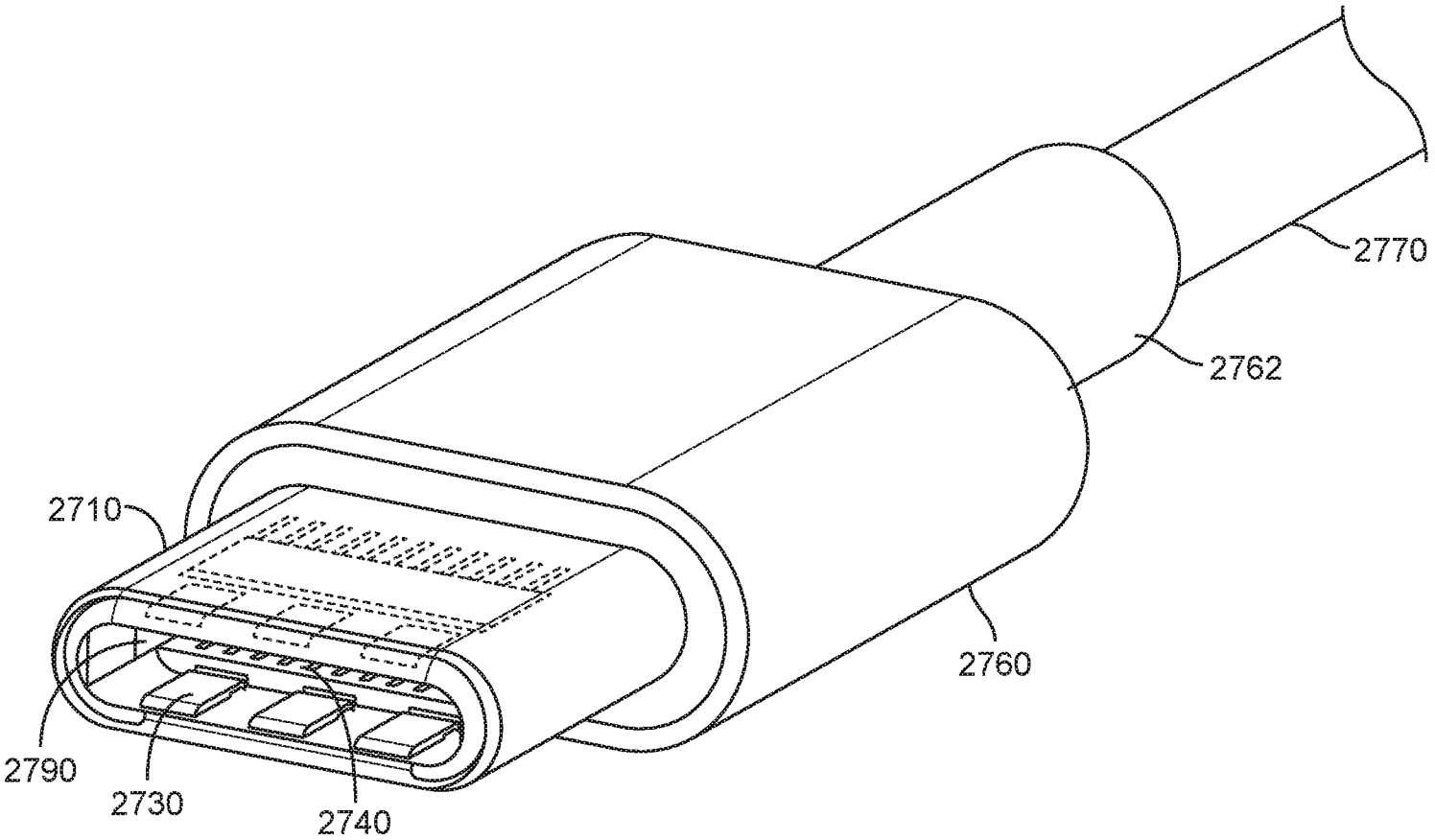
FIG. 27 illustrates a connector insert according to an embodiment of the present invention.

FIG. 27 illustrates a connector insert according to an embodiment of the present invention. This connector insert may include a shield 2710. Shield 2710 may be around ground contacts 2730, contacts 2740, and side ground contacts 2790. Housing 2760 may be formed around a printed circuit board. Various circuits or components may be located on a printed circuit board. Housing 2760 may also provide a structure that may be held by a user during insertion and extraction of this connector insert into and out of a corresponding connector receptacle during use. Conductors in cable 2770 may be connected to contacts 2730, 2740, 2790, or shield 2710, and one or more circuits inside housing 2760. Strain relief 2762 may protect an end of cable 2770.

Figure 28:
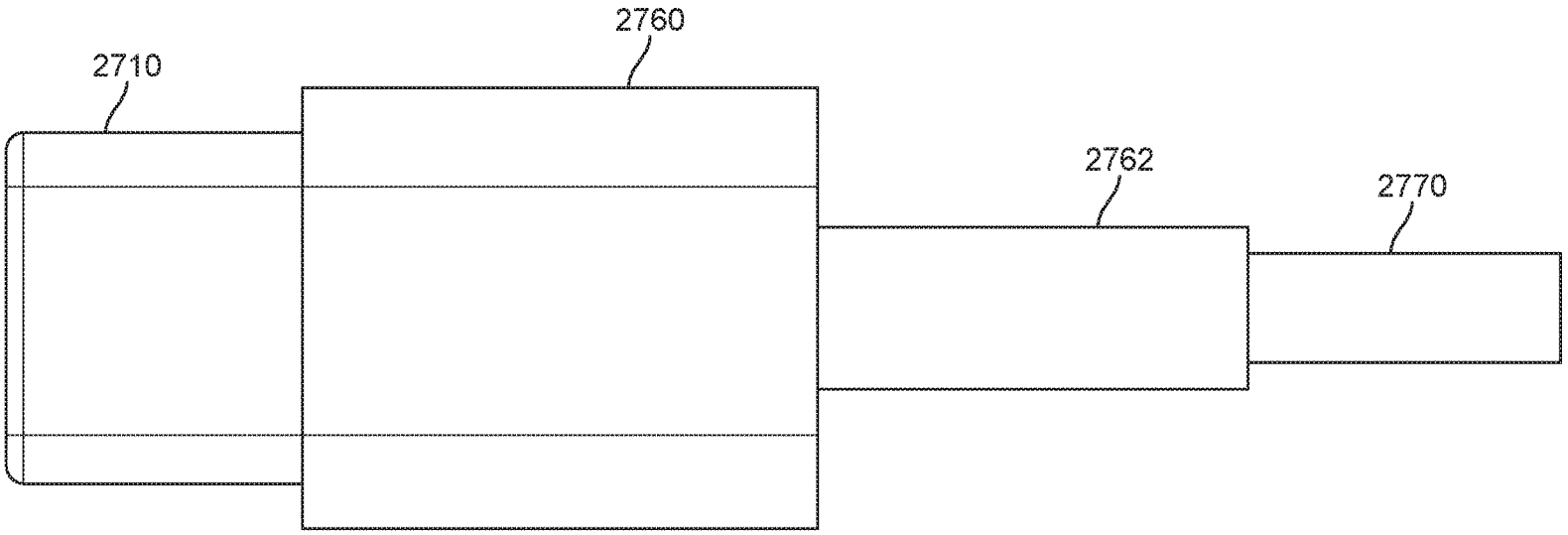
FIG. 28 illustrates a top view of a connector insert of FIG. 27.

FIG. 28 illustrates a top view of the connector insert of FIG. 27. This connector insert may include shield 2710, housing 2760, strain relief 2762, and cable 2770.

Figure 29:
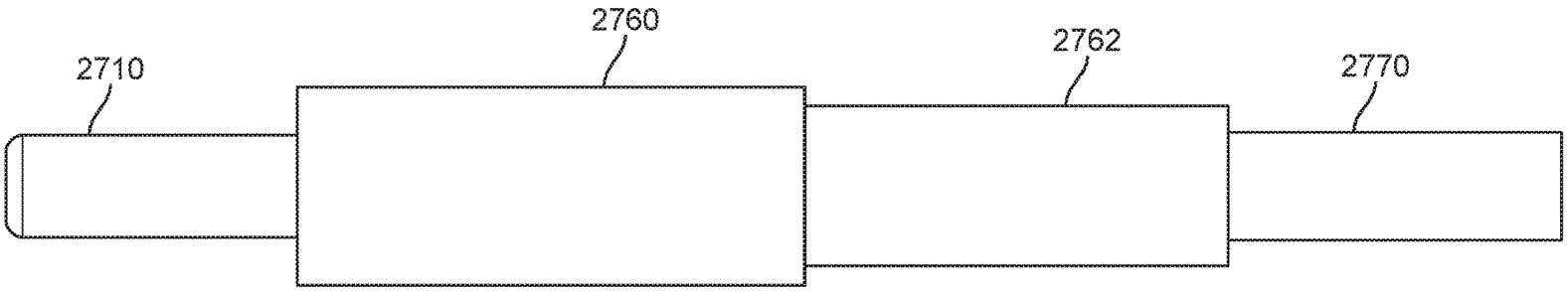
FIG. 29 illustrates a side view of a connector insert of FIG. 27.

FIG. 29 illustrates a side view of a connector insert of FIG. 27. Connector insert may include shield 2710, housing 2760, strain relief 2762, and cable 2770.

Figure 30:
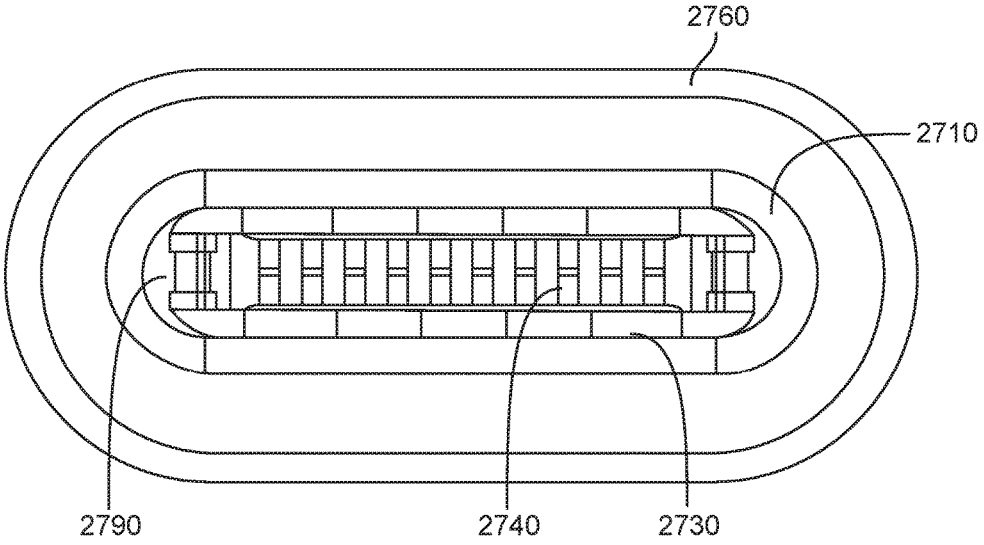
FIG. 30 illustrates a front view of the connector insert of FIG. 27.

FIG. 30 illustrates a front view of the connector insert a FIG. 27. Again, shield 2710 may extend from a front of housing 2760. Ground contacts 2730, side ground contacts 2790, and contacts 2740 may be located inside of shield 2710.

Figure 31:
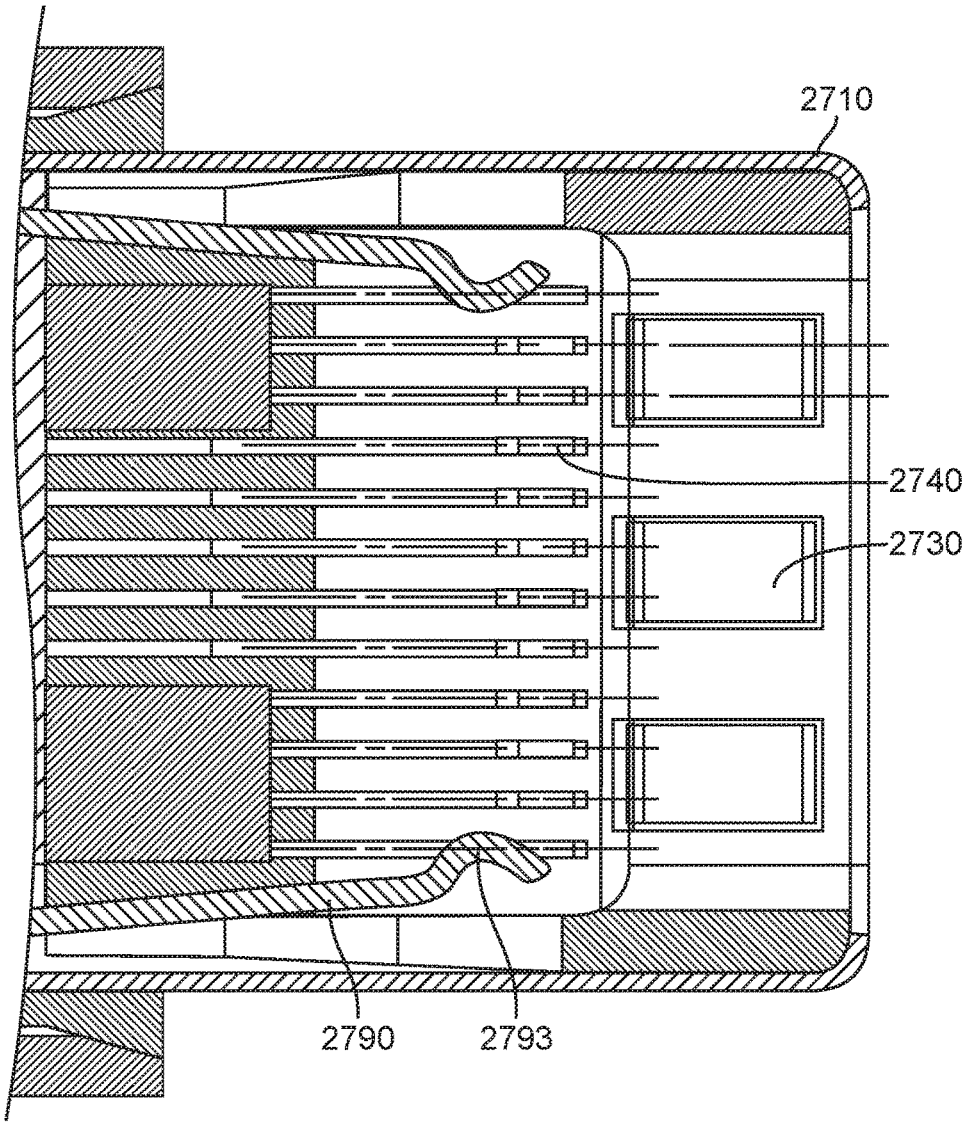
FIG. 31 illustrates a top view of the connector insert of FIG. 27.

FIG. 31 illustrates a top view of a connector insert a FIG. 27. Again, this connector insert may include a shield 2710. A number of contacts 2740 may be located inside of shield 2710. Ground contacts 2730 and side ground contacts 2790 may also be located inside of shield 2710. Side ground contacts 2790 may include contacting portions 2793.

Contacts 2740 may form electrical connections with contacts 1040 when this connector insert is inserted into the connector receptacle of FIG. 13. Similarly, side ground contacts 2790 may form electrical connections with plated latch areas 1045 on sides of tongue 1030 in the connector receptacle of FIG. 13. Side ground contacts 2790 may also fit in notches 1035, thereby providing retention in preventing accidental extraction of a connector insert from the sector receptacle of FIG. 13. Also, ground contacts 2730 may form electrical connections with ground contact 1060 in the connector receptacle of FIG. 13.

These connector inserts may be formed in various ways using various techniques consistent with various embodiments of the present invention. One specific embodiment of the present invention may employ the following acts.

Figure 32:
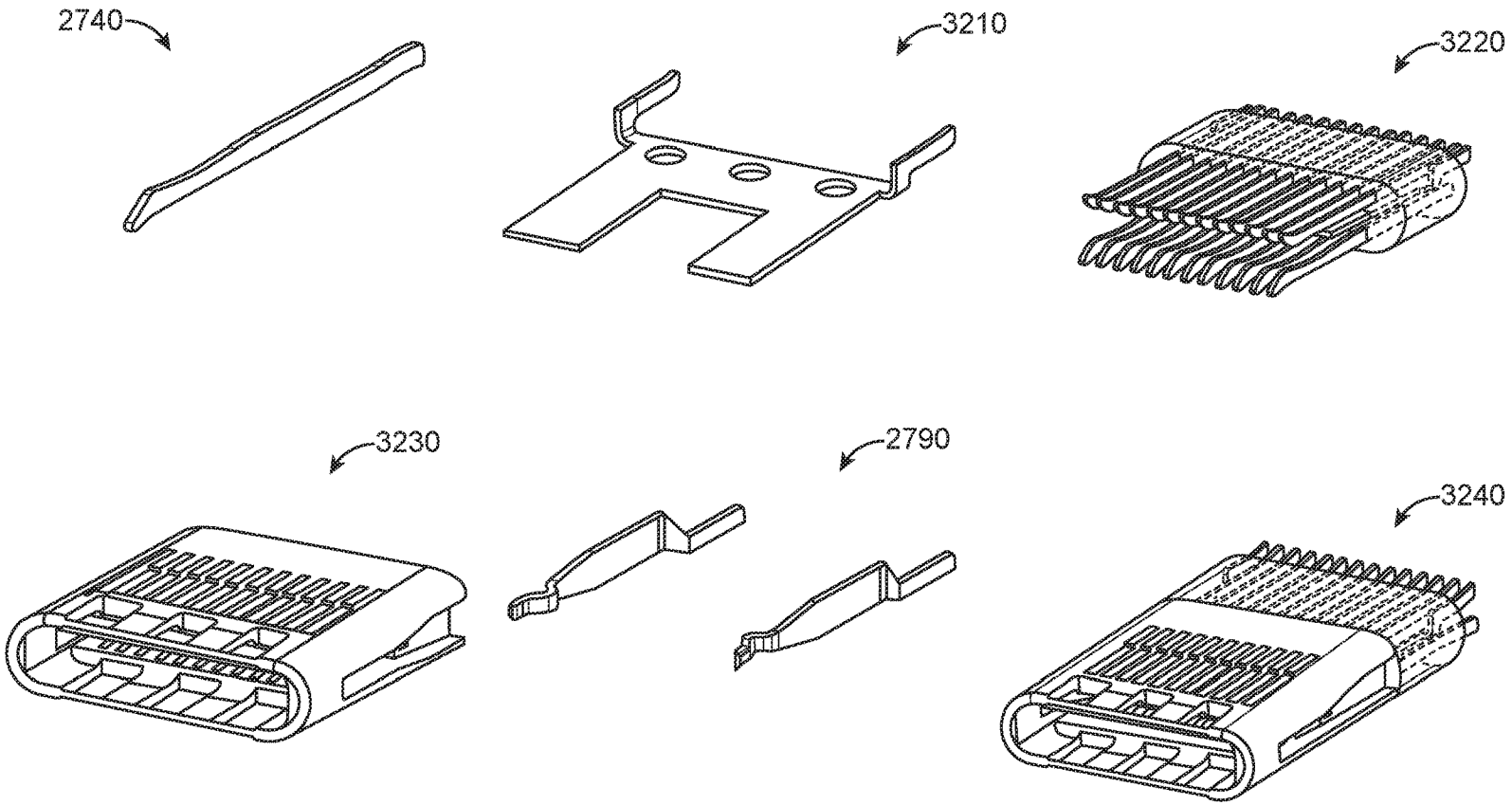
FIG. 32 illustrates initial acts in manufacturing of a connector insert according to embodiment of the present invention.

FIG. 32 illustrates initial acts in a manufacturing of a connector insert according to embodiment of the present invention. A number of contacts 2740 may be formed. A mid-piece 3210 may be formed. An injection or insert molding may be formed around a mid-portion of contacts 2740 and the piece 3210 in order to form unit 3220. A housing portion 3230 may be insert or injection molded. Piece 3220 may be inserted into housing 3230. Side ground contacts 2790 may be inserted into sides of housing 3230, resulting in connector insert piece 3240.

Figure 33:
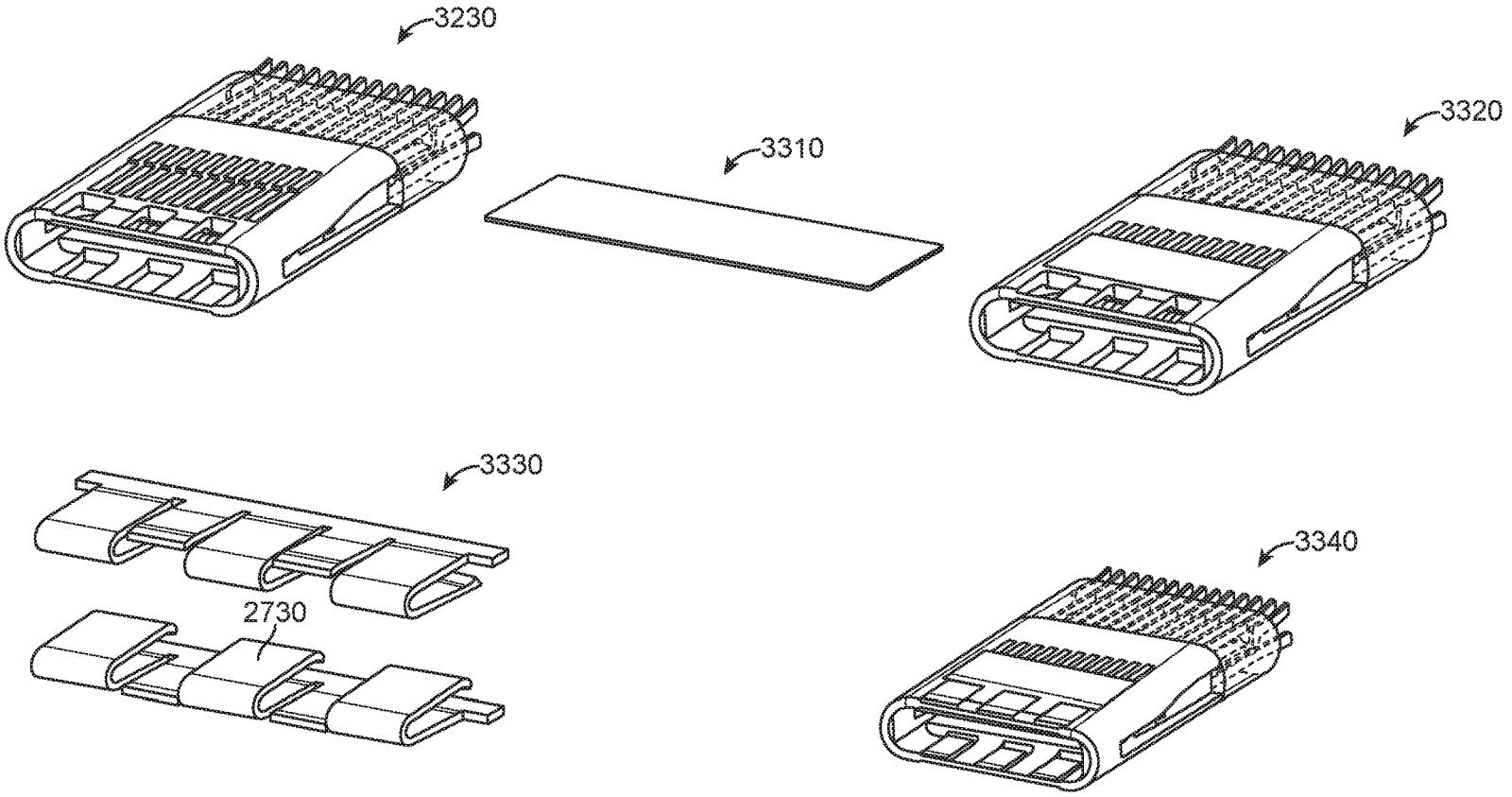
FIG. 33 illustrates following acts that may be used during the manufacture of connector insert according to an embodiment of the present invention.

FIG. 33 illustrates following acts may be used during the manufacture of connector insert according to an embodiment of the present invention. A piece of tape or other isolating piece 3310 may be placed over openings in housing 3230, resulting in structure 3320. Ground contact pieces 3330, including ground contacts 2730, may be inserted into piece 3320, resulting in connector insert piece 3340.

Figure 34:
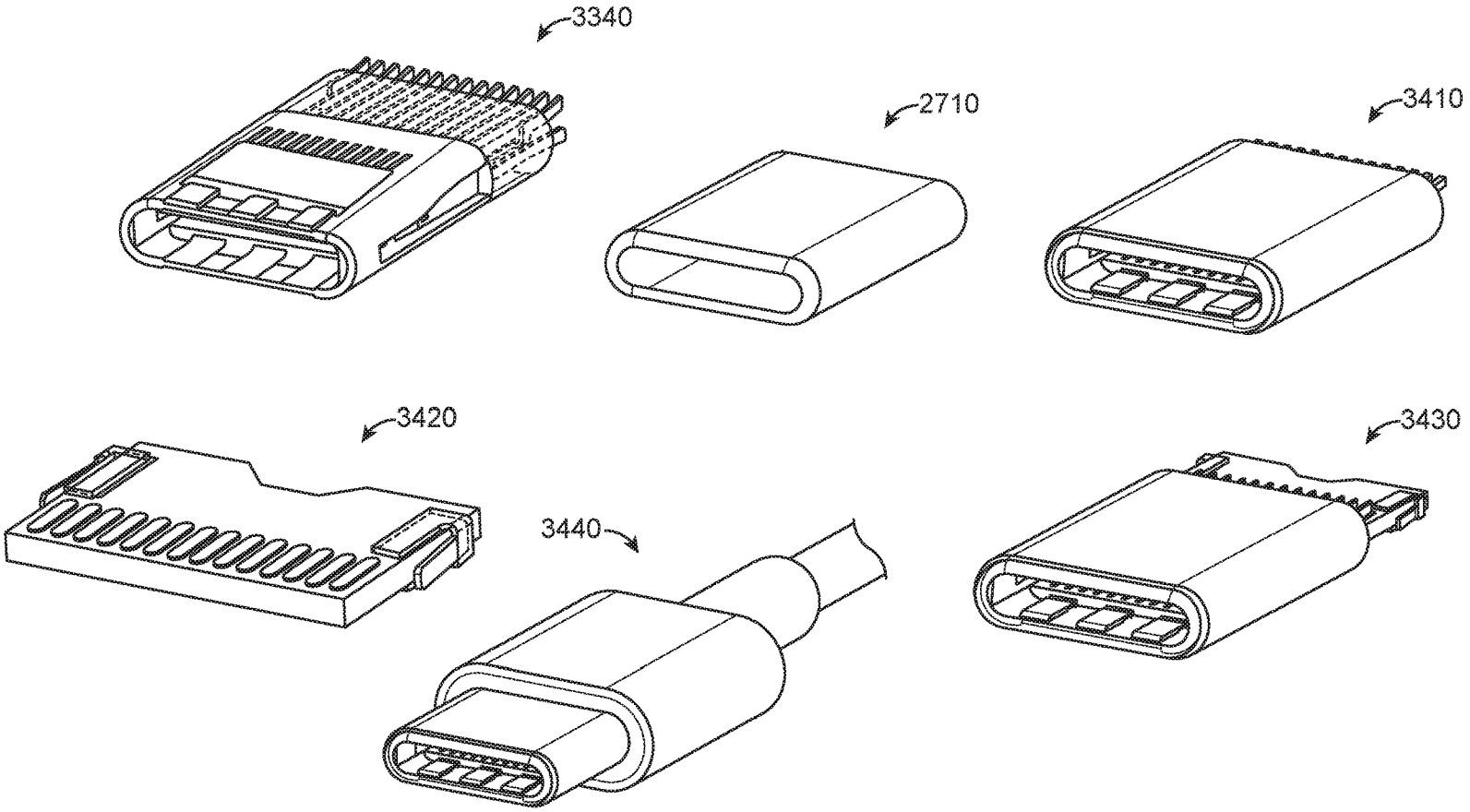
FIG. 34 illustrates following acts that may be used during the manufacture of connector insert according to an embodiment of the present invention.

FIG. 34 illustrates following acts that may be used during the manufacture of connector insert according to an embodiment of the present invention. Connector insert piece 3340 may be inserted into shield 2710, resulting in connector insert front and 3410. A printed circuit board 3420 may be attached to a rear of connector insert front piece 3410, resulting in connector insert piece 3430. Conductors in a cable may be attached to pads on printed board 3420, and a strain relief and housing may be attached or formed, resulting in connector insert 3440.

Figure 35:
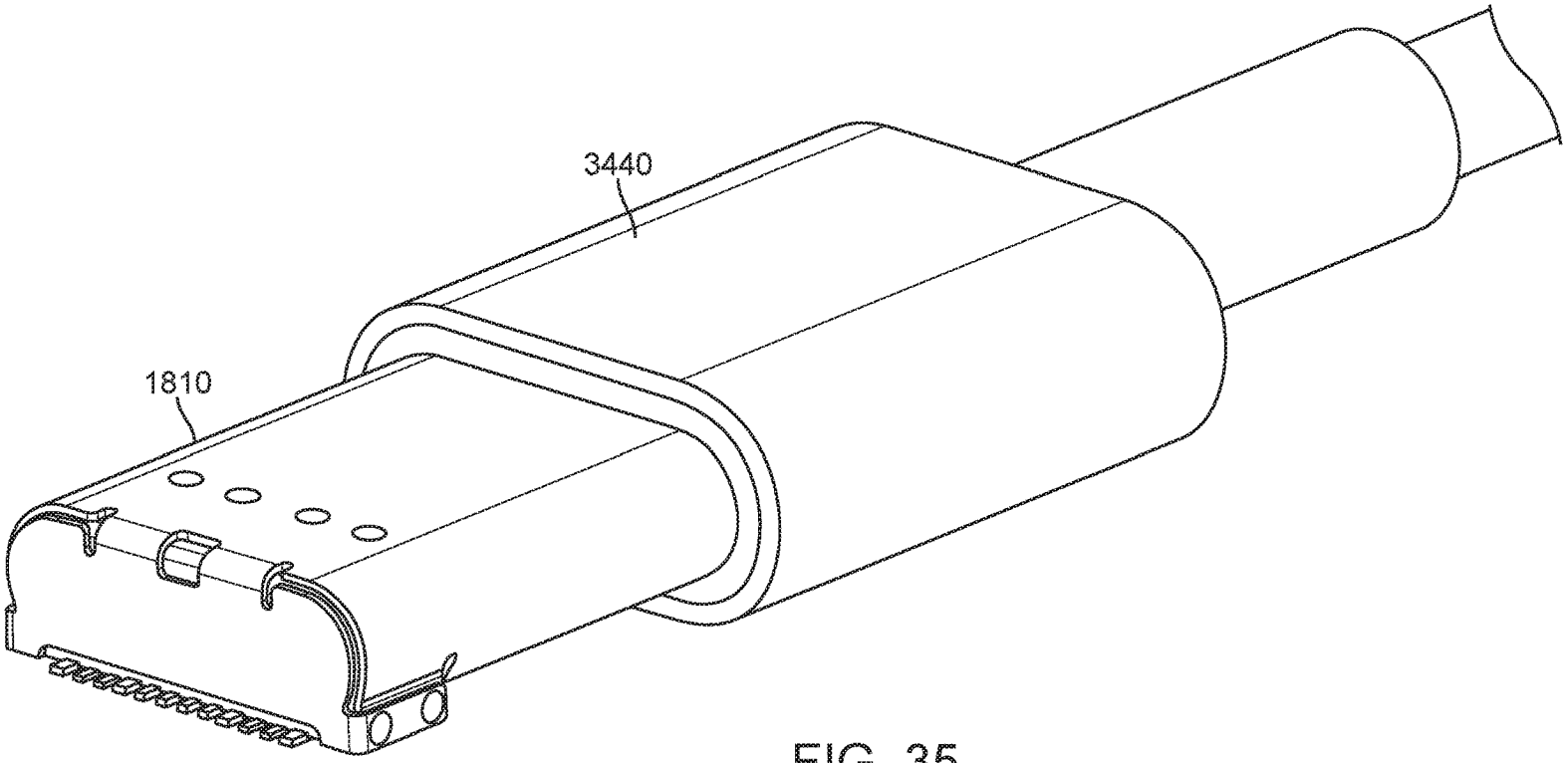
FIG. 35 illustrates a connector insert according to an embodiment of the present invention that has been inserted into a connector receptacle according to an embodiment of the present invention.

FIG. 35 illustrates a connector insert according to embodiments of the present invention that is been inserted into a connector receptacle according to an embodiment of the present invention. Specifically, connector insert 3440 has been inserted into connector receptacle 1810.

Figure 36:
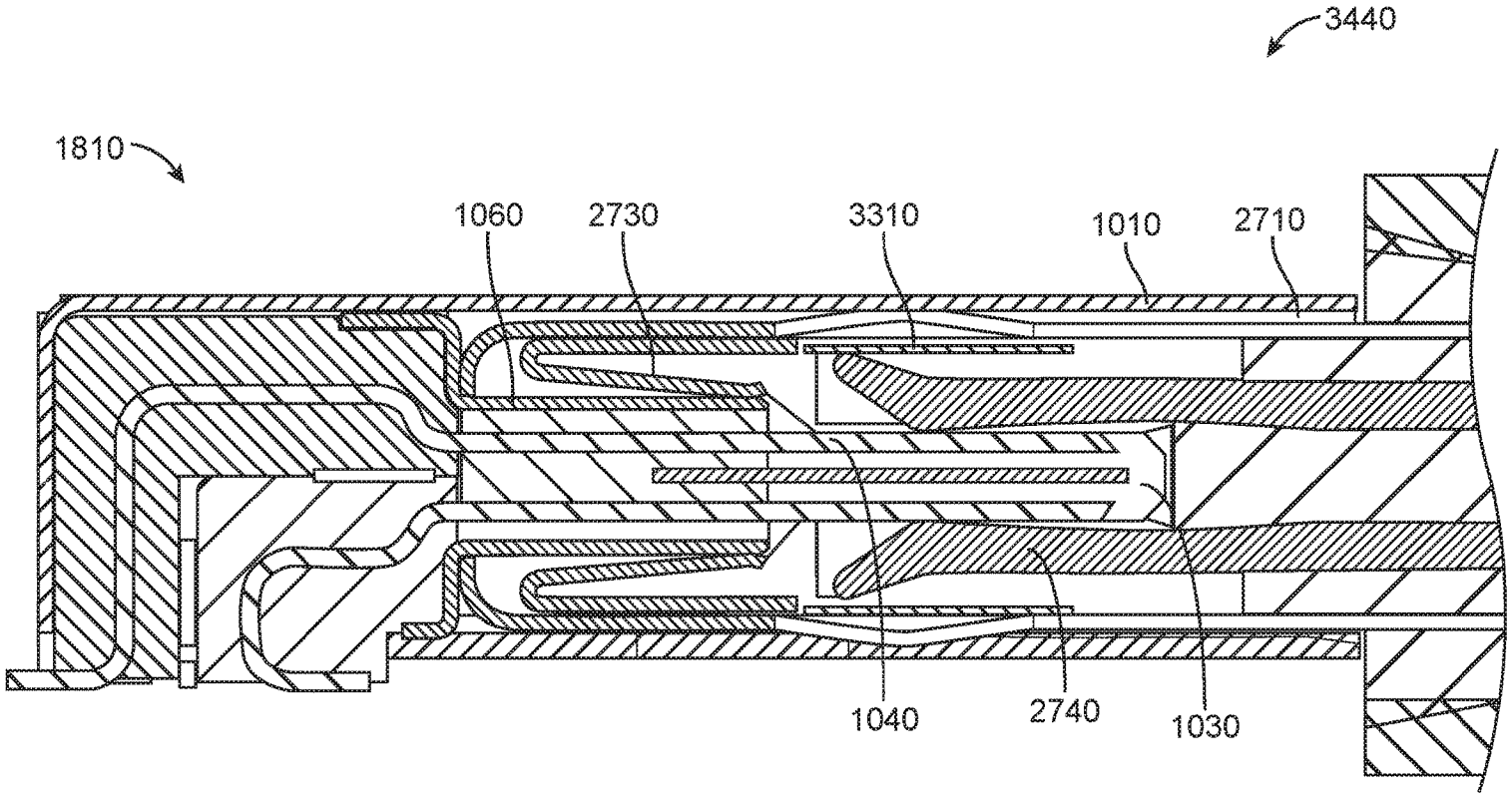
FIG. 36 illustrates a cutaway view showing the mating of a connector insert and a connector receptacle according to an embodiment of the present invention.

FIG. 36 is a cutaway view showing the mating of a connector insert and a connector receptacle according to an embodiment of the present invention. In this example, connector insert 3440 has been inserted into connector receptacle 1810. Shield 2710 on connector insert 3440 may be inserted inside and may form an electrical connection with shield 1010 of receptacle 1810. Ground contact 2730 may be in electrical contact and attached to shield 2710. Ground contact 2730 may form electrical connections with ground contact 1060. This may form a ground path for shielding and EMI isolation. Contacts 2740 may form electrical connections with contacts 1040 on tongue 1030 of connector receptacle 1810. A central ground piece may be placed in tongue 1030 midway between contacts 1040 as shown.

When connector insert 3440 is inserted into connector receptacle 1810, contacts 2740 may deflect sufficiently to electrically contact shield 2710. To prevent this, isolation piece 3310 may be used. Isolation piece 3310 may be Kapton tape, foam, or other nonconductive material. This or similar techniques may be employed in the other examples shown herein and in other embodiments of the present invention.

Figure 37:
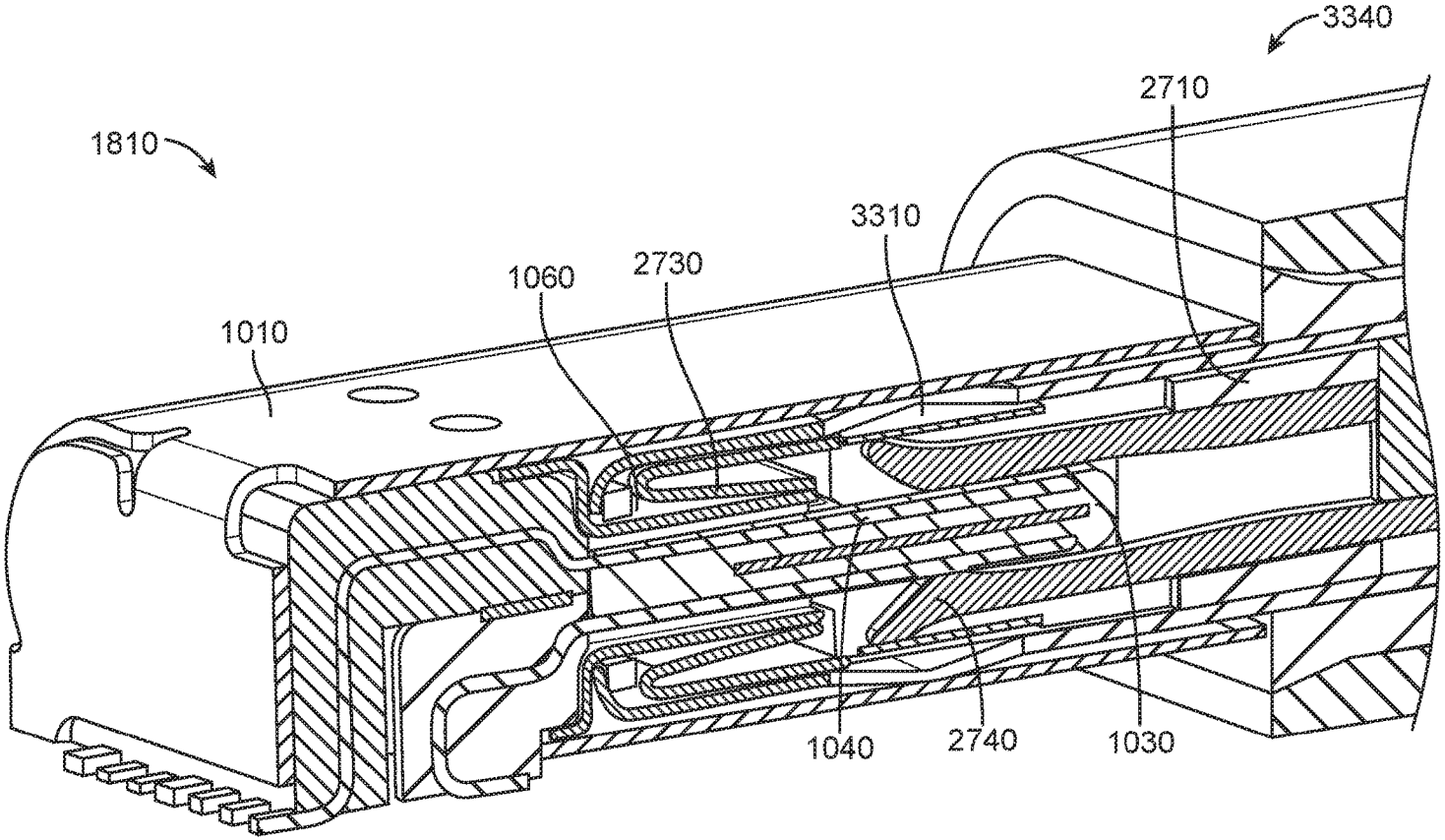
FIG. 37 illustrates an oblique view showing the mating of a connector insert in a connector receptacle according to an embodiment of the present invention.

FIG. 37 is an oblique view showing the mating of a connector insert in a connector receptacle according to an embodiment of the present invention. Again, in this example, connector insert 3440 has been inserted into connector receptacle 1810. Shield 2710 on connector insert 3440 may be inserted inside and may form an electrical connection with shield 1010 of receptacle 1810. Ground contact 2730 may be in electrical contact and attached to shield 2710. Ground contact 2730 may form electrical connections with ground contact 1060 or 1910, as shown in FIG. 19. This may form a ground path for shielding and EMI isolation. Contacts 2740 may form electrical connections with contacts 1040 on tongue 1030 of connector receptacle 1810.

Again, in this example, various ground paths are present. Ground contacts 2730 at a front end of a connector insert may mate to with ground contacts 1060 on a tongue 1030 of a connector receptacle. Also, a shield 2710 on the connector insert may form electrical connection with a shield 1010 of a connector receptacle.

In other embodiments of the present invention, the first of these ground paths maybe removed, and reliance may be placed on the second for grounding and EMI isolation. In these situations, one or more fingers may be included on either connector shield to improve connection reliability.

In various embodiments of the present invention, ground contacts 2730 may be formed in various ways. An example is shown in the following figures.

Figure 38:
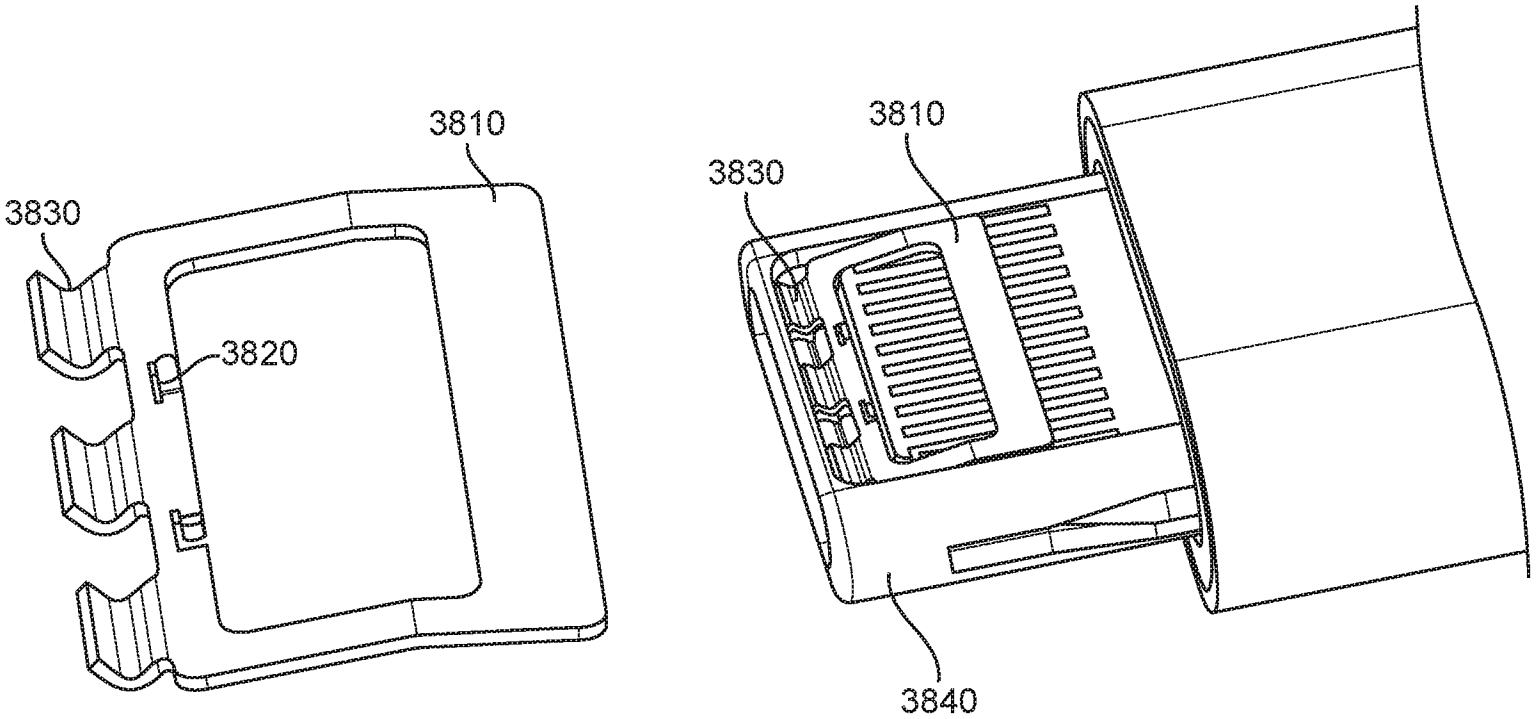
FIG. 38 illustrates a ground contact piece according to an embodiment of the present invention.

FIG. 38 illustrates a ground contact piece according to an embodiment of the present invention. Ground contact piece 3210 may include a number of ground contacts 3230. Ground contact piece 3210 may reside in housing 3240 in a connector insert.

Again, it may be desirable that the inclusion of these ground contacts does not significantly lengthen or increase the thickness of these connector inserts. However, it may be desirable to have a long lever arm such that a strong force may be applied by the ground contacts to corresponding ground contacts on a top of a connector receptacle tongue. In order to keep the added length short while having a long lever arm, ground contact piece 3810 may be placed over signal contacts 3850. Placing ground contact piece 3810 over signal contacts 3850 allows ground contact piece 3810 to provide a long lever arm while only lengthening the connector insert by an amount needed for the actual ground contacts 3830. The long lever arm provided by ground contact piece 3810 may help to prevent deformation of the ground contacts during the life of the connector insert and may allow a strong contacting force to be applied by ground contacts 3830 to the corresponding contacts on a connector receptacle tongue.

Ground contact piece 3810 may include opening 3860. Opening 3860 may help to reduce the capacitance between signal pins 3850 and ground contact piece 3810, thereby improving the impedance at signal contacts 3850. A piece of tape (not shown) may be used to electrically isolate contacts 3850 from shield 3840. Ground contacts 3830 may be arranged such that during the insertion of this connector insert into a connector receptacle, ground contacts 3830 do not cause damage to circuits connected to or associated with the connector insert or connector receptacle when they engage contacts on a tongue in the connector receptacle.

As before, it may be desirable to provide an electrical connection between ground contacts 3830 and a shield on the connector insert or plug. Accordingly, a ground contact piece in the above and other examples may include touch points or fingers. An example is shown in the following figure.

Figure 39:
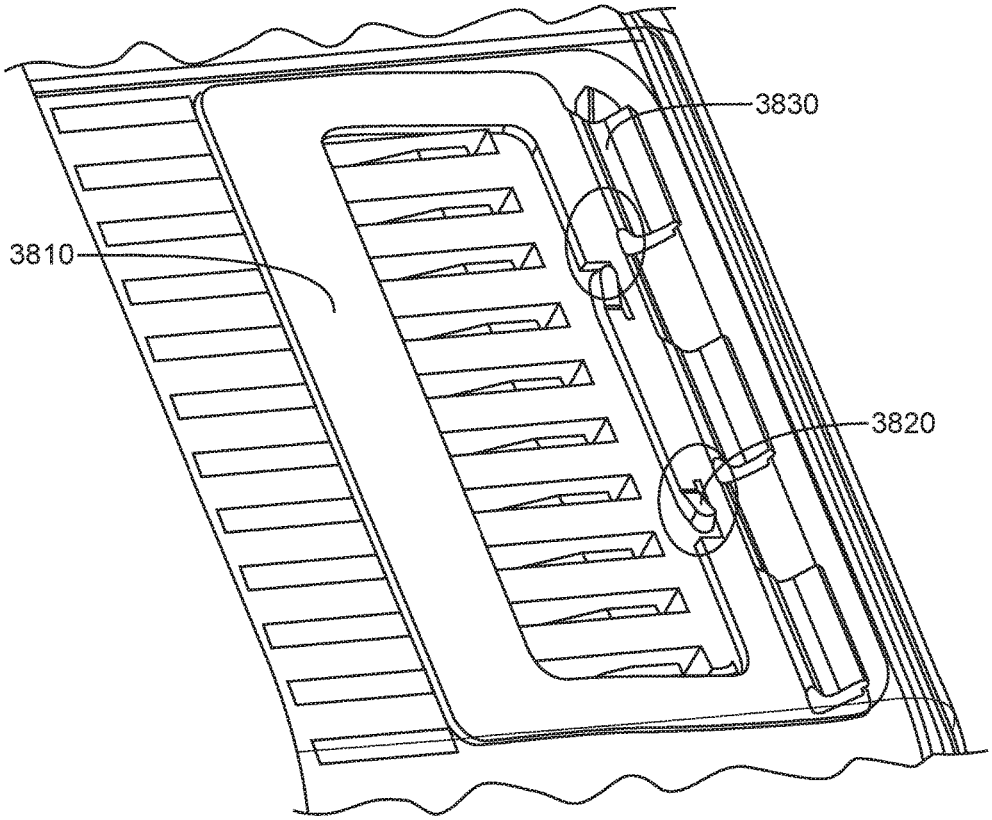
FIG. 39 illustrates a close-up view of a ground piece according to an embodiment of the present invention.

FIG. 39 illustrates a close-up view of a ground piece according to an embodiment of the present invention. Ground piece 3810 again may include a number of ground contacts 3830. Ground contacts 3830 may form electrical connections with ground pad, contacts, or other structures in a connector receptacle. For example, ground contacts 3830 may form electrical connections with a ground pad or piece on a tongue in a connector receptacle, or other appropriate ground pieces or pads.

Ground piece 3810 may further include one or more fingers 3820. Fingers 3820 may form an electrical connection to a shield, such a shield 2710 around a connector insert.

In other embodiments of the present invention, it may be desirable to provide additional touch points between a ground piece and a connector insert shield. Examples of such ground pieces can be found in co-pending U.S. patent application Ser. No. 14/543,717, filed Nov. 17, 2014, titled GROUND CONTACTS FOR REDUCED-LENGTH CONNECTOR INSERTS, which is incorporated by reference.

Figure 40:
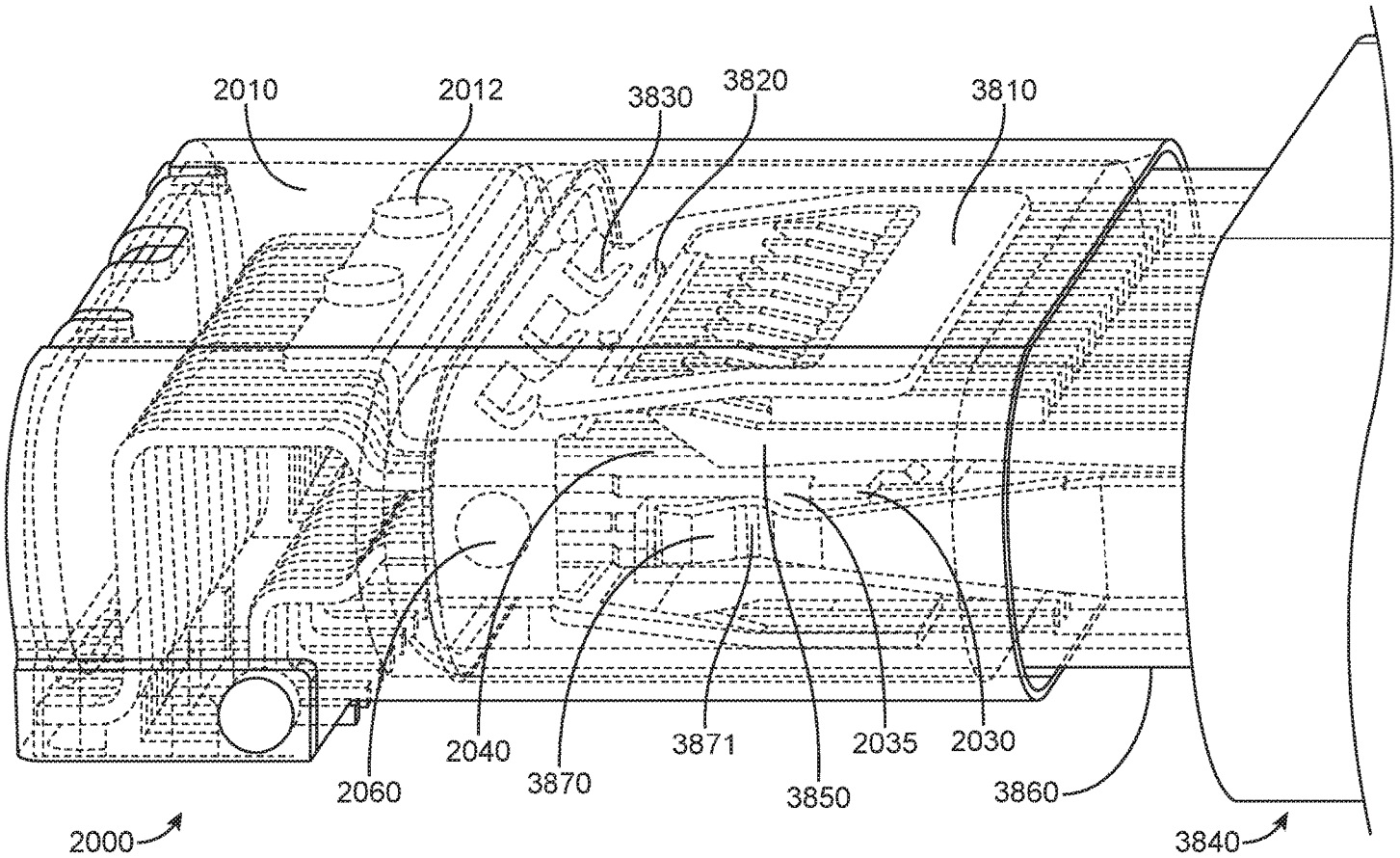
FIG. 40 illustrates another connector insert inserted into a connector receptacle according to an embodiment of the present invention.

FIG. 40 illustrates another connector insert inserted into a connector receptacle according to an embodiment of the present invention. In this example, connector insert 3840 may be inserted into connector receptacle 1900. Connector insert 3840 may be the same or similar to the connector insert shown in FIG. 38. Connector receptacle 2000 may be the same or similar to the connector receptacle shown in FIG. 20.

This connector system, as with the other included connector systems may perform at least three functions. The first is to convey signals from a connector insert to a connector receptacle. These signals may include power, ground, and data signals, such as audio and video signals. A second is to shield these signals while they are being transferred. This may prevent or reduce the corruption of the signals during transfer. A third is to provide a retention force such that the connector insert is not inadvertently removed from the connector receptacle. Such accidental extractions may be particularly undesirable during transfer of large files.

Signals may be transferred using pins 3860 in the connector insert 3840, which may mate with contacts 2040 in receptacle for 2000.

These signals may be shielded in a number of ways. For example, shield 3860 of connector insert 3840 may electrically connect to ground piece 3810 at finger 3820. Ground contacts 3830 at a front of a connector insert may contact a horizontal (or vertical) portion of ground piece 2060. Ground piece 2060 may electrically connect to connector receptacle shield 2010 via connection points 2012. Shield 2010 of connector receptacle 2000 may electrically connect to shield 3860 on connector insert 3840.

Retention may be provided by side ground contacts 3870 engaging notches 2035 on tongue 2030. Specifically, side ground contacts 3870 may include contacting portion 3871, which may engage notches 2035 on sides of tongue 2030. Notches 2035 may be plated and connected to ground, thereby forming another ground path with side ground contacts 3870.

In various embodiments of the present invention, varying amounts of retention force may be desired. Accordingly, side ground contacts 3870 may be pre-biased such that they spring back to fit into notches 2035 during insertion. The strength and thickness of side ground contacts 3870 may also be adjusted to provide different retention forces for different applications. In some embodiments of the present invention, for example some docking stations, it may be desirable to provide zero retention force, in which case side ground contacts 3870 may be omitted.

This connector system, as with the other connector systems shown here, may provide a rotatable connector that may be inserted and either of at least two orientations, which may be 180 degrees apart. This connector system may be free or substantially free of moving parts to improve robustness and reliability. This may also reduce the amount of wear and marring that may occur after usage. Moreover, the shielding provided may allow for transfer of signals and highly isolated manner.

Figure 41:
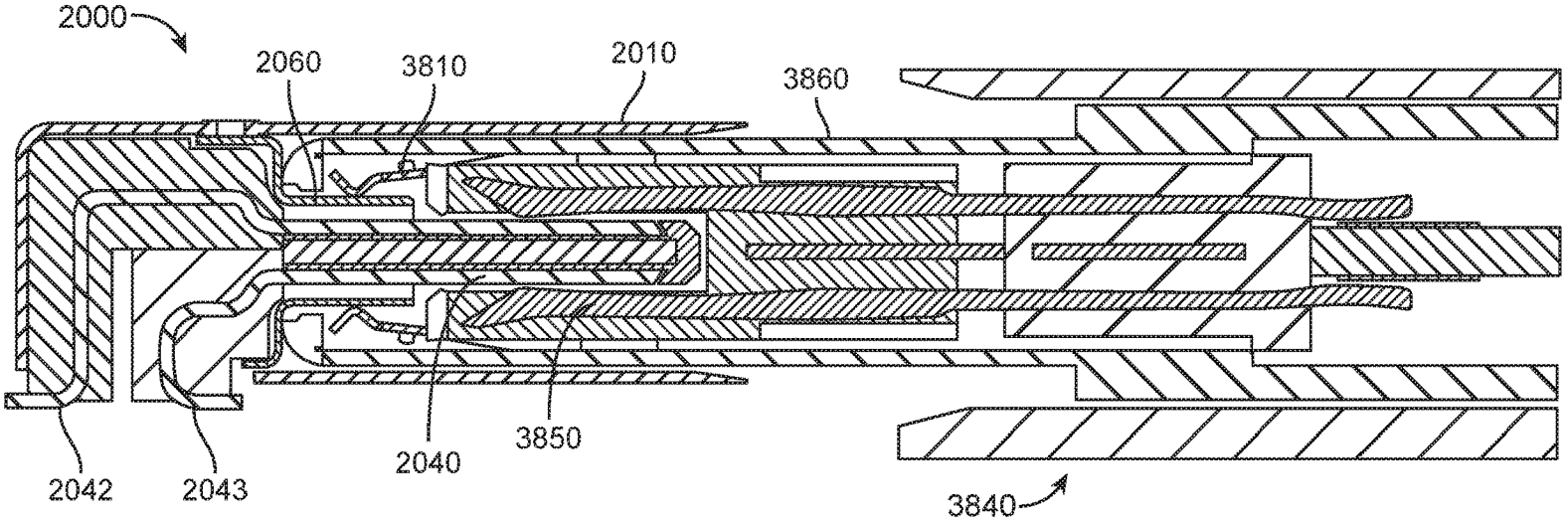
FIG. 41 illustrates a side view of a connector system according to an embodiment of the present invention

FIG. 41 illustrates a side view of a connector system according to an embodiment of the present invention. Again, contacts 3850 and a connector insert may mate with contacts 2040 in a connector receptacle. Ground piece 3810 may form an electrical connection between shield 3860 of a connector insert and ground piece 2060 of a connector receptacle. Ground piece 2060 may further contacts shield 2010 on the receptacle, which may in turn contact shield 3860 of the connector insert. Contacts 2040 in the connector receptacle may emerge from the connector receptacle as contact tails 2042 and 2043. These contact tails may connect to traces or pads on a printed circuit board or other appropriate substrate.

Figure 42:
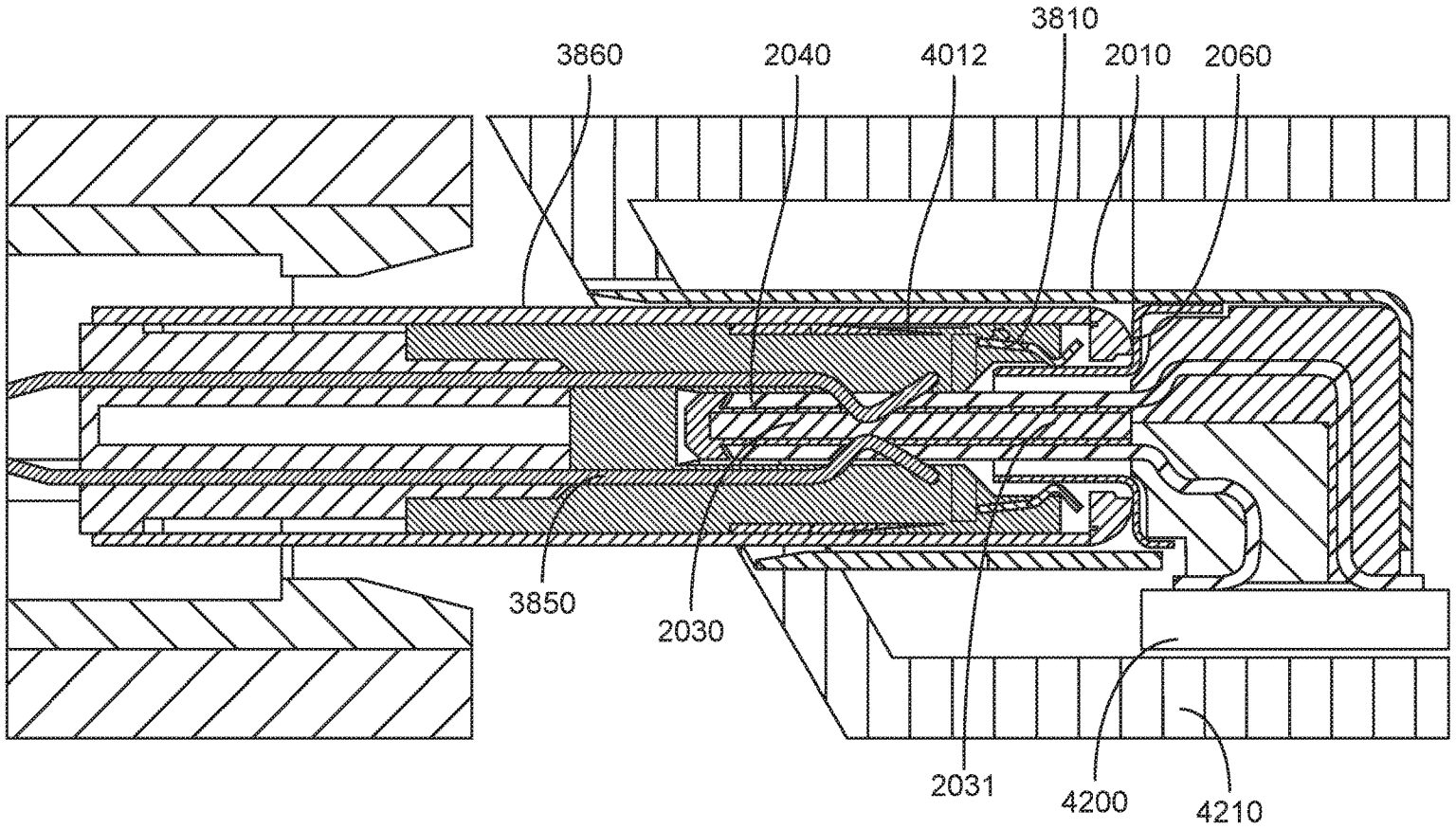
FIG. 42 illustrates a side view of connector system according to an embodiment of the present invention.

FIG. 42 illustrates a side view of connector system according to an embodiment of the present invention. Again, contacts 3850 in a connector insert may convey signals by contacting contacts 2040 in a connector receptacle. The connector receptacle may be mounted on a printed circuit board or other appropriate substrate 4200 in electronic device housing or enclosure 4810. Again, shield 4010 of a connector insert may be attached to or otherwise electrically connected to ground piece 3210. Ground piece 3210 may make an electrical connection to ground piece 2060 in a connector receptacle. Ground piece 2060 may electrically connect to shield 2010 of the connector receptacle. Shield 2010 of the connector receptacle may electrically connect to shield 3860 of the connector insert.

In various embodiments of the present invention, a tongue, such as tongue 2030, may have a thicker portion, shown here as thicker portion 2031. A thicker portion may increase tongue strength and may provide sufficient strength while allowing a front portion of tongue 2030 to be relatively thin.

During insertion of the connector insert into the connector receptacle, contacts 3850 may deflect when they reach tongue 2030. An opening may be provided in the housing in the connector insert to allow this deflection. Without more, contacts 3850 may electrically contact shield 3860 during insertion. Accordingly, isolation tape 4012 may be included to electrically isolate contacts 4040 from shield 3860 during insertion. Isolation tape 4012 may be tape such as Kapton tape, or it may be foam or other insulating or nonconductive material.

Figure 43:
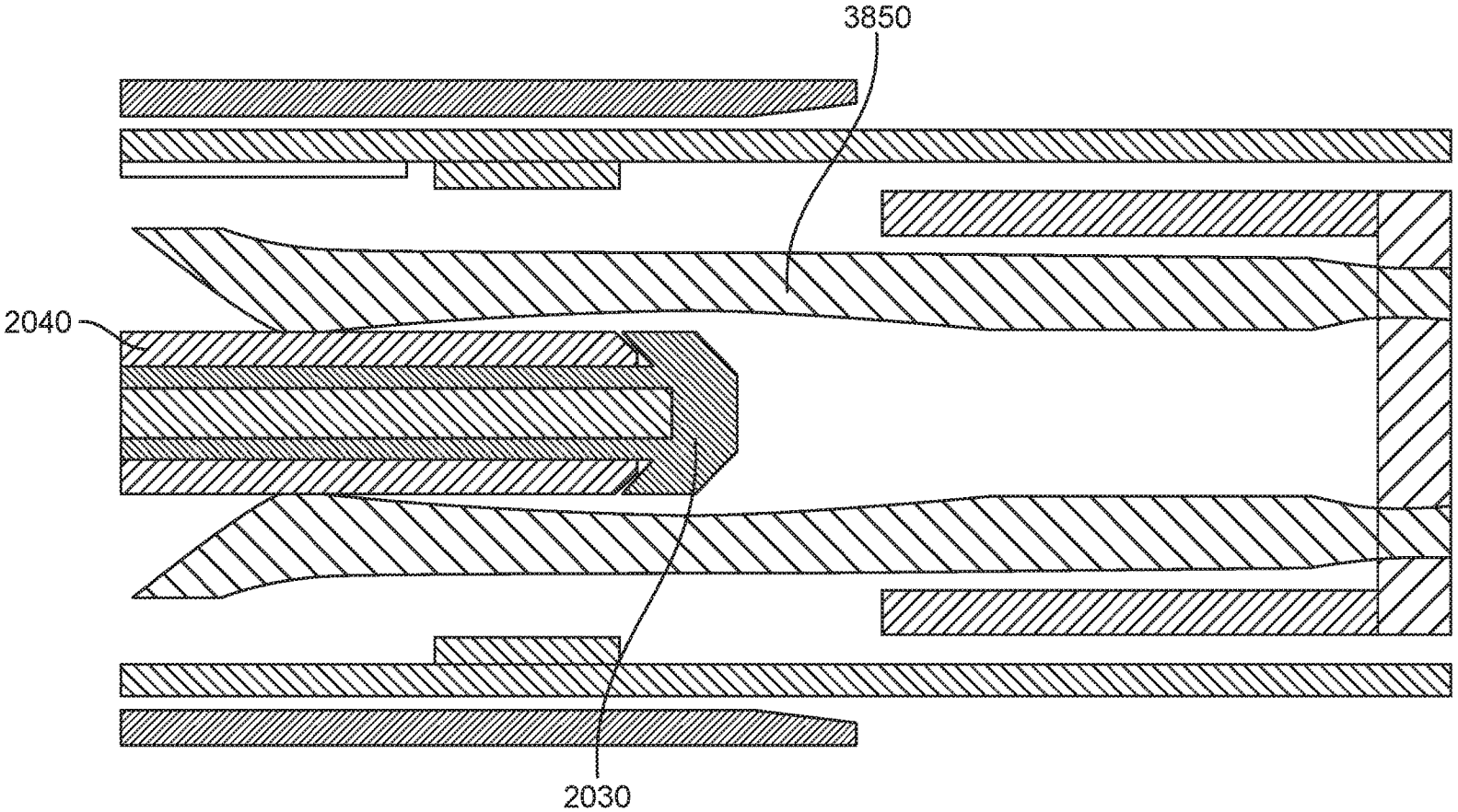
FIG. 43 illustrates a side view of a portion of a connector system according to an embodiment of the present invention.

FIG. 43 illustrates a side view of a portion of a connector system according to an embodiment of the present invention. Again, contacts 3850 in a connector insert may form an electrical connection with contact 2040 on tongue 2030 in a connector receptacle.

Figure 44:
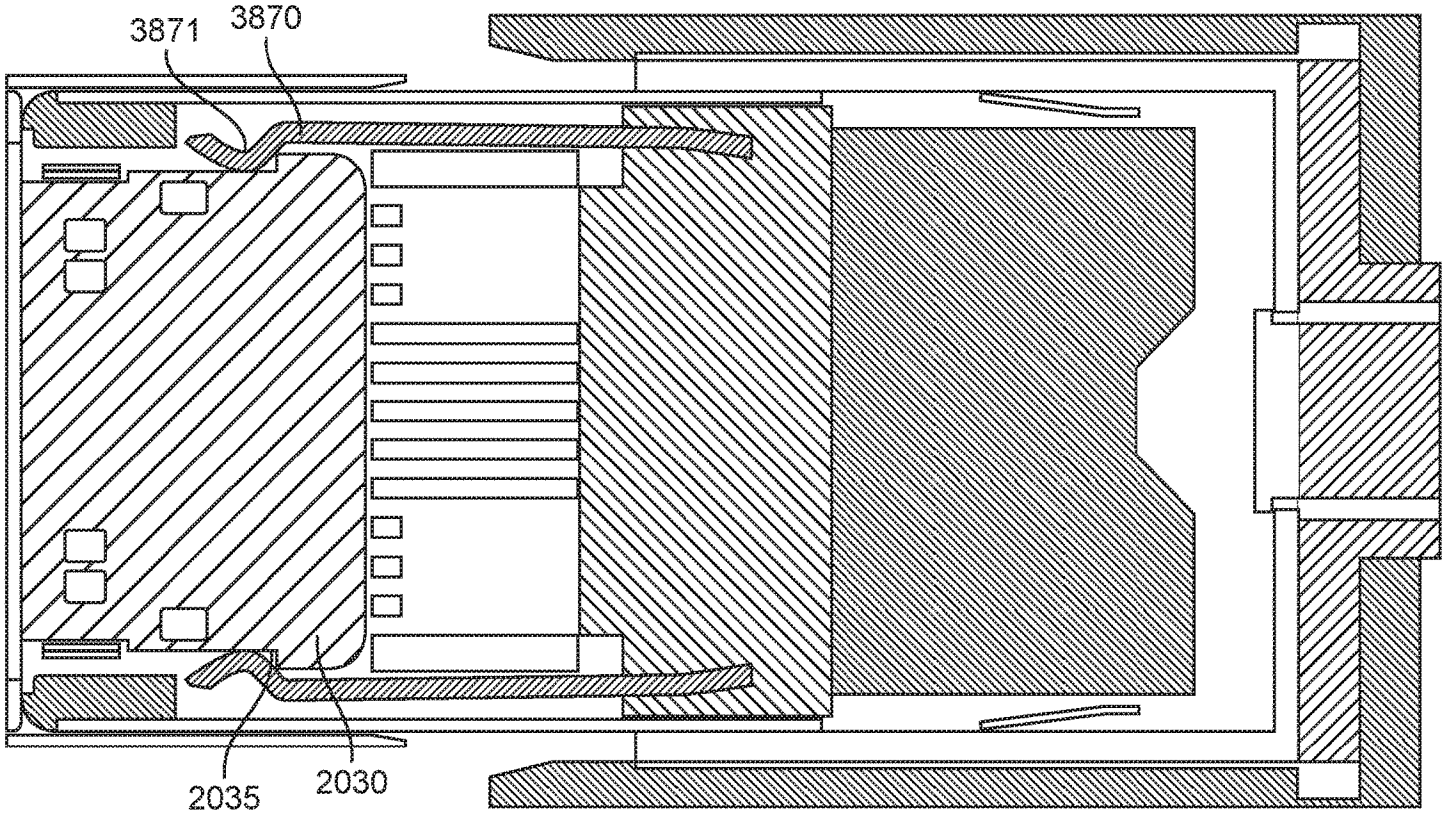
FIG. 44 illustrates a top view of a connector system according to an embodiment of the present invention.

FIG. 44 illustrates a top view of a connector system according to an embodiment of the present invention. In this figure, side ground contacts 3870 may include contacting portions, 3871 which may engage notch 2035 on tongue 2030.

Figure 45:
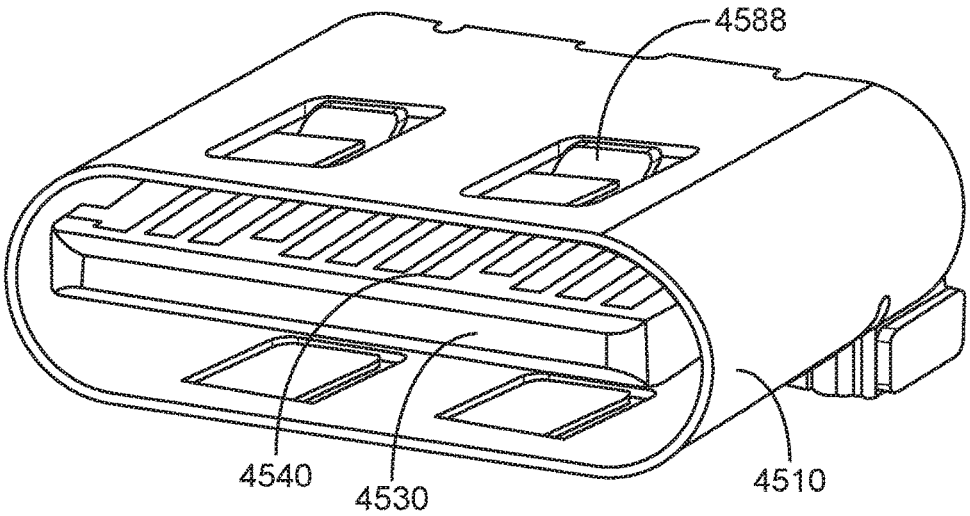
FIG. 45 illustrates a connector receptacle according to an embodiment of the present invention.

FIG. 45 illustrates a connector receptacle according to an embodiment of the present invention. Shield 4510 may include fingers 4588. Fingers 4588 may form an electrical connection with a shield of a connector insert when a connector insert is inserted into this connector receptacle. Tongue 4530 may be located inside shield 4510, and may support a number of contacts 4540.

Figure 46:
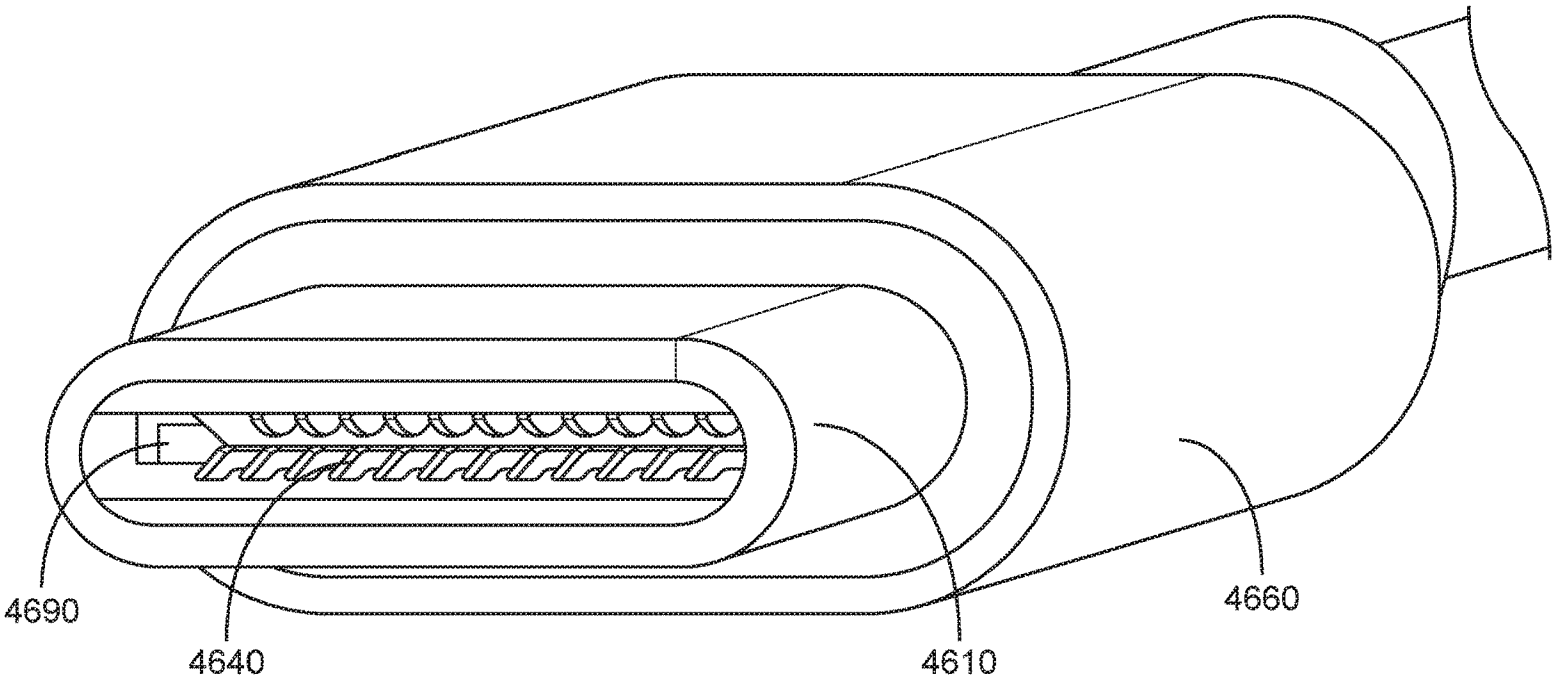
FIG. 46 illustrates a connector insert according to an embodiment of the present invention.

FIG. 46 illustrates a connector insert according to an embodiment of the present invention. A shield 4610 may extend from a front of housing 4660. Contacts 4640 and side ground contacts 4690 may be located inside of shield 4610. Shield 4610 may form electrical connections with fingers 4588 on the connector receptacle of FIG. 45.

In various embodiments of the present invention, contacts at an opening of the connector insert, such as contacts 430 and 2230, may form electrical connections with one or more ground pads on a connector receptacle tongue. Also, the connector insert shield may electrically contact receptacle shield 510. This arrangement may form an electrical shield around contacts in the connector insert and connector receptacle. In other embodiments of the present invention, this shielding may be done in other ways. For example, one or more fingers may be located on either the receptacle shield or connector insert shield. These fingers may make electrical contact with the corresponding shield of the other connector. One or more of these fingers may also fit in or engage an opening on the corresponding shield to provide a retention force between the connector insert and connector receptacle. Specifically, during insertion, the insert shield may fit inside the receptacle shield. Fingers on the receptacle shield may pass along an outside of the insert shield. Contact portions of the fingers may fit in openings in a side of the connector insert shield. An example is shown in the following figures.

Figure 47:
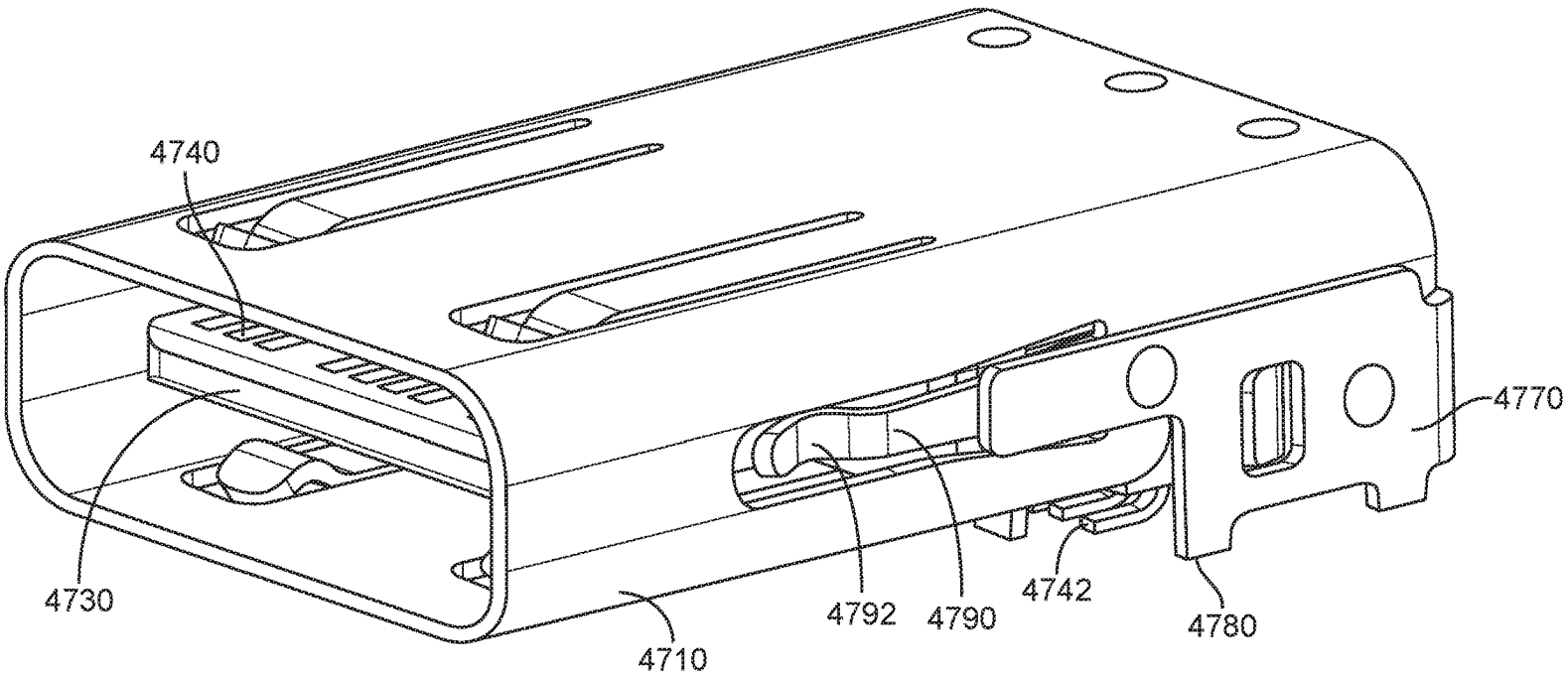
FIG. 47 illustrates a connector receptacle according to an embodiment present invention.

FIG. 47 illustrates a connector receptacle according to an embodiment present invention. This connector receptacle may include a tongue 4730 supporting a number of contacts 4740 on a top and bottom side. Shield 4710 may surround the tongue. Lower shield portion 4770 may support the tongue and provide one or more tabs 4780, which may fit in openings in a printed circuit board or other property substrate. Contact tail portions 4742 may electrically connect to contacts 4740 on tongue 4730.

Shield 4710 may include one or more fingers 4790. Fingers 4790 may be stamped from shield 4710. Fingers 4790 may include contact portions 4792. Contact portions 4792 may engage with a shield of a connector insert when the connector insert is inserted into the connector receptacle. Contact portions 4792 on one or more fingers 4790 may engage or fit in openings in the connector insert shield. Again, while in this example, fingers 4790 are located in shield 4710 of a connector receptacle, in other embodiments of the present invention, these fingers may be located on a connector insert, or both the connector insert and connector receptacle. Corresponding openings may be similarly located on either or both the connector receptacle or connector insert.

Figure 48:
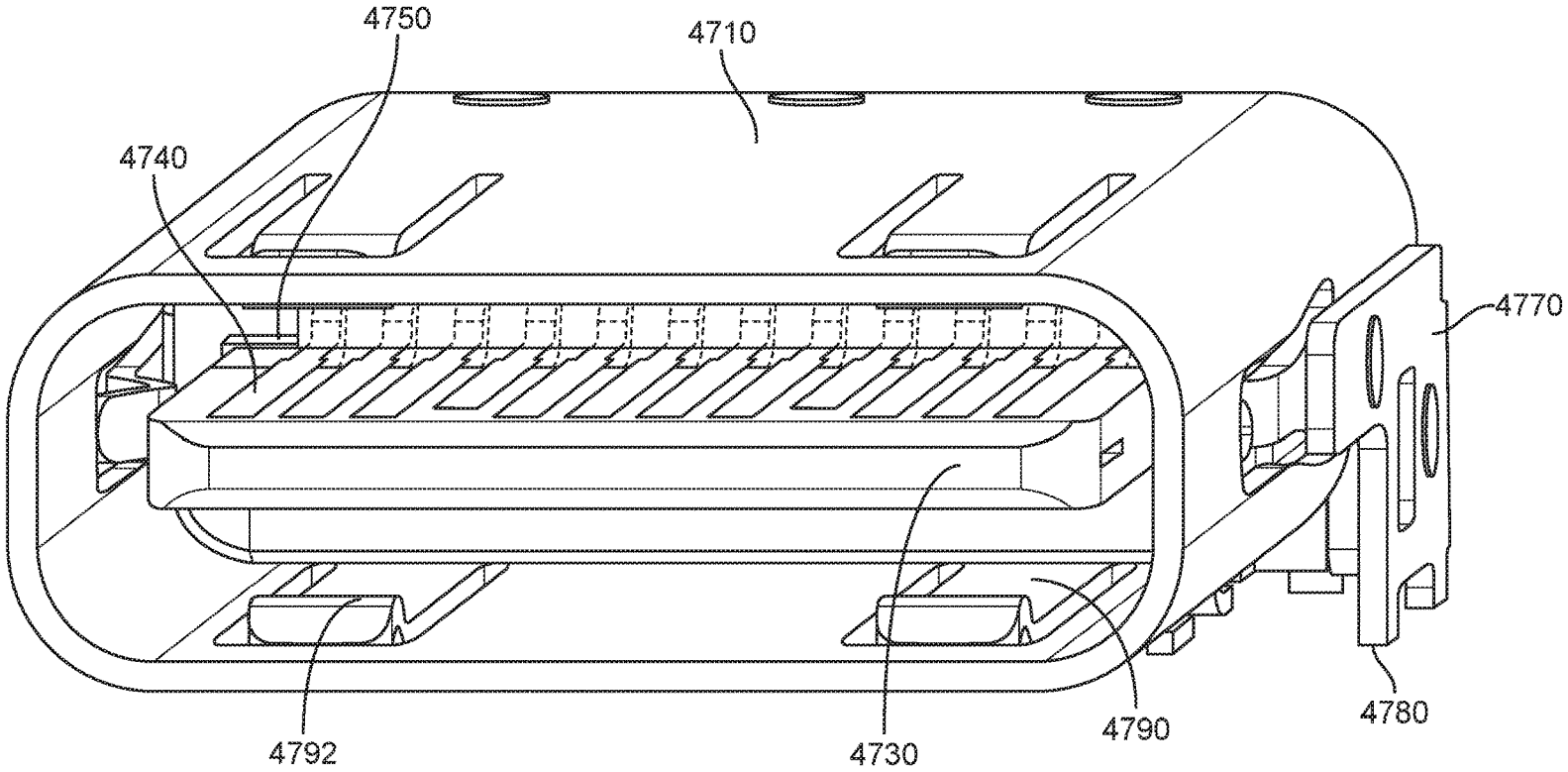
FIG. 48 illustrates a front view of the connector receptacle of FIG. 47.

FIG. 48 illustrates a front view of the connector receptacle of FIG. 47. As before, receptacle shield 4710 may be formed around tongue 4730. Tongue 4730 may support one or more contacts 4740. Shield 4710 may include one or more fingers 4790 having contacting portions 4792. Shield 4710 may be supported by housing or brackets 4750 and lower shield portion 4770. Lower shield portion 4770 may include one or more tabs 4780, as before.

Figure 49:
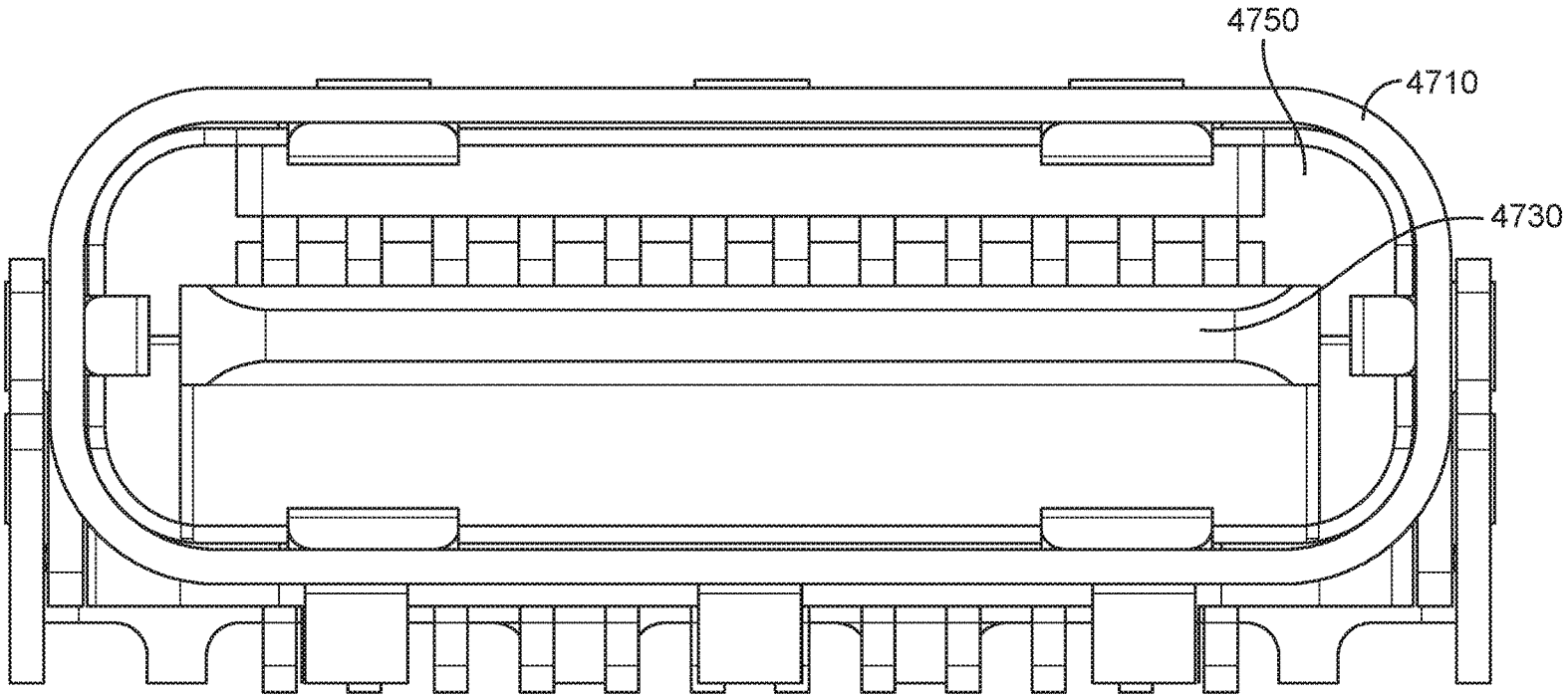
FIG. 49 illustrates another front view of a connector receptacle of FIG. 47.

FIG. 49 illustrates a front view of a connector receptacle of FIG. 47. Again, tongue 4730 may be supported by housing or bracket 4750. Housing or bracket 4750 and tongue 4730 may be at least partially surrounded by shield 4710.

Figure 50:
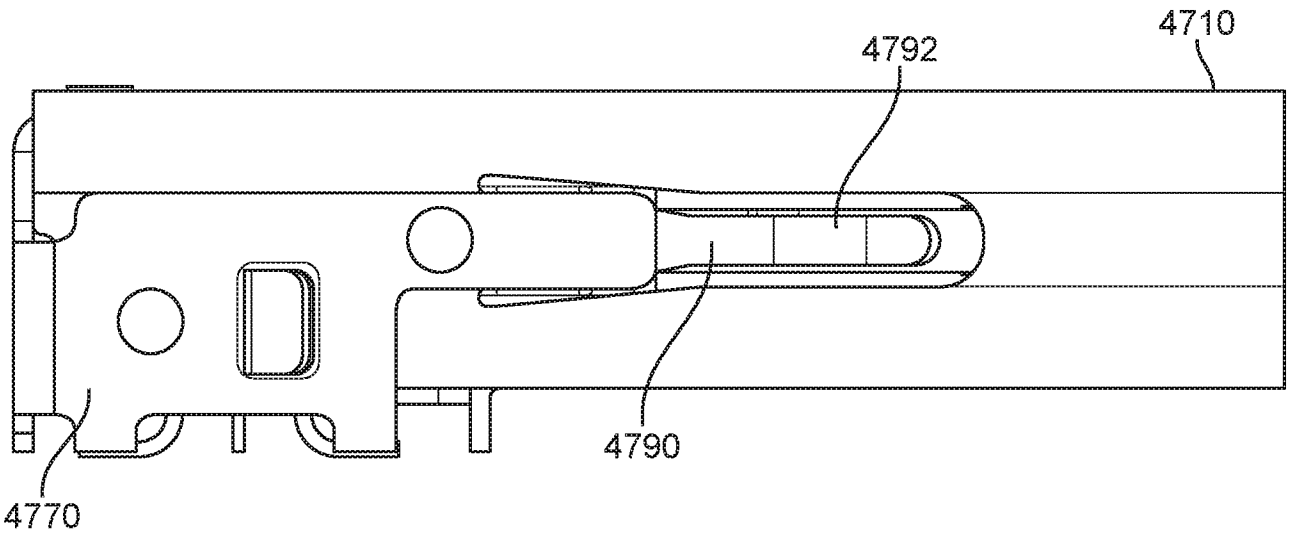
FIG. 50 illustrates a side view of a connector receptacle in FIG. 47.

FIG. 50 illustrates a side view of a connector receptacle in FIG. 50. Again, finger 4790 may include contact portion 4792. Shield 4710 may be mechanically supported by lower shield portion 4770.

Figure 51:
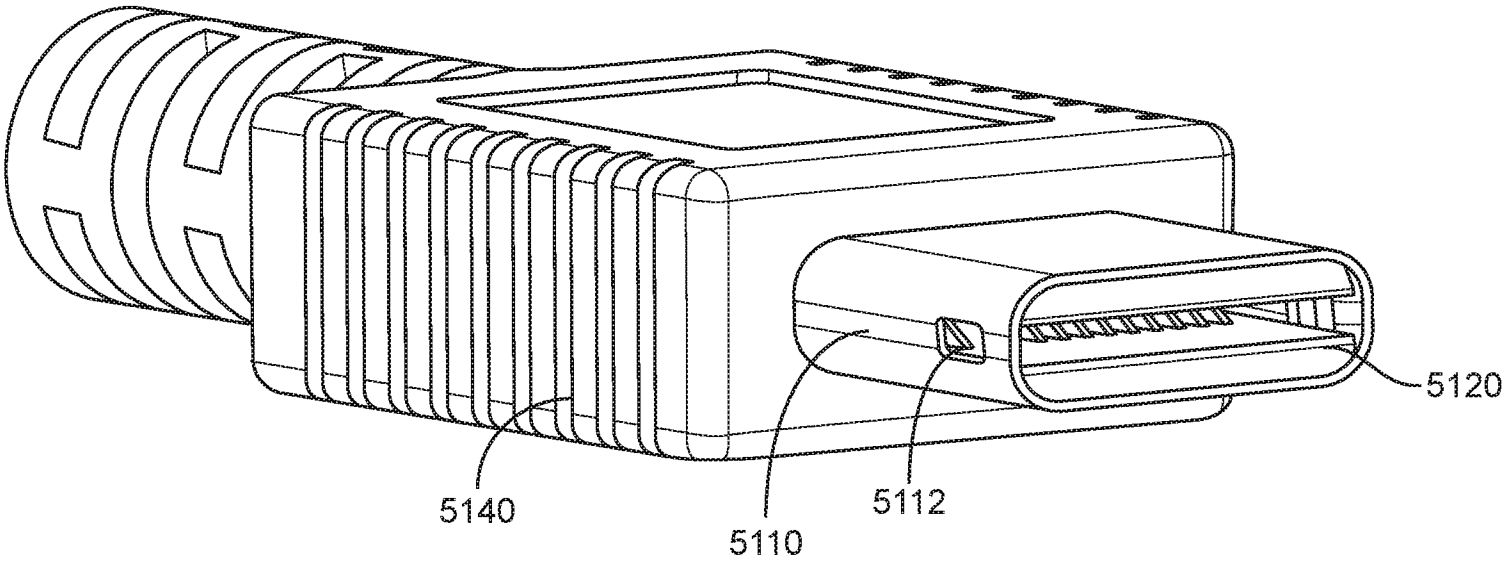
FIG. 51 illustrates another connector plug or insert according to an embodiment of the present invention.

FIG. 51 illustrates another connector insert according to an embodiment of the present invention. This connector insert may include shield 5110. Shield 5110 may include opening 5112. Shield 5110 may be formed around insert housing 5120. This connector insert may further include housing portion 5140 which may be formed around circuitry in a printed circuit board. Housing 5140 may be serrated to improve user handling. When this connector insert is inserted into the connector receptacle of FIG. 47, contact portion 4792 of spring finger 4790 may slide along an outside of shield 5110 and fit in or engage opening 5112.

Again, embodiments of the present invention may provide connector receptacles inserts that may convey signals compatible with one or more interface standards or protocols. In some circumstances, it may be desirable to provide connector inserts in receptacles that may be compatible with a reduced number of interfaces standards. For example, it may be desirable to provide a connector receptacle that may accept one of the connector inserts shown above, even though the connector receptacle may only be compatible with a reduced number of interface standards. An example is shown below.

Figure 52:
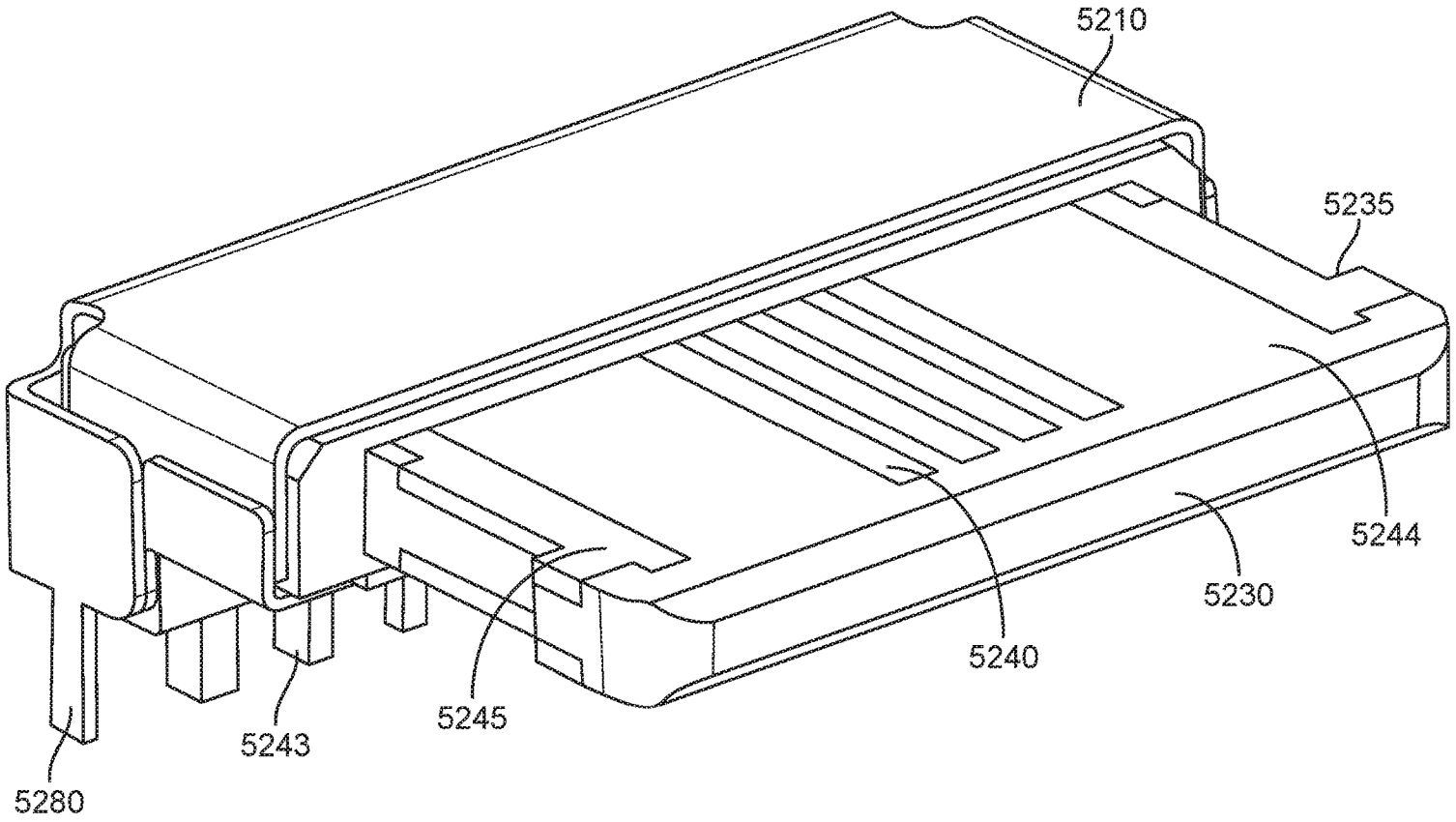
FIG. 52 illustrates a portion of a connector receptacle according to an embodiment of the present invention.

FIG. 52 illustrates a portion of a connector receptacle according to an embodiment of the present invention. This connector receptacle may be compatible with only one or more USB interface standards, such as USB1, USB2, or USB3. This in turn may enable the connector receptacle to include a reduced number of pins 5240, thereby simplifying its construction. The supply construction may also result in a reduced size. Also, since USB is relatively low-speed signaling, this connector receptacle may not require a shield around tongue 5230, but instead may employ a much smaller shield 5210. This smaller shield may provide a smaller connector receptacle assembly that may consume a reduced amount of space inside a device. In various embodiments of the present invention, since a large shield is not used, a surface of an opening in enclosure itself may be used as a ground path, or other contacts or structures may be placed in the opening.

This connector receptacle may include tongue 5230 having side notches 5235. Side notches 5235 may create retention features. Ground contacts 5245 may include a top surface for accepting a signal contact in a connector insert, and side ground areas for forming an electrical connection with a side ground contact in connector receptacle. Tongue 5230 may include plastic molded isolation area 5244 for supporting contacts 5240 and 5245. Contact tails 5243 may connect to contacts 5240. Contact tails 5243 may be surface mount contacts, through-hole contacts, or other types of contacts. Shield tabs 5240 and contact tails 5243 may electrically connect to holes or pads on a printed circuit board or other appropriate substrate.

Figure 53:
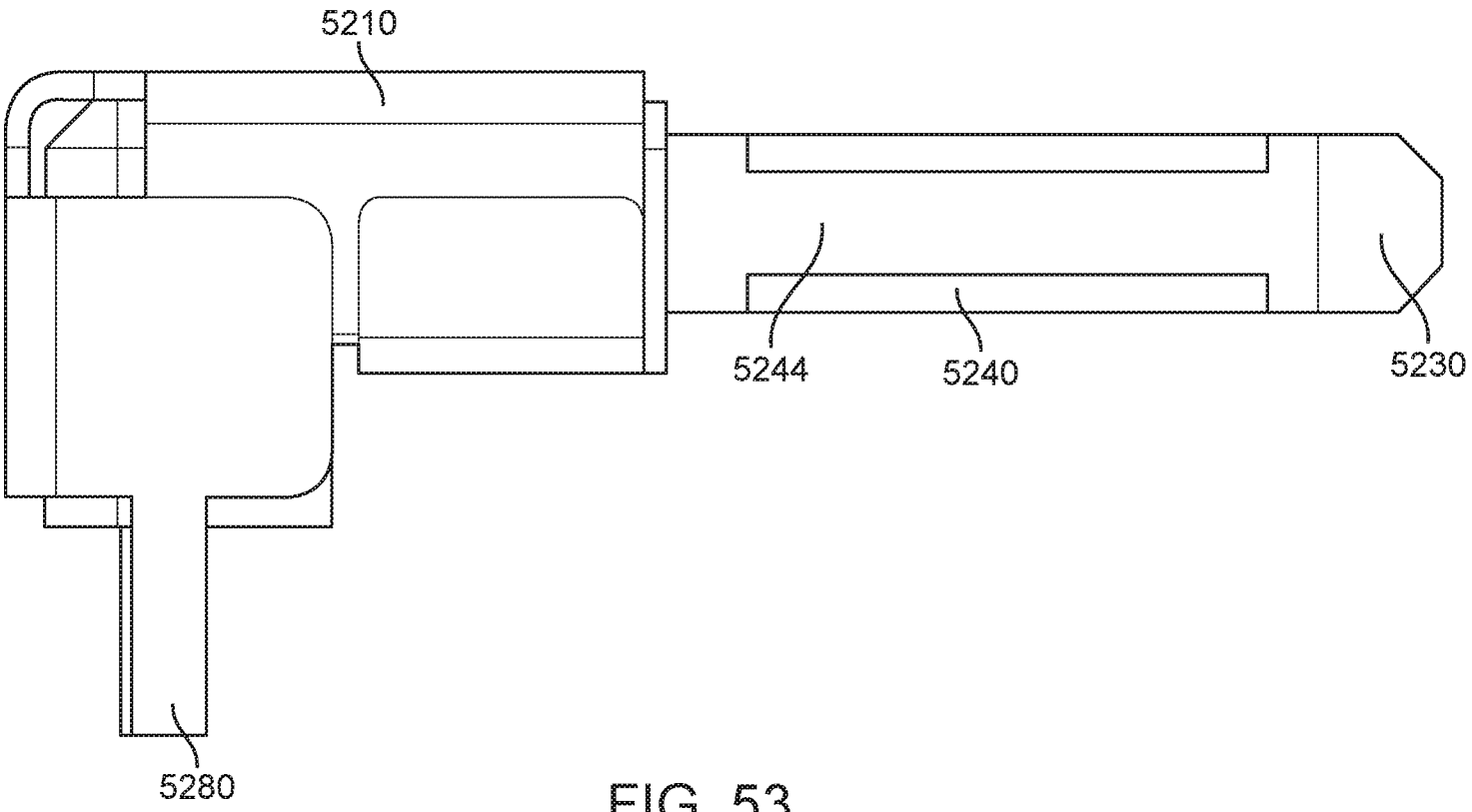
FIG. 53 illustrates a side view of the connector receptacle of FIG. 52.

FIG. 53 illustrates a side view of the connector receptacle of FIG. 52. Again, since this connector receptacle is dedicated for USB interfaces, a reduced size shield 5210 may be employed. Tabs 5280 may connect shield 5210 to ground traces or contacts on a printed circuit board. Tongue 5230 may support number of contacts, including ground contacts 5245. Tongue 5230 may be formed of plastic piece 5244 supporting contacts 5245 and 5240.

Figure 54:
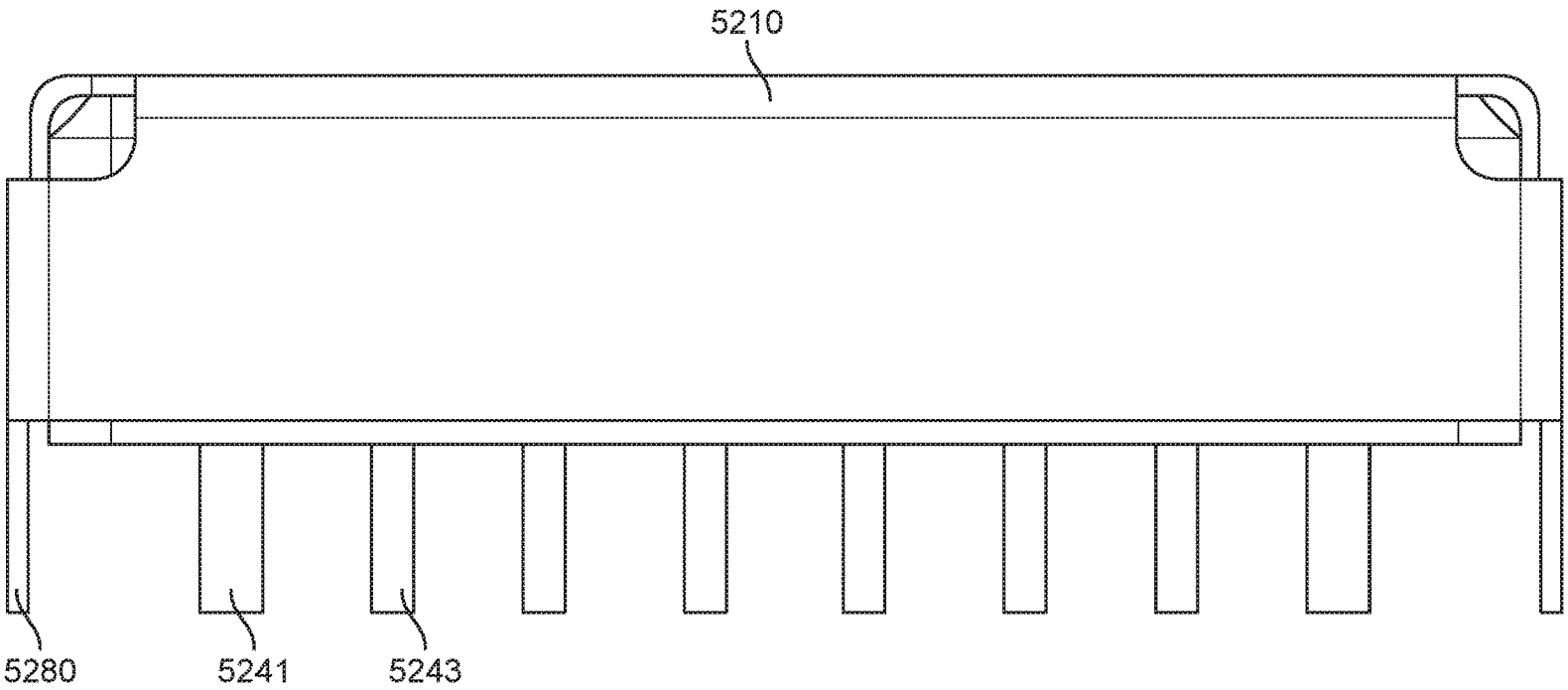
FIG. 54 illustrates a rear view of the connector receptacle of FIG. 52.

FIG. 54 illustrates a rear view of the connector receptacle of FIG. 52. Again, a reduced size shield 5210 may be employed since this connector receptacle may be arranged to convey only lower speed USB signals. Ground tabs 5280 may electrically connect shield 5210 to a ground on a printed circuit board. Contact tails 5241 may electrically connect ground contacts 5240 to a printed circuit board or other appropriate substrate, while contact tails 5243 may electrically connect contacts 5245 to printed circuit board or other appropriate substrate.

Again, embodiments of the present invention may provide connector receptacles having very thin tongues. When an insert is extracted, spring type signal contacts in a top row of the insert may engage spring type signal contacts in a bottom row of the insert. To prevent this from causing damage, power pins in one row may be arranged such that they are not aligned with ground pins in the other row. A pinout providing this is shown in the following figure.

FIG. 55 illustrates a pinout for a connector receptacle according to embodiments the present invention. This pinout may support a universal connector that may provide and receive signals for more than one standard or proprietary interface. In this example, P may be power, G may be ground, RX and TX may be differential signal lines, while the LS lines are control lines.

FIG. 56 illustrates a pinout for another connector receptacle according to embodiments the present invention. This pinout may support a universal connector that may provide and receive signals for more than one standard or proprietary interface. In this example, G may be ground, HVP may be power, the HS pins may carry differential signal pairs, USB may convey USB signals, while RFU and C signals are control or other similar signals.

FIG. 57 illustrates a mapping of pins for various types of interfaces to pins of a connector receptacle according to an embodiment of the present invention. In this example, mappings for DisplayPort and HDMI, for receiving and transmitting (sink and source), power chargers, and USB interfaces are shown.

FIG. 58 illustrates another pinout according to an embodiment of the present invention.

Figure 59:
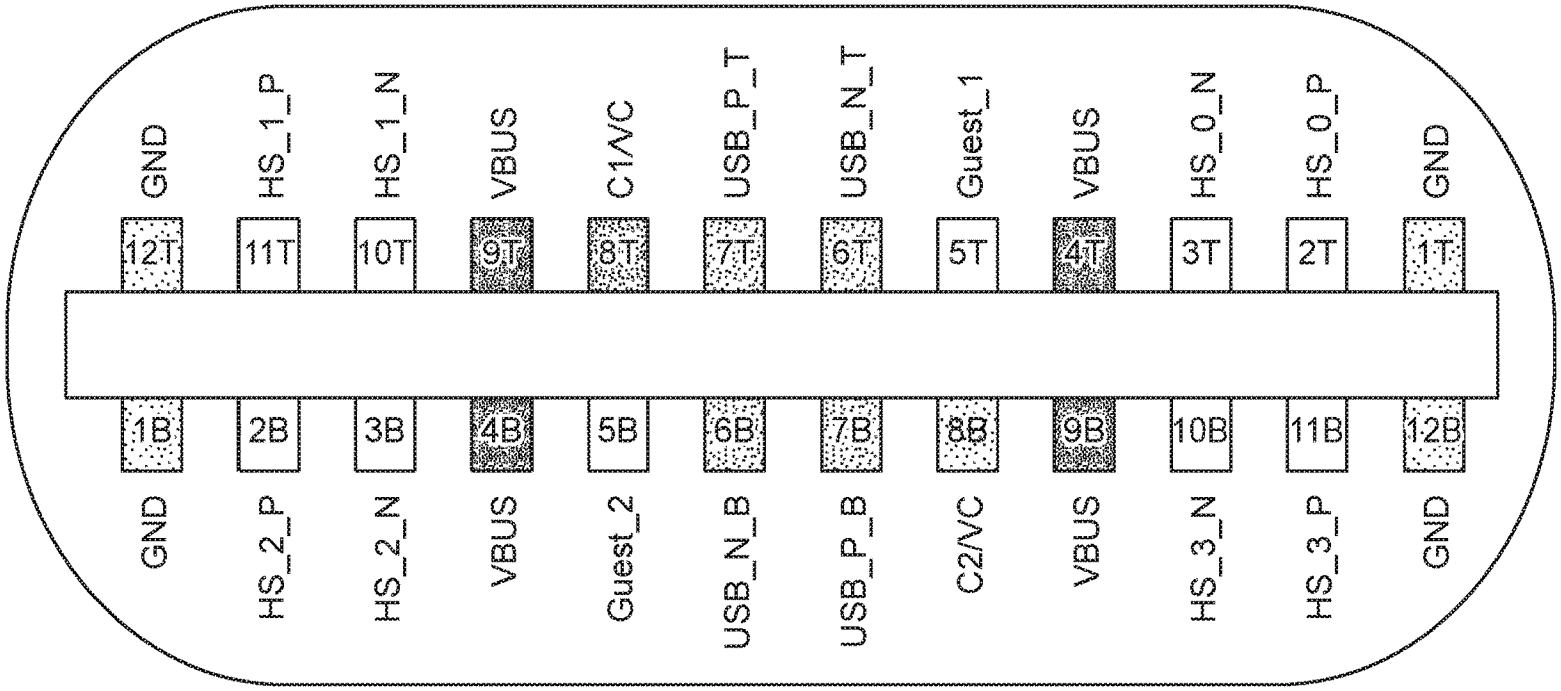
FIG. 59 is another pinout for a connector receptacle according to embodiments the present invention.

FIG. 59 illustrates another mapping of pins for various types of interfaces to pins of a connector receptacle according to an embodiment of the present invention. These mappings show that embodiments of the present invention may provide connector receptacles and inserts that may convey power, ground, and data, including audio and video information. These connectors and receptacles may be flippable or rotatable. That is, embodiments of the present invention may provide a connector system where a connector insert may be inserted in either of two orientations 180 degrees apart into a connector receptacle.

In various embodiments of the present invention, contacts and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connector inserts and receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector inserts and receptacles may provide pathways for signals that are compliant with various standards such as one of the Universal Serial Bus (USB) standards including USB-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector inserts and receptacles that may be used to provide a reduced set of functions for one or more of these standards. In various embodiments of the present invention, these interconnect paths provided by these connector inserts and receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An electronic device comprising:

a receptacle comprising:

a tongue having a major axis extending laterally across a front opening of the receptacle from a first side of the tongue to a second side of the tongue;

a first plurality of contacts having contacting portions on a top of the tongue;

a second plurality of contacts having contacting portions on a bottom of the tongue;

a first ground pad located on the top of the tongue, wherein the contacting portions of the first plurality of contacts are located between the first ground pad and the front opening of the receptacle;

a second ground pad located on the bottom of the tongue, wherein the contacting portions of the second plurality of contacts are located between the second ground pad and the front opening of the receptacle;

a first shield around the tongue, the first shield having a first side opening positioned laterally from the first side of the tongue and a second side opening positioned laterally from the second side of the tongue; a first side ground contact spaced away from the first side of the tongue and located in the first side opening of the first shield; and a second side ground contact spaced away from the first side of the tongue and located in the second side opening of the first shield.

2. The electronic device of claim 1 wherein the first ground pad is a ground pad in a first plurality of ground pads on the top of the tongue.

3. The electronic device of claim 1 wherein the first side ground contact and the second side ground contact electrically connect to a shield of a corresponding connector insert when the corresponding connector insert is inserted into the receptacle.

4. The electronic device of claim 3 further comprising:
a second shield attached to a rear portion of the first shield.

5. The electronic device of claim 4 wherein the tongue has notches in each of the first side and the second side to engage side ground contacts in the corresponding connector insert when the corresponding connector insert is mated to the receptacle.

6. The electronic device of claim 3 wherein the second ground pad is one of a second plurality of ground pads on a bottom of the tongue.

7. The electronic device of claim 1 wherein the first side ground contact and the second side ground contact physically and electrically connect to a shield of a corresponding connector insert when the corresponding connector insert is inserted into the receptacle.

8. A connector insert comprising:
a top row of contacts;
a bottom row of contacts;
a first housing around mid-portions of each of the top row of contacts and the bottom row of contacts;
a second housing having a plurality of slots supporting contacting portions of the top row of contacts and the bottom row of contacts;
a shield around the first housing and the second housing;
a top row of ground contacts located in top openings in the second housing between the top row of contacts and a front opening of the connector insert; and
a bottom row of ground contacts located in bottom openings in the second housing between the bottom row of contacts and the front opening of the connector insert.

9. The connector insert of claim 8 wherein the first housing is plastic.

10. The connector insert of claim 8 wherein the shield is conductive.

11. The connector insert of claim 10 wherein the shield is formed of steel.

12. The connector insert of claim 8 wherein the top row of ground contacts are formed as a single piece.

13. The connector insert of claim 8 further comprising a printed circuit board attached to a rear of the connector insert.

14. The connector insert of claim 8 wherein the shield forms a lip of the front opening of the connector insert.

15. The connector insert of claim 14 wherein the top row of ground contacts are positioned such that undesirable connections to contacts in a connector receptacle are not formed when the connector insert is inserted into the connector receptacle.

16. The connector insert of claim 8 wherein the first housing is molded as a single piece around mid-portions of each of the top row of contacts and the bottom row of contacts.

17. A connector receptacle comprising:
a first plurality of contacts;
a first housing around a mid-portion of each of the first plurality of contacts;
a second plurality of contacts;
a second housing around a mid-portion of each of the second plurality of contacts;
a central ground plane;
a tongue comprising a non-conductive piece over a front of the central ground plane and having first slots on a top side for contacting portions of each of the first plurality of contacts and second slots on a bottom side for contacting portions of each of the second plurality of contacts;
a first ground pad located on a top surface of the first housing;
a second ground pad located on a bottom surface of the second housing; and
a shield around the tongue.

18. The connector receptacle of claim 17 wherein the tongue has notches in each of a left and right side to engage side ground contacts in a connector insert when the connector insert is mated to the connector receptacle.

19. The connector receptacle of claim 18 wherein the shield is conducive.

20. The connector receptacle of claim 18 wherein the shield includes a finger for contacting a shield around the connector insert.

21. The connector receptacle of claim 20 wherein the shield includes a plurality of fingers for contacting a shield around the connector insert.

22. The connector receptacle of claim 17 wherein the shield is formed of steel.

23. The connector receptacle of claim 17 wherein a first outside edge of the central ground plane, a first ground contact in the first plurality of contacts, and a first ground contact in the second plurality of contacts form a first ground contact on a first side of the tongue, and
wherein a second outside edge of the central ground plane, a second ground contact in the first plurality of contacts, and a second ground contact in the second plurality of contacts form a second ground contact on a second side of the tongue.

* * * * *